US010806975B2

(12) United States Patent
Onuki et al.

(10) Patent No.: US 10,806,975 B2
(45) **Date of Patent: *Oct. 20, 2020**

(54) GOLF CLUB

(71) Applicant: SUMITOMO RUBBER INDUSTRIES, LTD., Kobe-shi, Hyogo (JP)

(72) Inventors: Masahide Onuki, Kobe (JP); Yuki Motokawa, Kobe (JP); Naruhiro Mizutani, Kobe (JP)

(73) Assignee: SUMITOMO RUBBER INDUSTRIES, LTD., Kobe-shi, Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/205,440

(22) Filed: Nov. 30, 2018

(65) Prior Publication Data

US 2019/0168083 A1 Jun. 6, 2019

(30) Foreign Application Priority Data

Dec. 1, 2017 (JP) ..... 2017-231503

(51) Int. Cl.

| | |
|---|---|
| ***A63B 53/02*** | (2015.01) |
| ***A63B 53/04*** | (2015.01) |
| ***A63B 53/08*** | (2015.01) |
| *A63B 102/32* | (2015.01) |

(52) U.S. Cl.

CPC ..... *A63B 53/02* (2013.01); *A63B 53/0466* (2013.01); *A63B 53/047* (2013.01); *A63B 53/0487* (2013.01); *A63B 53/08* (2013.01); *A63B 2053/023* (2013.01); *A63B 2102/32* (2015.10)

(58) Field of Classification Search

CPC ..... A63B 53/02; A63B 53/0466; A63B 53/08; A63B 2102/32; A63B 53/0487; A63B 2053/023; A63B 53/047

USPC ..... 473/305–315, 244–248

See application file for complete search history.

(56) References Cited

U.S. PATENT DOCUMENTS

| | | | | | |
|---|---|---|---|---|---|
| 4,697,814 | A | * | 10/1987 | Yamada | A63B 53/04 473/348 |
| 4,699,383 | A | * | 10/1987 | Kobayashi | A63B 53/04 473/348 |
| 5,149,091 | A | * | 9/1992 | Okumoto | A63B 53/02 473/311 |

(Continued)

FOREIGN PATENT DOCUMENTS

| | | | |
|---|---|---|---|
| JP | 60-108888 U1 | | 7/1985 |
| JP | 2006-42950 | * | 2/2006 |

*Primary Examiner* — Sebastiano Passaniti

(74) *Attorney, Agent, or Firm* — Birch, Stewart, Kolasch & Birch, LLP

(57) ABSTRACT

A golf club includes a head including a hosel part, a shaft, and a tip engagement part having a reverse-tapered shape and being disposed at a tip end portion of the shaft. The tip engagement part includes a sleeve having a reverse-tapered shape and being fixed to the tip end portion of the shaft. The hosel part includes a hosel hole. The hosel hole includes a reverse-tapered hole corresponding to at least a part of the outer surface of the tip engagement part. The tip engagement part is fitted to the reverse-tapered hole. Of the hosel hole, at least an upper end edge and a lower end edge are formed by a resin.

16 Claims, 52 Drawing Sheets

(56) References Cited

U.S. PATENT DOCUMENTS

| | | | | |
|---|---|---|---|---|
| 5,226,659 | A * | 7/1993 | Lo | A63B 53/04 473/348 |
| 7,980,959 | B2 | 7/2011 | Morris et al. | |
| 9,814,943 | B2 * | 11/2017 | Onuki | A63B 53/0466 |
| 10,207,159 | B2 * | 2/2019 | Onuki | A63B 53/007 |
| 10,279,223 | B2 * | 5/2019 | Onuki | A63B 60/42 |
| 10,328,318 | B2 * | 6/2019 | Onuki | A63B 53/02 |
| 10,369,426 | B2 * | 8/2019 | Onuki | A63B 53/02 |
| 2010/0234123 | A1 * | 9/2010 | Sato | A63B 53/02 473/307 |
| 2012/0071258 | A1 * | 3/2012 | Yamaguchi | A63B 53/00 473/287 |
| 2013/0017901 | A1 | 1/2013 | Sargent et al. | |
| 2017/0157471 | A1 | 6/2017 | Onuki et al. | |

* cited by examiner

PH1

GOLF CLUB

The present application claims priority on Patent Application No. 2017-231503 filed in JAPAN on Dec. 1, 2017. The entire contents of this Japanese Patent Application are hereby incorporated by reference.

BACKGROUND OF THE INVENTION

Field of the Invention

The present disclosure relates to a golf club.

Description of the Related Art

A club including an attaching/detaching mechanism configured such that a shaft can be detachably attached to a head has been known. Each of US2013/0017901 and U.S. Pat. No. 7,980,959 discloses a golf club including the attaching/detaching mechanism.

As to the attaching/detaching mechanism, a new structure has been proposed. In a golf club disclosed in JP2017-99795 (US2017/0157471), the shaft can be fixed to the head by engaging a tip engagement part provided on a tip end portion of the shaft with a hosel hole having a reverse-tapered hole.

SUMMARY OF THE INVENTION

An attaching/detaching mechanism in which a shaft can be securely fixed to a head and which has easy operability is preferable. It is also preferable that inconveniences which may occur in attaching/detaching operations can be prevented. The present disclosure provides a golf club capable of suppressing such inconveniences which may occur in attaching/detaching operations.

In one aspect, a golf club includes a head including a hosel part, a shaft, and a tip engagement part that has a reverse-tapered shape and is disposed at a tip end portion of the shaft. The tip engagement part includes a sleeve that has a reverse-tapered shape and is fixed to the tip end portion of the shaft. The hosel part includes a hosel hole. The hosel hole includes a reverse-tapered hole that corresponds to at least a part of the outer surface of the tip engagement part. The tip engagement part is fitted to the reverse-tapered hole. At least an upper end edge and a lower end edge of the hosel hole are formed by a resin.

BRIEF DESCRIPTION OF THE DRAWINGS

FIG. 20 shows a state at a starting time of the passing process;

DESCRIPTION OF THE PREFERRED EMBODIMENTS

The following will describe embodiments in detail with appropriate reference to the drawings.

Unless otherwise described, "a circumferential direction" in the present application means a circumferential direction of a shaft. Unless otherwise described, "an axial direction" in the present application means an axial direction of the shaft. Unless otherwise described, "an axial perpendicular direction" in the present application means a direction orthogonally crossing the axial direction of the shaft. Unless otherwise described, a section in the present application means a section along a plane perpendicular to a center line of the shaft. Unless otherwise described, a grip side in the axial direction of the shaft is defined as an upper side, and a sole side in the axial direction of the shaft is defined as a lower side.

Figure 1:
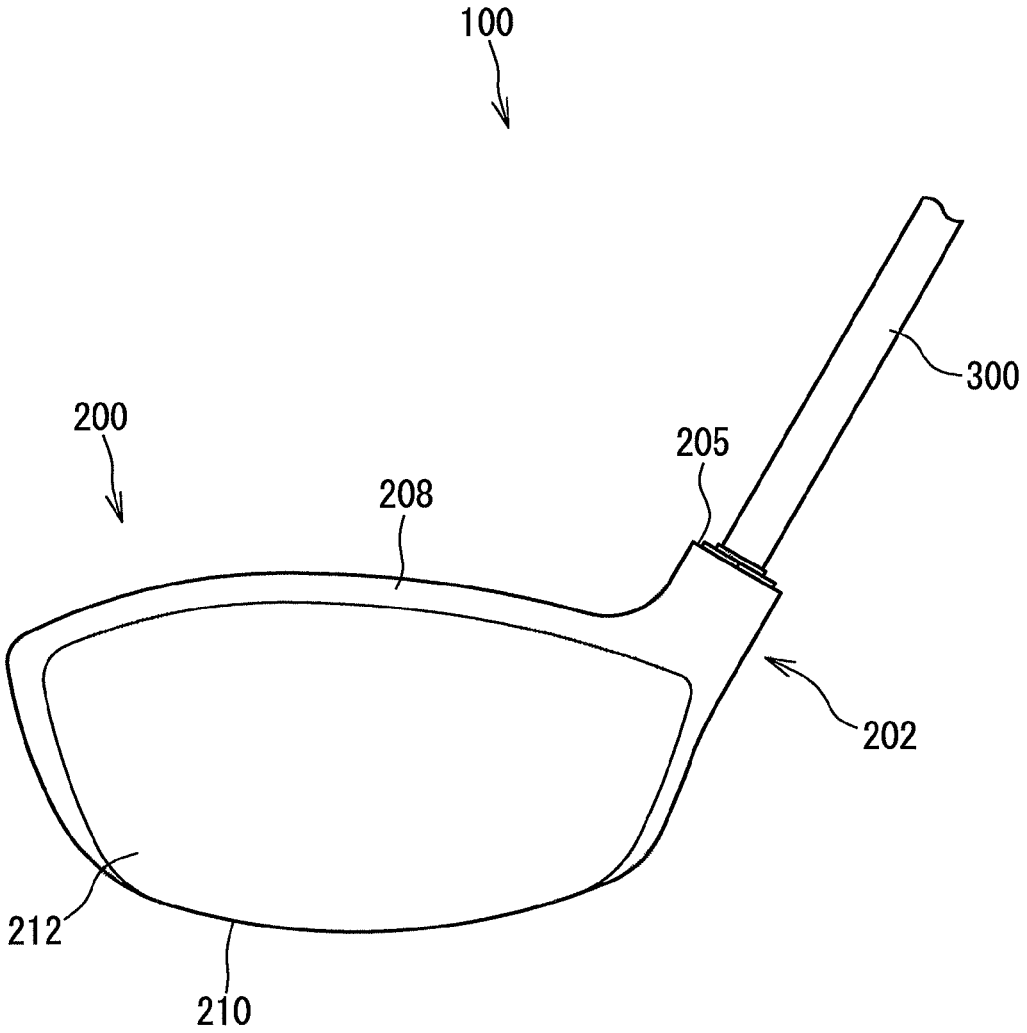
FIG. 1 shows a golf club according to one embodiment.
Figure 2:
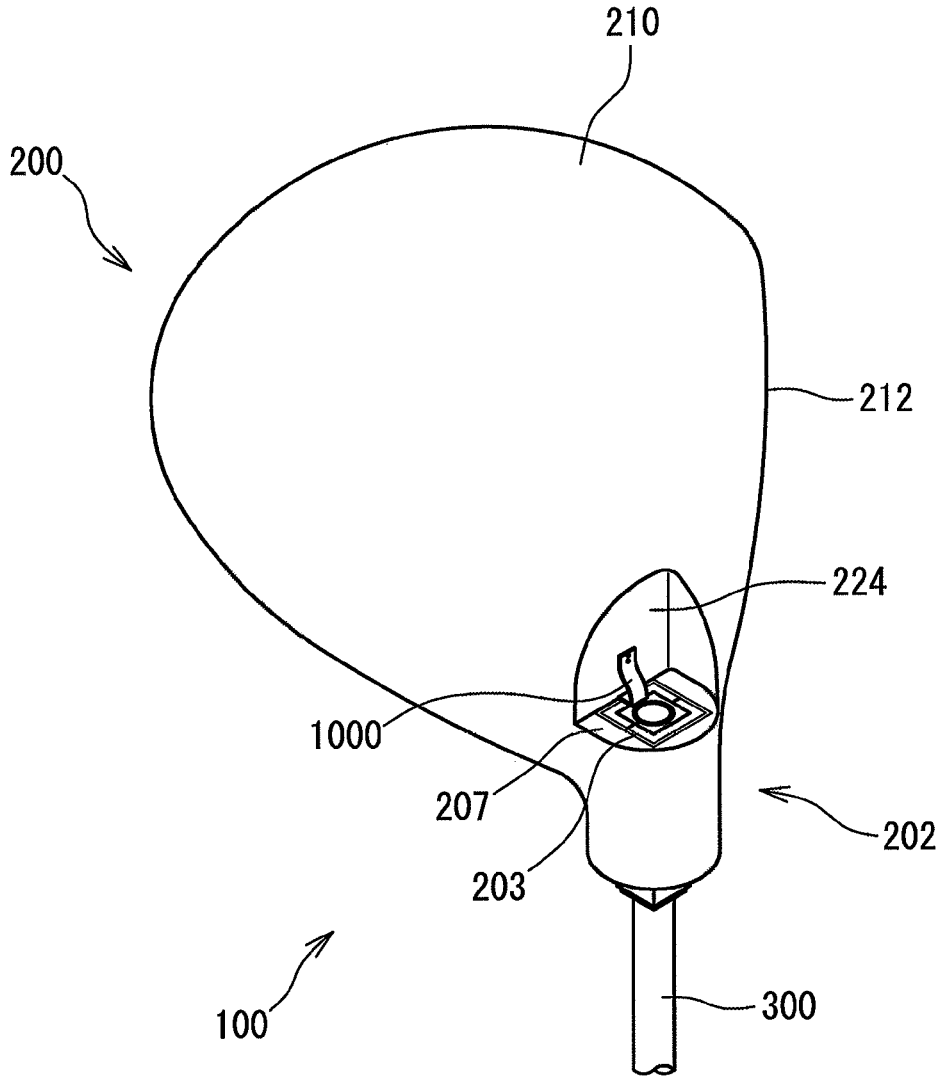
FIG. 2 is a perspective view of the golf club in FIG. 1 as viewed from a sole side.
Figure 3:
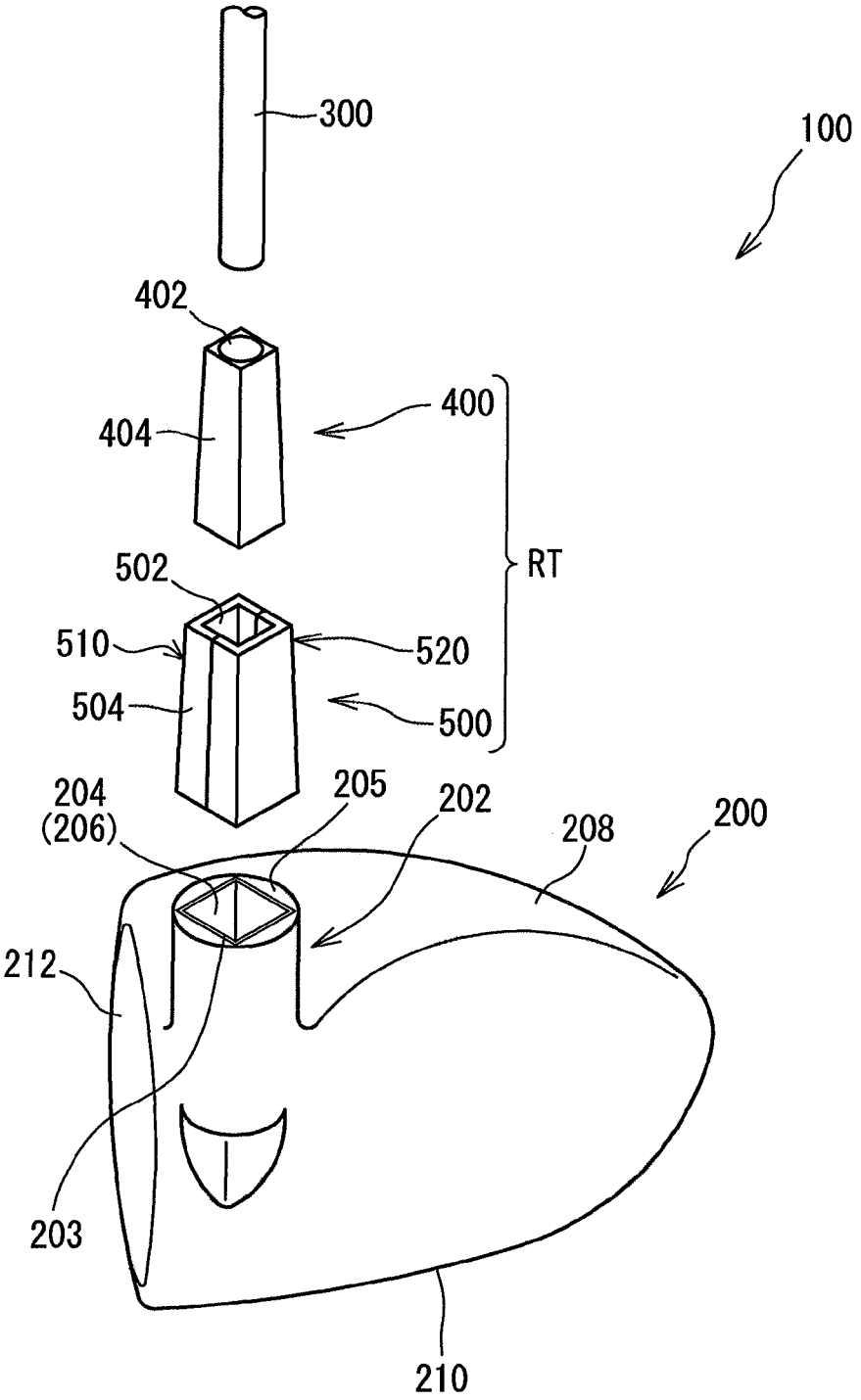
FIG. 3 is an exploded view of the golf club in FIG. 1.

FIG. 1 shows a golf club 100 which is a first embodiment. FIG. 1 shows only the vicinity of a head of the golf club 100. FIG. 2 is a perspective view of the golf club 100 as viewed from the sole side. FIG. 3 is an exploded perspective view of the golf club 100.

The golf club 100 includes a head 200, a shaft 300, a sleeve 400, a spacer 500, and a grip (not shown in the drawings). The sleeve 400 and the spacer 500 constitute a tip engagement part RT. The tip engagement part RT is disposed at a tip end portion of the shaft 300. An outer surface of the tip engagement part RT is formed by the spacer 500.

The type of the head 200 is not limited. The head 200 of the present embodiment is a wood type head. The head 200 may be a hybrid type head, an iron type head, a putter head or the like. The wood type head may be a driver head, or may be a head of a fairway wood.

The shaft 300 is not limited, and for example, a carbon shaft and a steel shaft may be used.

Although not shown in the drawings, the shaft 300 has a diameter varying with an axial direction position thereof. The diameter of the shaft 300 is increased toward the grip side. The sleeve 400 is fixed to the tip end portion of the shaft 300. The tip end portion of the shaft 300 is the thinnest portion in the shaft 300.

In the present embodiment, the number of the spacers 500 is one. As described later, the spacer 500 may not be present. The number of the spacers may be two. Two spacers may be stacked. In other words, the spacer may be double-layered. The number of the spacers may be three or more. For example, three spacers may be stacked. In other words, the spacer may be triple-layered.

The head 200 includes a hosel part 202. The hosel part 202 includes a hosel hole 204. The hosel hole 204 includes a reverse-tapered hole 206. The shape of the reverse-tapered hole 206 corresponds to the shape of the outer surface of the tip engagement part RT. The shape of the reverse-tapered hole 206 corresponds to the shape of the outer surface of the spacer 500. In an engagement state, the outer surface of the tip engagement part RT (the outer surface of the spacer 500) is brought into surface-contact with the reverse-tapered hole 206. The outer surface of the tip engagement part RT has a plurality of (four) planes, and all of the planes are brought into surface-contact with the reverse-tapered hole 206.

Figure 5:
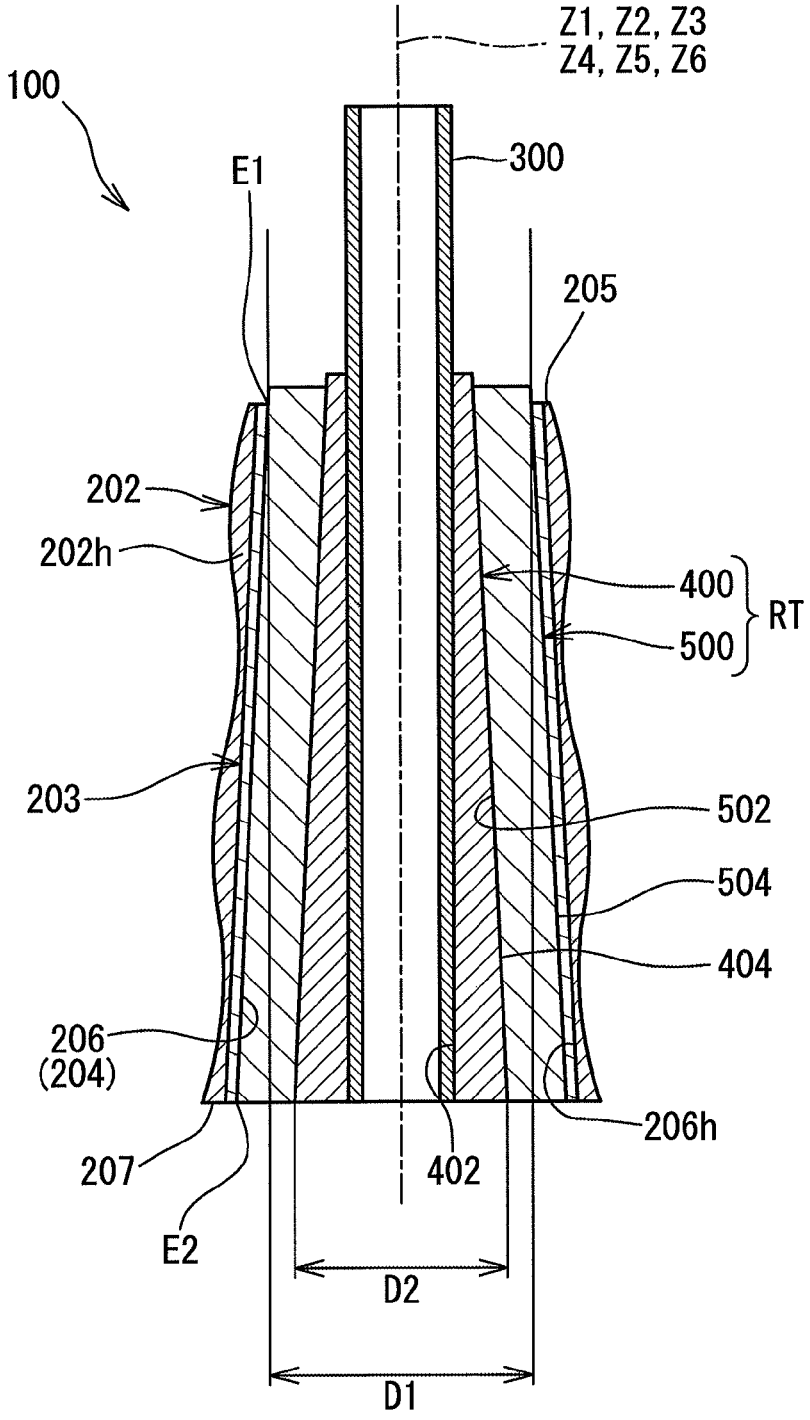
FIG. 5 is a sectional view of the golf club in FIG. 1.

As shown in FIG. 5, the hosel part 202 includes a hosel body 202*h* and a resin part 203. The hosel body 202*h* is made of a metal. The resin part 203 is made of a resin. The hosel body 202*h* includes a body hole 206*h*. The body hole 206*h* is a reverse-tapered hole. The sectional shape of the body hole 206*h* is the same as that of the reverse-tapered hole 206. The body hole 206*h* is a hole in which the reverse-tapered hole 206 is slightly enlarged. The body hole 206*h* and the reverse-tapered hole 206 are similar to each other. The body hole 206*h* is formed by a metal. The resin part 203 is fixed inside the body hole 206*h*. The resin part 203 is adhered to the inside of the body hole 206*h* by an adhesive.

Of course, the sectional shape of the body hole 206*h* need not be the same as that of the reverse-tapered hole 206. For example, the sectional shape of the body hole 206*h* may be a circle, the sectional shape of the outer surface of the resin part 203 may be a circle, and the sectional shape of the inner surface of the resin part 203 may be the same as the sectional shape of the outer surface of the tip engagement part RT.

The hosel part 202 (reverse-tapered hole 206) exists over the whole circumferential direction. The hosel part 202 (reverse-tapered hole 206) is continuous without a gap in the whole circumferential direction. The hosel part 202 is not split in the circumferential direction. The hosel part 202 does not have a slit formed such that a part of the hosel part in the circumferential direction is lacking.

As with a usual head, the head 200 includes a crown 208, a sole 210, and a face 212 (see FIGS. 1 to 3).

As shown in FIG. 3, the sleeve 400 has an inner surface 402 and an outer surface 404. The inner surface 402 forms a shaft hole. The sectional shape of the inner surface 402 is a circle. The shape of the inner surface 402 corresponds to the shape of an outer surface of the shaft 300. The inner surface 402 is fixed to the tip end portion of the shaft 300.

That is, the sleeve 400 is fixed to the tip end portion of the shaft 300. Adhesion performed by using an adhesive is adopted as the fixation.

The outer surface 404 is a pyramid surface. The outer surface 404 is a four-sided pyramid surface. The sectional shape of the outer surface 404 is a non-circle. The sectional shape of the outer surface 404 is a polygon (regular polygon). The sectional shape of the outer surface 404 is a tetragon. The sectional shape of the outer surface 404 is a square. The area of a figure formed by a sectional line of the outer surface 404 is increased toward a tip side of the shaft 300. That is, the sleeve 400 has a reverse-tapered shape.

As shown in FIG. 3, the spacer 500 has an inner surface 502 and an outer surface 504. The inner surface 502 forms a sleeve hole. The sectional shape of the inner surface 502 corresponds to the sectional shape of the outer surface 404 of the sleeve 400. The outer surface 404 of the sleeve 400 is fitted to the inner surface 502. In other words, the sleeve 400 is fitted inside the spacer 500. The spacer 500 is not adhered to the sleeve 400. The spacer 500 is merely brought into contact with the sleeve 400.

The shape of the inner surface 502 corresponds to the shape of the outer surface 404 of the sleeve 400. The inner surface 502 is a pyramid surface. The inner surface 502 is a four-sided pyramid surface. The sectional shape of the inner surface 502 is a non-circle. The sectional shape of the inner surface 502 is a polygon (regular polygon). The sectional shape of the inner surface 502 is a tetragon. The sectional shape of the inner surface 502 is a square. The area of a figure formed by a sectional line of the inner surface 502 is increased toward the tip side of the shaft 300.

The shape of the outer surface 504 (outer surface of the tip engagement part RT) corresponds to the shape of the reverse-tapered hole 206. The outer surface 504 is a pyramid surface. The outer surface 504 is a four-sided pyramid surface. The sectional shape of the outer surface 504 is a non-circle. The sectional shape of the outer surface 504 is a polygon (regular polygon). The sectional shape of the outer surface 504 is a tetragon. The sectional shape of the outer surface 504 is a square. The area of a figure formed by a sectional line of the outer surface 504 is increased toward the tip side of the shaft 300. That is, the spacer 500 has a reverse-tapered shape. The sleeve 400 and the spacer 500 constitute the tip engagement part RT.

Figure 4:
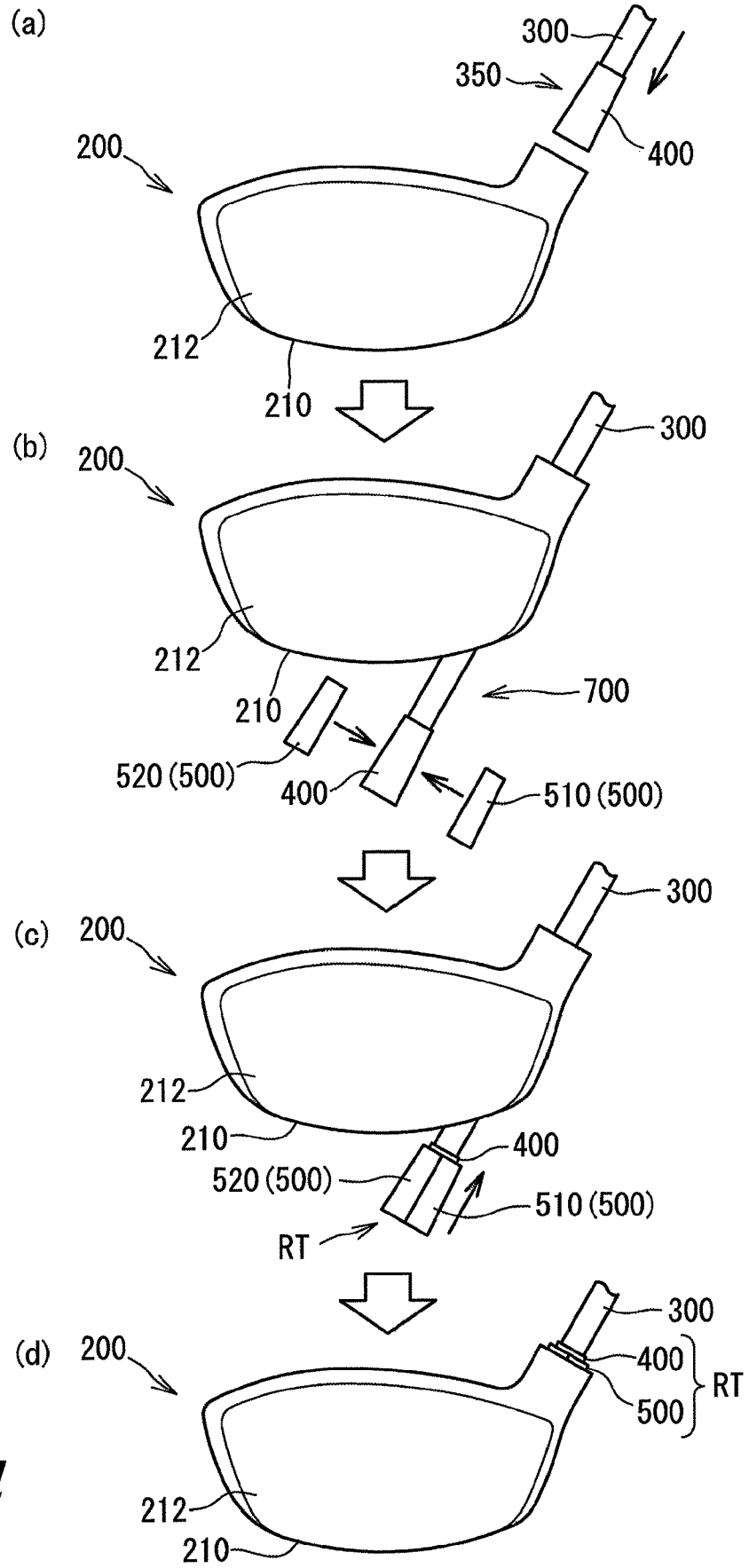
FIG. 4 is a process view showing a process of attaching a shaft in the golf club of FIG. 1.

FIG. 4 shows a procedure of mounting the shaft 300 to the head 200.

In the mounting procedure, a sleeve-attached shaft 350 is first prepared (step (a) in FIG. 4). The sleeve-attached shaft 350 is obtained by fixing the sleeve 400 to the shaft 300. That is, in the sleeve-attached shaft 350, the sleeve 400 is fixed (adhered) to the tip end portion of the shaft 300.

Next, the sleeve 400 of the sleeve-attached shaft 350 is made to pass through the hosel hole 204 (step (b) in FIG. 4). The sleeve 400 has a dimension and a shape capable of passing through the hosel hole 204. The sleeve 400 is inserted to the hosel hole 204 from the upper side and is come out from the lower side of the hosel hole 204. An outer diameter of a lower end surface of the sleeve 400 is smaller than an inner diameter of an upper end of the hosel hole 204. The sleeve 400 can be made to pass through the hosel hole 204 at any phase of the sleeve 400. The sleeve 400 is moved to a lower side of the sole 210 by the passing (step (b) in FIG. 4). Note that the "phase" means an orientation (axial rotation position) of the sleeve 400 in the circumferential direction.

Next, the spacer 500 is attached to the sleeve 400 (step (b) in FIG. 4). The spacer 500 is externally attached to the sleeve 400. The spacer 500 is attached to externally cover the sleeve 400. The tip engagement part RT is completed by attaching the spacer 500 to the sleeve 400. As described later, the spacer 500 has a divided structure. This divided structure makes it possible to attach the spacer 500 externally to the sleeve 400.

Next, the sleeve-attached shaft 350 is moved to the upper side with respect to the head 200, whereby the tip engagement part RT (spacer 500) is fitted to the reverse-tapered hole 206 (step (c) in FIG. 4). As a result, the shaft 300 is attached to the head 200. The mounting of the shaft 300 to the head 200 is achieved by the fitting. In other words, an engagement state is achieved by the fitting. The engagement state is a state where the golf club 100 can be used. In the engagement state, all reverse-tapered fittings are achieved. All reverse-tapered fittings mean: a fitting between the outer surface 404 and the inner surface 502; and a fitting between the outer surface 504 and the reverse-tapered hole 206.

Thus, the shaft 300 is easily attached to the head 200. In addition, the shaft 300 can be detached from the head 200 by performing the above-described procedure in the reverse order. The detachment is also easily performed. In the golf club 100, the shaft 300 is detachably attached to the head 200.

Figure 6:
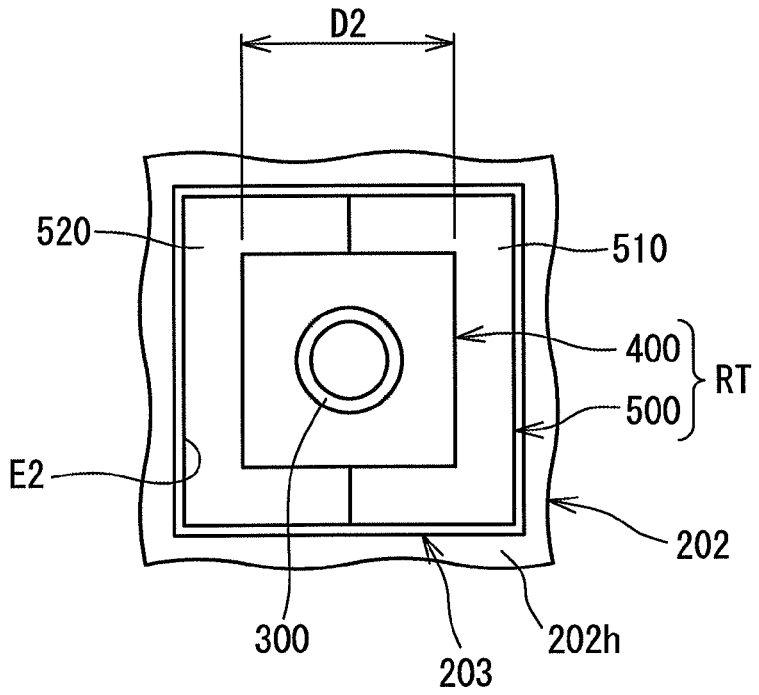
FIG. 6 is a bottom view of the vicinity of a tip engagement part of the golf club in FIG. 1.

FIG. 5 is a sectional view of the golf club 100 taken along the axial direction. FIG. 5 is an enlarged sectional view of the vicinity of the tip engagement part RT. FIG. 6 is a plan view of the tip engagement part RT as viewed from the lower side (sole side).

In the present embodiment, a center line Z1 of the inner surface 402 of the sleeve 400 is not inclined with respect to a center line Z2 of the outer surface 404 of the sleeve 400. The center line Z1 conforms to the center line Z2. A center line Z3 of the shaft 300 is not inclined with respect to the center line Z2 of the outer surface 404 of the sleeve 400. The center line Z3 conforms to the center line Z2. A center line Z4 of the inner surface 502 of the spacer 500 is not inclined with respect to a center line Z5 of the outer surface 504 of the spacer 500. The center line Z4 conforms to the center line Z5. The center line Z4 of the inner surface 502 of the spacer 500 is not inclined with respect to a center line Z6 of the reverse-tapered hole 206 of the head 200. The center line Z4 conforms to the centerline Z6. The center line Z3 of the shaft 300 is not inclined with respect to the center line Z6 of the reverse-tapered hole 206 of the head 200. The center line Z3 conforms to the center line Z6.

A double-pointed arrow D1 in FIG. 5 shows the minimum width of the hosel hole 204. In the present embodiment, the sectional shape of the hosel hole 204 is a square, and the minimum width D1 is the length of one side of the square at the upper end surface of the hosel hole 204.

A double-pointed arrow D2 in FIG. 5 shows the maximum width of the sleeve 400. In the present embodiment, the sectional shape of the outer surface 404 of the sleeve 400 is a square, and the maximum width D2 is the length of one side of the square at the lower end surface of the sleeve 400.

In the present embodiment, the minimum width D1 is larger than the maximum width D2. The minimum value of the sectional area of the hosel hole 204 is larger than the maximum value of the sectional area of the sleeve 400. The lower end of the sleeve 400 can pass through an opening of the upper end of the hosel hole 204. As a result, the sleeve 400 can pass through the hosel hole 204. The sleeve 400 can be inserted to the hosel hole 204 from the upper side, pass through the hosel hole 204, and come out from the lower side of the hosel hole 204. The thickness of the spacer 500, for example, is set such that the minimum width D1 is larger than the maximum width D2.

As described above, the hosel part 202 includes the resin part 203 (see FIG. 5). The resin part 203 constitutes an upper end edge E1 of the hosel hole 204. Therefore, the upper end edge E1 is formed by the resin. The resin part 203 constitutes a lower end edge E2 of the hosel hole 204. Therefore, the lower end edge E2 is formed by the resin.

The resin part 203 constitutes at least a part of the inner surface of the hosel hole 204. In the embodiment of FIG. 5, the resin part 203 constitutes the whole inner surface of the hosel hole 204. The resin part 203 constitutes at least a part of the inner surface of the reverse-tapered hole 206. In the embodiment of FIG. 5, the resin part 203 constitutes the whole inner surface of the reverse-tapered hole 206.

The upper end surface of the resin part 203 constitutes a part of a hosel upper end surface 205 (see FIG. 3). The lower end surface of the resin part 203 constitutes a part of a hosel lower end surface 207 (see FIG. 2).

As described above, the hosel part 202 includes the hosel body 202*h*, and the hosel body 202*h* includes the body hole 206*h* (see FIG. 5). The body hole 206*h* is a reverse-tapered hole.

In the present embodiment, the resin part 203 is a resin member that is formed separately from the head 200. The resin part 203 is fixed to the hosel part 202. The resin part 203 is fixed inside the body hole 206*h*. The resin part 203 is adhered to the inside of the body hole 206*h* by an adhesive. The resin part 203 need not be the resin member. For example, the resin part 203 may be a coating film.

Figure 7:
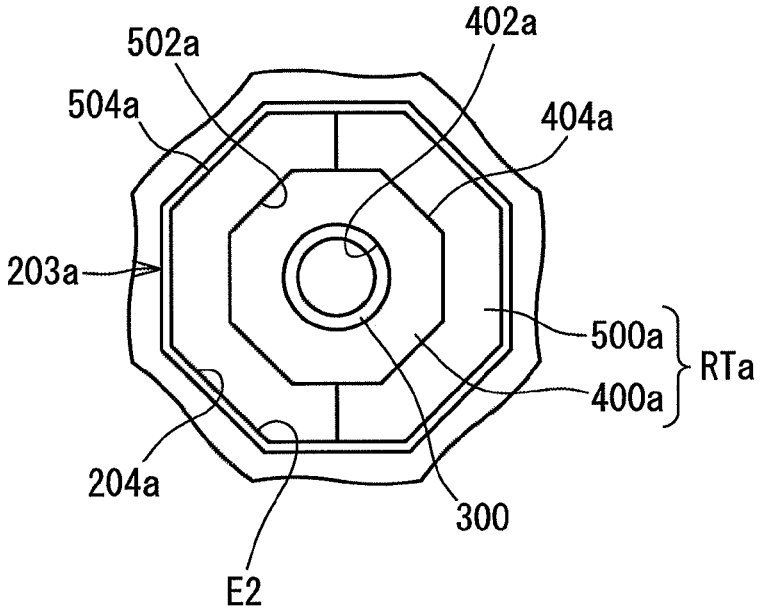
FIG. 7 is a bottom view of the vicinity of a tip engagement part of a golf club according to a modification example.

FIG. 7 is a plan view of a tip engagement part RTa according to a modification example as viewed from the sole side. The tip engagement part RTa includes a sleeve 400*a* and a spacer 500*a*. The sleeve 400*a* and the spacer 500*a* constitute the tip engagement part RTa.

The sleeve 400*a* has an inner surface 402*a* and an outer surface 404*a*. The inner surface 402*a* forms a shaft hole. The sectional shape of the inner surface 402*a* is a circle. The shape of the inner surface 402*a* corresponds to the shape of the outer surface of the shaft 300. The inner surface 402*a* is fixed to the tip end portion of the shaft 300. That is, the sleeve 400*a* is fixed to the tip end portion of the shaft 300. An adhesive is used for the fixation.

The outer surface 404*a* is a pyramid surface. The outer surface 404*a* is an eight-sided pyramid surface. The sectional shape of the outer surface 404*a* is a non-circle. The sectional shape of the outer surface 404*a* is a polygon (regular polygon). The sectional shape of the outer surface 404*a* is an octagon. The sectional shape of the outer surface 404*a* is a regular octagon. The area of a figure formed by a sectional line of the outer surface 404*a* is increased toward the tip side of the shaft 300. That is, the sleeve 400*a* has a reverse-tapered shape.

The spacer 500*a* has an inner surface 502*a* and an outer surface 504*a*. The inner surface 502*a* forms a sleeve hole. The sectional shape of the inner surface 502*a* corresponds to the sectional shape of the outer surface 404*a* of the sleeve 400*a*. The outer surface 404*a* of the sleeve 400*a* is fitted to the inner surface 502*a*. In other words, the sleeve 400*a* is fitted inside the spacer 500*a*. The spacer 500*a* is not adhered to the sleeve 400*a*. The spacer 500*a* is merely brought into contact with the sleeve 400*a*.

The shape of the inner surface 502*a* corresponds to the shape of the outer surface 404*a* of the sleeve 400*a*. The inner surface 502*a* is a pyramid surface. The inner surface 502*a* is an eight-sided pyramid surface. The sectional shape of the inner surface 502*a* is a non-circle. The sectional shape of the inner surface 502*a* is a polygon (regular polygon). The sectional shape of the inner surface 502*a* is an octagon. The sectional shape of the inner surface 502*a* is a regular octagon. The area of a figure formed by a sectional line of the inner surface 502*a* is increased toward the tip side of the shaft 300.

The shape of the outer surface 504*a* (outer surface of the tip engagement part RTa) corresponds to the shape of a reverse-tapered hole 206*a*. The outer surface 504*a* is a pyramid surface. The outer surface 504*a* is an eight-sided pyramid surface. The sectional shape of the outer surface 504*a* is a non-circle. The sectional shape of the outer surface 504*a* is a polygon (regular polygon). The sectional shape of the outer surface 504*a* is an octagon. The sectional shape of the outer surface 504*a* is a regular octagon. The area of a figure formed by a sectional line of the outer surface 504*a* is increased toward the tip side of the shaft 300.

Also in this modification example, the hosel part of the head includes a resin part 203*a*. The resin part 203*a* constitutes an upper end edge (not shown in the drawing) and a lower end edge E2 of a hosel hole 204*a*. The resin part 203*a* constitutes the whole inner surface of the hosel hole 204*a*.

Figure 8:
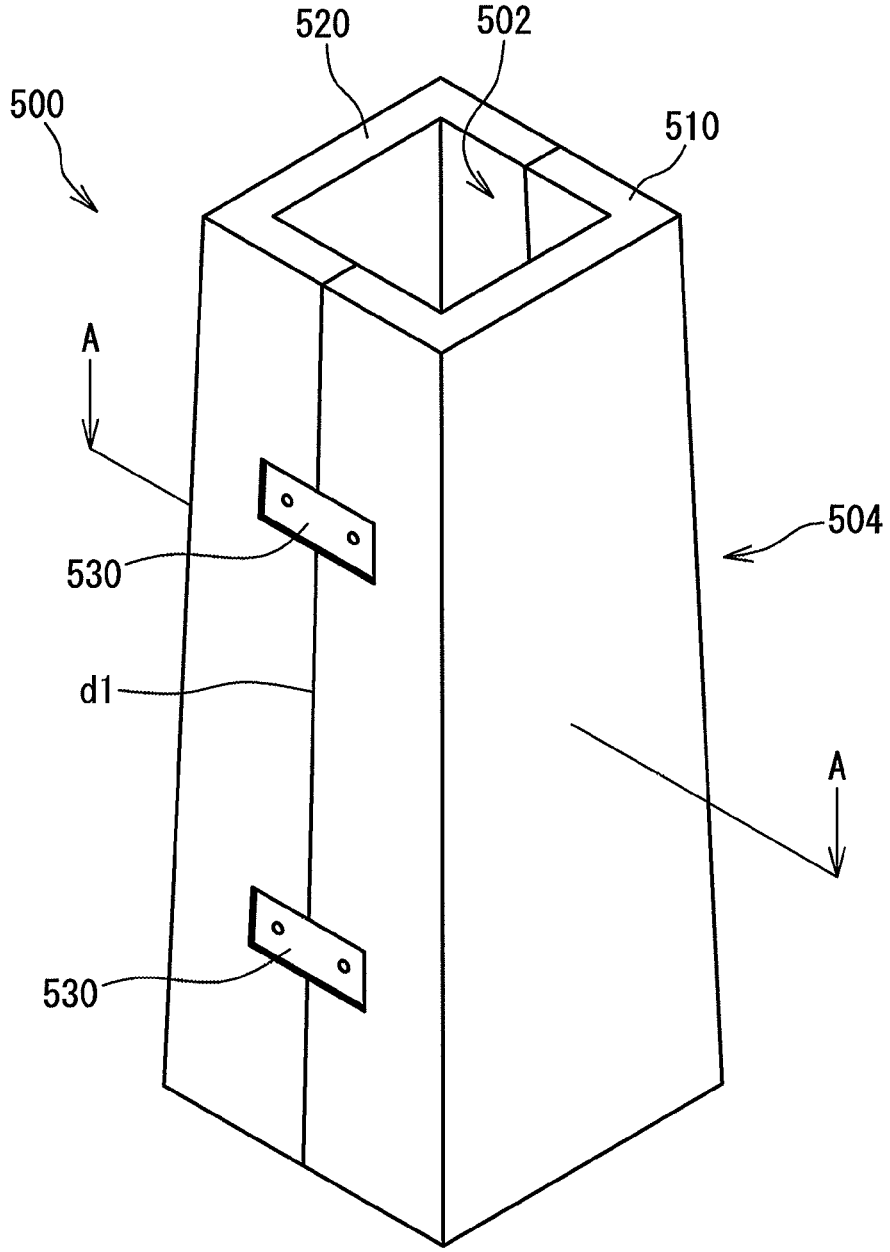
FIG. 8 is a perspective view showing an example of a spacer having a divided structure.
Figure 9A:
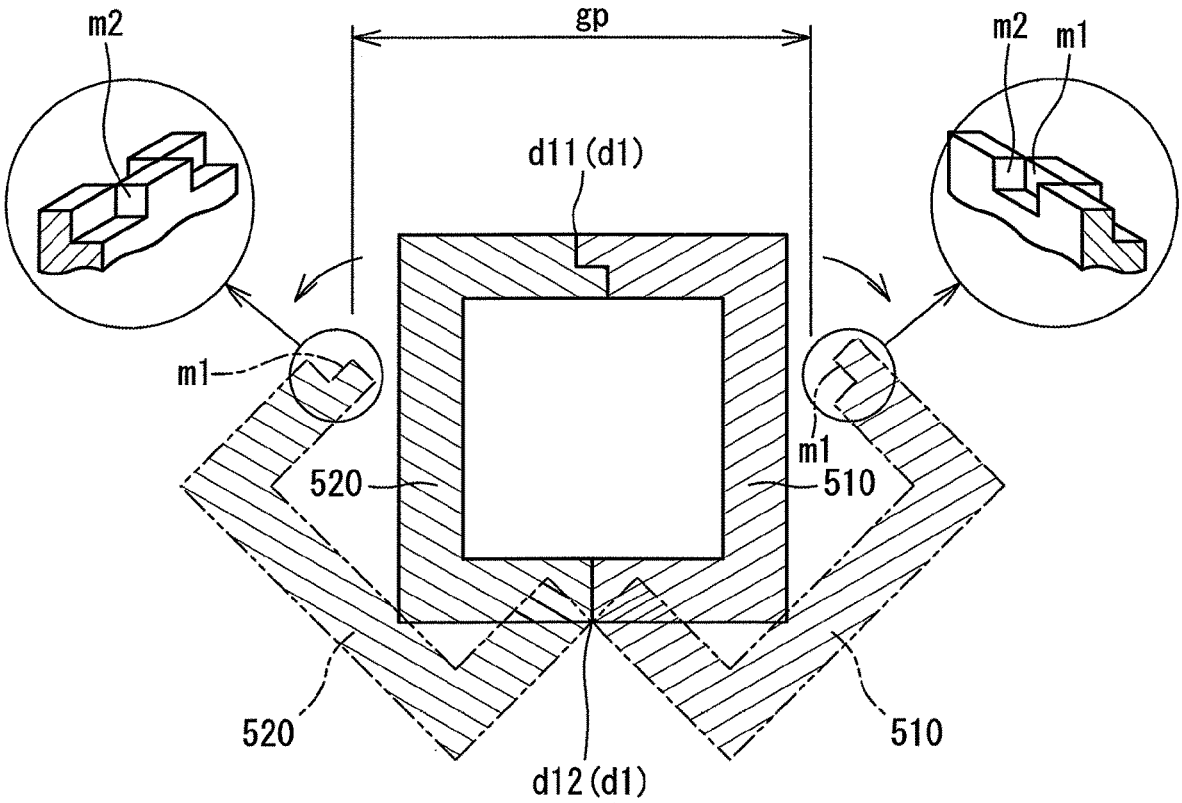
FIG. 9(*a*) is a sectional view taken along line A-A in FIG. 8, FIG. 9(*b*) is a sectional view showing another engagement structure, and FIG. 9(*c*) is a sectional view showing another engagement structure.
Figure 9B:
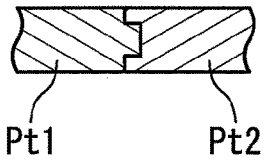
Figure 9C:
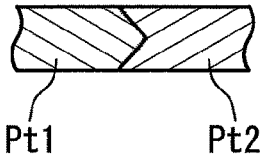

FIG. 8 is a perspective view of the spacer 500. FIG. 9 (*a*) is a sectional view taken along line A-A in FIG. 8. As described above, the spacer 500 has the inner surface 502 and the outer surface 504.

The spacer 500 has a divided structure. The spacer 500 includes a first divided body 510 and a second divided body 520. A divisional line d1 is shown in FIG. 8. The divisional line d1 is a boundary between the first divided body 510 and the second divided body 520.

The spacer 500 includes a connecting part 530. In the present embodiment, the connecting part 530 is a plate spring. The plate spring is an elastic body. In the present embodiment, two connecting parts 530 are provided. One side of each of the connecting parts 530 is fixed to the first divided body 510, and the other side of each of the connecting parts 530 is fixed to the second divided body 520.

The connecting parts 530 are housed in respective recessed parts provided on the outer surface 504. The connecting parts 530 are not projected outside the outer surface 504. The connecting parts 530 do not hamper contact between the reverse-tapered hole 206 and the outer surface 504.

Although the step (b) in FIG. 4 shows that the first divided body 510 and the second divided body 520 are separated from each other, the spacer 500 is actually configured to open and close. The connecting parts 530 play the role of a hinge. The spacer 500 opens on the connecting parts 530. The spacer 500 opens by applying an external force. This opened state is shown by two-dot chain lines in FIG. 9(*a*). The spacer 500 opens by bending the connecting parts 530 (plate springs). In this opened state, a gap gp is produced between the first divided body 510 and the second divided body 520. The sleeve 400 can be put inside the spacer 500 through the gap gp. The spacer 500 is closed in a state where the sleeve 400 is put inside the spacer. The plate springs 530 bias the spacer 500 so that the spacer 500 is in a closed state. Therefore, the spacer 500 is (automatically) closed when the external force is lost.

The connecting parts 530 can maintain a connected state in which the first divided body 510 is connected to the second divided body 520. The spacer 500 is in the connected state when an external force does not act on the spacer 500. The connected state is a state of the spacer 500 in the golf club 100 usable as a club.

The spacer 500 has a position adjusting structure to prevent a positional displacement between the first divided body 510 and the second divided body 520. As the position adjusting structure, a plate splicing structure may be applied. The embodiment of FIG. 9(*a*) includes an example of the position adjusting structure. In the position adjusting structure, the first divided body 510 has an abutting surface m1 that prevents the positional displacement in a thickness direction, and an abutting surface m2 that prevents the positional displacement in the axial direction. Similarly, the second divided body 520 has the abutting surface m1 that prevents the positional displacement in the thickness direction, and the abutting surface m2 that prevents the positional displacement in the axial direction. In the spacer 500 in the closed state, the abutting surface m1 of the first divided body 510 abuts on the abutting surface m1 of the second divided body 520, and the abutting surface m2 of the first divided body 510 abuts on the abutting surface m2 of the second divided body 520. Therefore, the positional displacements in the thickness direction and the axial direction are prevented.

The spacer 500 can fulfill the position adjusting function even if the spacer 500 does not have the above-described position adjusting structure because the spacer 500 is fitted to the outer surface of the sleeve, the inner surface of the hosel hole, etc. In comparison between the abutting surfaces m1 and the abutting surfaces m2, the abutting surfaces m2 which prevent the positional displacement in the axial direction are more effective. This is because the spacer 500 is fitted to the outer surface of the sleeve, the inner surface of the hosel hole, etc., and thus the positional displacement in the thickness direction is less likely to occur. In this respect, the position adjusting structure preferably includes the abutting surfaces m2 which prevent the positional displacement in the axial direction, and more preferably includes the abutting surfaces m2 which prevent the positional displacement in the axial direction, and the abutting surfaces m1 which prevent the positional displacement in the thickness direction.

As shown in FIG. 9 (*a*), the divisional line d1 of the spacer 500 includes a first divisional line d11 and a second divisional line d12. The first divisional line d11 is a divisional line on which the connecting parts 530 are not present. The second divisional line d12 is a divisional line on which the connecting parts 530 are present. In FIG. 9 (*a*), the above-described position adjusting structure provided on the first divisional line d11 is shown. Preferably, the position adjusting structure is provided also on the second divisional line d12.

FIG. 9(*b*) shows another position adjusting structure. In this position adjusting structure, a projection of a first member Pt1 and a recess of a second member Pt2 are butted against each other. The center side in a thickness direction of the first member Pt1 is overlapped with an inner side and an outer side in a thickness direction of the second member Pt2. The first member Pt1 is either one of the first divided body 510 and the second divided body 520. The second member Pt2 is the other of the first divided body 510 and the second divided body 520.

FIG. 9(*c*) shows another position adjusting structure. In this position adjusting structure, a projection of a first member Pt1 and a recess of a second member Pt2 are butted against each other. The section of the projection of the first member Pt1 is constituted by slopes. The section of the recess of the second member Pt2 is constituted by slopes. The center side in a thickness direction of the first member Pt1 is overlapped with an inner side and an outer side in a thickness direction of the second member Pt2. The first member Pt1 is either one of the first divided body 510 and the second divided body 520. The second member Pt2 is the other of the first divided body 510 and the second divided body 520.

The position adjusting structures shown in FIG. 9(*b*) and FIG. 9(*c*) can also prevent the positional displacement in the axial direction in addition to the positional displacement in the thickness direction. For example, when such a position adjusting structure as shown in FIG. 9 (*b*) or FIG. 9(*c*) is adopted only at a part of the axial direction, an abutting surface capable of preventing the positional displacement in the axial direction can be formed at a termination position of the position adjusting structure. Therefore, the positional displacement in the axial direction can be prevented.

Figure 10:
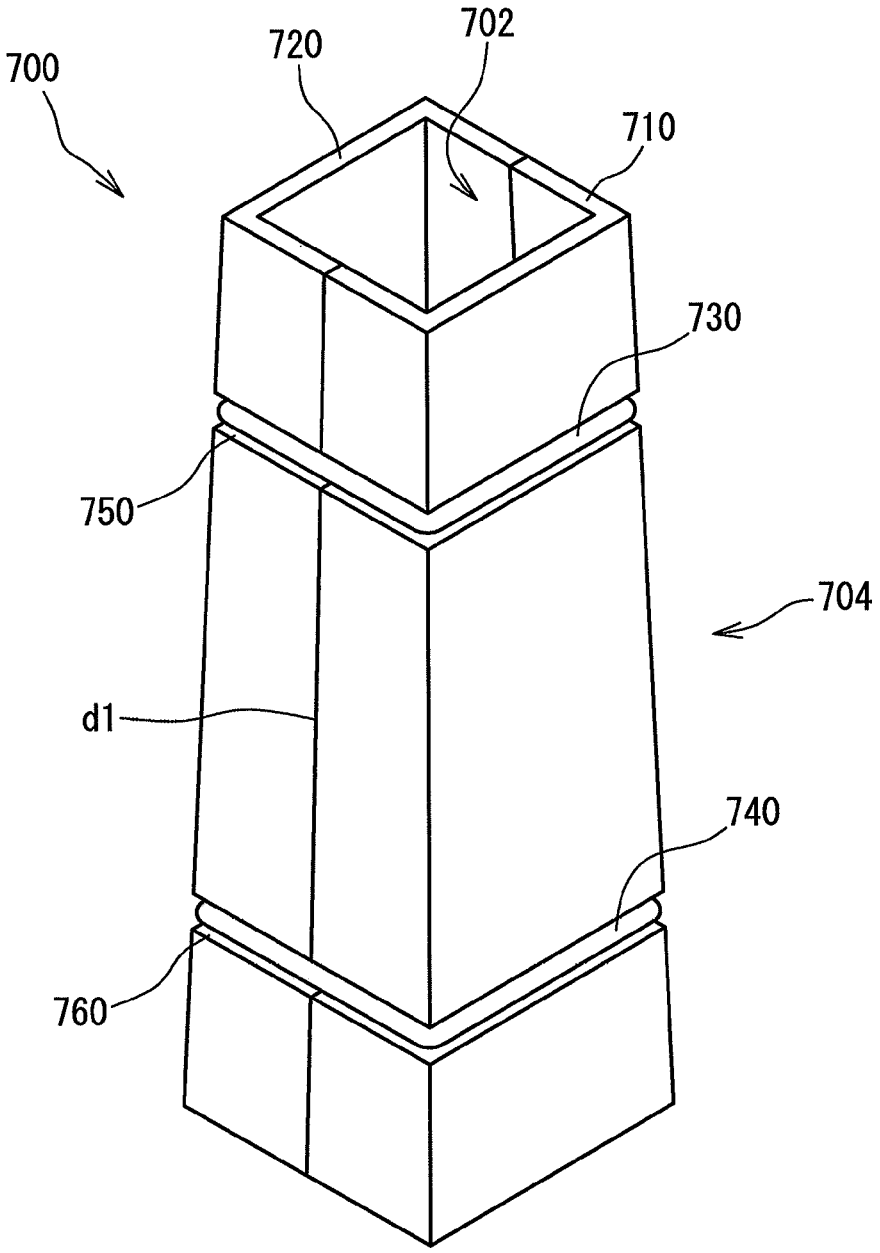
FIG. 10 is a perspective view showing another example of the spacer having a divided structure.

FIG. 10 is a perspective view of a spacer 700 according to another modification example. The spacer 700 has an inner surface 702 and an outer surface 704.

The spacer 700 has a divided structure. The spacer 700 includes a first divided body 710 and a second divided body 720. A divisional line d1 is shown in FIG. 10. The divisional line d1 is a boundary between the first divided body 710 and the second divided body 720.

The spacer 700 includes ring-shaped elastic bodies 730 and 740. The spacer 700 further includes circumferential grooves 750 and 760. The elastic bodies 730 and 740 are fitted to the circumferential grooves 750 and 760, respectively. The elastic bodies 730 and 740 are not projected outside the outer surface 704. The elastic bodies 730 and 740 do not hamper contact between the outer surface 704 and a reverse-tapered surface to which the outer surface 704 is fitted. The reverse-tapered surface to which the outer surface 704 is fitted is the reverse-tapered hole of the head or an inner surface of another spacer. The elastic bodies 730 and 740 are an example of a connecting part capable of maintaining a connected state in which the first divided body 710 and the second divided body 720 are connected to each other.

The elastic bodies 730 and 740 can be removed by applying an external force to stretch the elastic bodies 730 and 740. The first divided body 710 and the second divided body 720 can be separated from each other by removing the elastic bodies 730 and 740. On the contrary, the elastic bodies 730 and 740 can be attached after butting the first divided body 710 and the second divided body 720 against each other. The elastically contractile force of the elastic bodies 730 and 740 biases the divided bodies 710 and 720 so that the two divided bodies 710 and 720 are butted against each other. For example, this spacer 700 also enables to replace a spacer.

Thus, the spacer 500 and the spacer 700 each have the divided structure. The spacer 500 and the spacer 700 each have the first divided body and the second divided body. The spacer 500 and the spacer 700 each have the connecting part capable of maintaining the connected state in which the first divided body is connected to the second divided body. In the spacer 500 and the spacer 700, the mutual transition between the connected state in which the first divided body and the second divided body are connected to each other, and a separated state in which a gap is formed between the first divided body and the second divided body is enabled. In the separated state, the sleeve can be disposed inside the spacer by allowing the sleeve to pass through the gap. In the separated state, the spacer can be detached from or attached to the shaft 300 to which the sleeve 400 is fixed.

Figure 11:
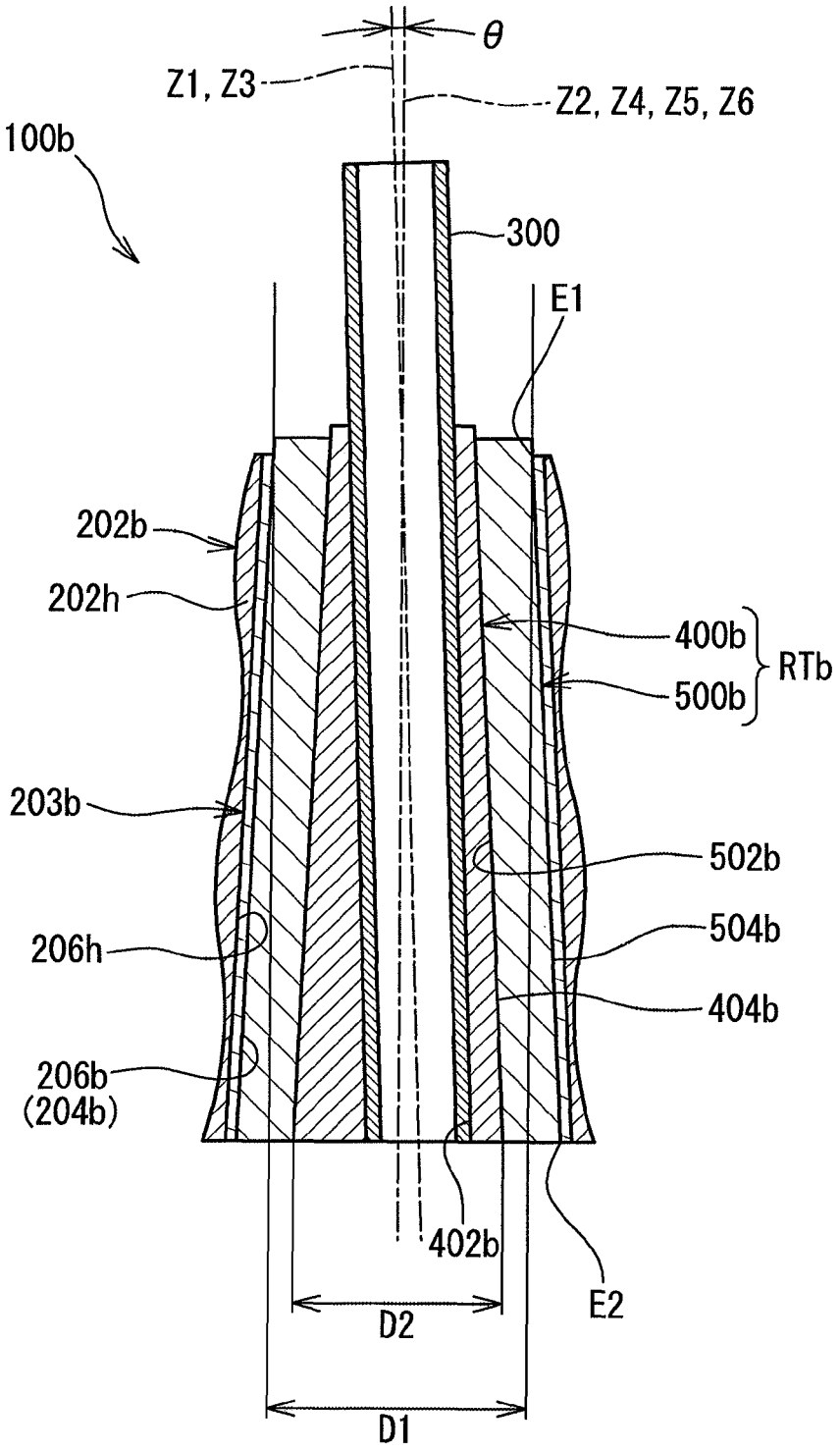
FIG. 11 is a sectional view of the vicinity of a hosel according to another embodiment.

FIG. 11 is a sectional view of a golf club 100*b* according to another embodiment. FIG. 11 is an enlarged sectional view of the vicinity of a tip engagement part RTb.

In the present embodiment, a center line Z1 of an inner surface 402*b* of a sleeve 400*b* is inclined with respect to a center line Z2 of an outer surface 404*b* of the sleeve 400*b*. The inclination angle is e degree. The center line Z3 of the shaft 300 is inclined with respect to the center line Z2 of the outer surface 404*b* of the sleeve 400*b*. The inclination angle is e degree. A center line Z4 of an inner surface 502*b* of a spacer 500*b* is not inclined with respect to a center line Z5 of an outer surface 504*b* of the spacer 500*b*. The center line Z4 conforms to the center line Z5. The center line Z4 of the inner surface 502*b* of the spacer 500*b* is not inclined with respect to a center line Z6 of a reverse-tapered hole 206*b* of a head 200*b*. The center line Z4 conforms to the center line Z6. The center line Z3 of the shaft 300 is inclined with respect to the center line Z6 of the reverse-tapered hole 206*b*. The inclination angle is θ degree.

Thus, in the embodiment of FIG. 11, the center line Z1 of the inner surface 402*b* of the sleeve 400*b* is inclined with respect to the centerline Z6 of the reverse-tapered hole 206*b*. Therefore, a loft angle and a lie angle can be changed based on a rotation position of the sleeve 400*b*. The embodiment of FIG. 11 has an angle adjusting function.

The center line Z4 of the inner surface 502*b* of the spacer 500*b* may be inclined with respect to the center line Z5 of the outer surface 504*b* of the spacer 500*b*. In addition, the inclination of the center line Z1 as mentioned above may be combined with the inclination of the center line Z4. This combination enhances the degree of freedom of angle adjustment.

A hosel part 202*b* includes a resin part 203*b*. The hosel part 202*b* includes a hosel body 202*h* and the resin part 203*b*. The hosel body 202*h* is made of a metal. The resin part 203*b* is made of a resin. The hosel body 202*h* includes a body hole 206*h*. The body hole 206*h* is a reverse-tapered hole. The sectional shape of the body hole 206*h* is the same as that of the reverse-tapered hole 206*b*. The body hole 206*h* is a hole in which the reverse-tapered hole 206*b* is slightly enlarged. The body hole 206*h* and the reverse-tapered hole 206*b* are similar to each other. The body hole 206*h* is formed by a metal. The resin part 203*b* is fixed inside the body hole 206*h*. The resin part 203*b* is adhered to the inside of the body hole 206*h* by an adhesive.

The resin part 203*b* constitutes an upper end edge E1 and a lower end edge E2 of a hosel hole 204*b*. The resin part 203*b* constitutes the whole inner surface of the hosel hole 204*b*. The resin part 203*b* constitutes the whole inner surface of the reverse-tapered hole 206*b*.

[Rotation Position of Sleeve]

The sleeve can be rotated about the center line of the sleeve itself. The rotation position of the sleeve is changed by the rotation. In the engagement state, the sleeve can take a plurality of rotation positions. The number of the rotation positions which can be taken is set based on the shape of the outer surface of the sleeve.

[Rotation Position of Spacer]

The spacer can be rotated about the center line of the spacer itself. The rotation position of the spacer is changed by the rotation. In the engagement state, the spacer can take a plurality of rotation positions. The number of the rotation positions which can be taken is set based on the shape of the outer surface of the spacer.

[Adjustment of Position and Direction of Center Line of Shaft]

The center line of the shaft hole (the center line of the shaft) can be displaced with respect to the center line of the outer surface of the sleeve. These center lines may be inclined with respect to each other, or may be displaced in parallel to each other (parallel and eccentric). Inclination and eccentricity may be combined. In this case, the direction and/or the position of the center line of the shaft can be changed by the rotation position of the sleeve.

The center line of the inner surface of the spacer can be displaced with respect to the center line of the outer surface of the spacer. These center lines may be inclined with respect to each other, or may be displaced in parallel to each other (parallel and eccentric). Inclination and eccentricity may be combined. In this case, the direction and/or the position of the center line of the shaft can be changed by the rotation position of the spacer.

The rotation position of the spacer can be selected independently of the rotation position of the sleeve. In addition, when a plurality of spacers are used, rotation positions of the respective spacers can be selected independently of each other. The degree of freedom of the adjustment is enhanced by the spacer. The degree of freedom of the adjustment is further enhanced by using a plurality of spacers. In these respects, the number of the spacers which are stacked is preferably one or two or more. In view of complexity of adjustment and downsizing of the hosel part, the number of the spacers which are stacked is more preferably one or two.

Figure 12:
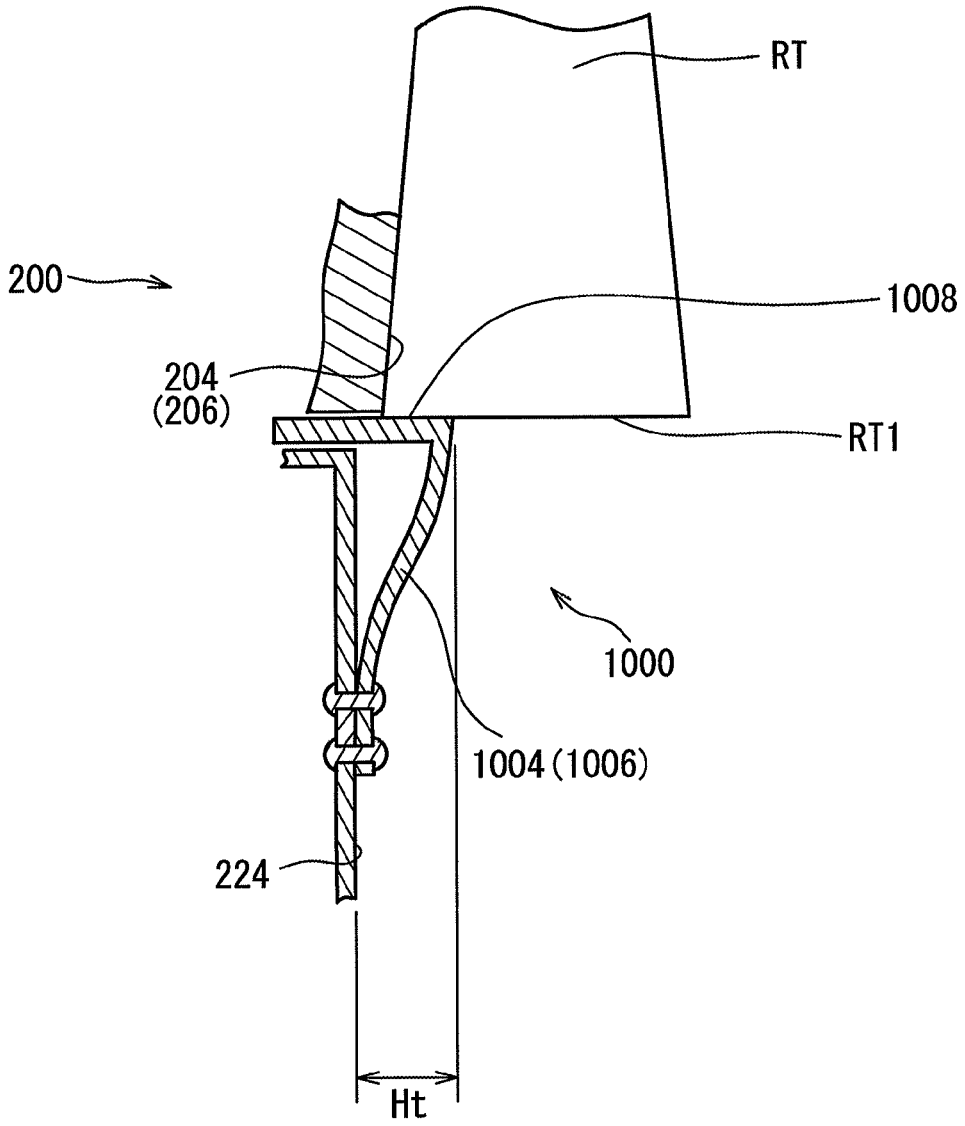
FIG. 12 is a sectional view showing an example of a falling-off prevention mechanism.

FIG. 12 is a sectional view of the vicinity of a falling-off prevention mechanism 1000 provided on the head 200. FIG. 12 is turned upside down relative to FIG. 2.

The falling-off prevention mechanism 1000 includes an elastic projection 1004 biased in a projecting direction under a state where the elastic projection 1004 can project and retract. In the present embodiment, the elastic projection 1004 is a plate spring 1006. FIG. 12 is a sectional view of the falling-off prevention mechanism 1000 in a natural state where an external force does not act thereon. In the natural state, the plate spring 1006 is configured such that a projection height Ht of the plate spring 1006 from an installation surface 224 is increased toward the reverse-tapered hole 206. In the natural state, the falling-off prevention mechanism 1000 has an abutting surface 1008 that abuts on the end surface (lower end surface) of the tip engagement part fitted to the reverse-tapered hole 206.

The abutting surface 1008 of the falling-off prevention mechanism 1000 abuts on the lower end surface of the spacer 500, and the lower end surface of the sleeve 400. A lower end surface RT1 of the tip engagement part RT includes the lower end surface of the spacer 500 and the lower end surface of the sleeve 400. The abutting surface 1008 abuts on the lower end surface RT1.

Thus, the falling-off prevention mechanism 1000 abuts on the sleeve (including an extension sleeve) and the spacer. For this reason, the moving of the tip engagement part RT in an engagement releasing direction is regulated. As a result, falling off of the tip engagement part RT is prevented. That is, falling off of the shaft 300 is prevented.

When the plate spring 1006 is pressed, the plate spring 1006 retracts such that the projection height Ht decreases. The abutting surface 1008 is housed inside the head 200 by the retracting of the plate spring 1006. As a result, the abutting surface 1008 becomes unable to abut on the lower end surface of the tip engagement part RT. In this state, the tip engagement part RT can be moved in the engagement releasing direction. Therefore, the shaft 300 can be detached from the head 200.

The engagement releasing direction is a direction along the axial direction, and a direction in which the tip engagement part RT moves toward the sole side with respect to the hosel hole. If the tip engagement part RT is moved in the engagement releasing direction, the tip engagement part RT comes out of the hosel hole. On the other hand, an engaging direction is a direction along the axial direction, and a direction in which the tip engagement part RT moves toward the grip side with respect to the hosel hole.

In the above-described step (d) (see FIG. 4), the tip engagement part RT moves toward the reverse-tapered hole 206, while pressing the plate spring 1006. The pressed plate spring 1006 retracts to allow the tip engagement part RT to move as described above. When the tip engagement part RT reaches a position where the tip engagement part RT abuts on (is engaged with) the reverse-tapered hole 206, the tip engagement part RT no longer presses the plate spring 1006 and the plate spring 1006 is projected. As a result, the abutting surface 1008 abuts on the lower end surface RT1 of the tip engagement part RT, whereby the falling-off prevention mechanism 1000 fulfills function thereof.

For releasing the function of the falling-off prevention mechanism 1000, press the plate spring 1006 by external force to release the abutting between the abutting surface 1008 and the lower end surface RT1. The external force is applied by a person's finger, for example.

Figure 13:
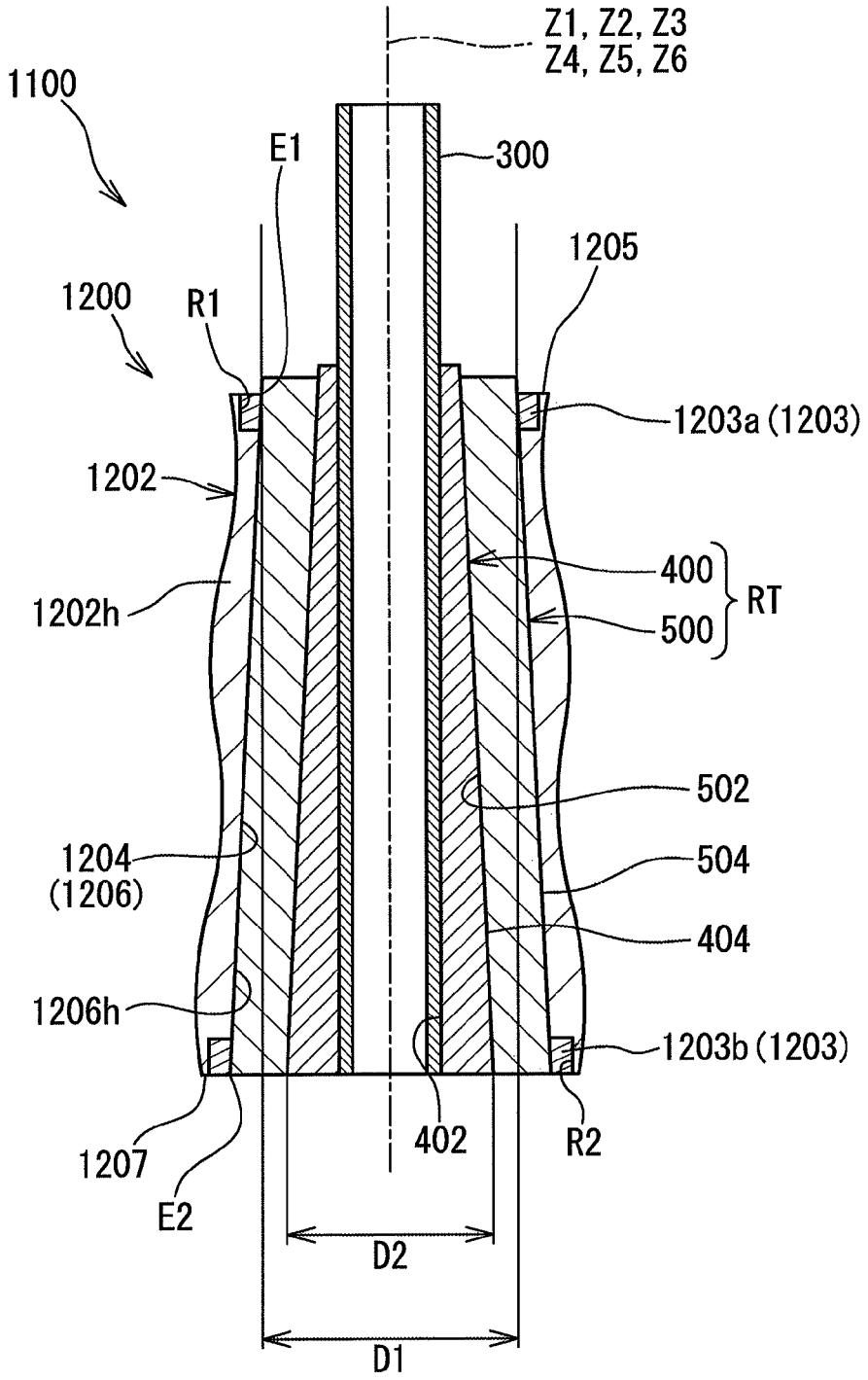
FIG. 13 is a sectional view of the vicinity of a hosel according to another embodiment.
Figure 14:
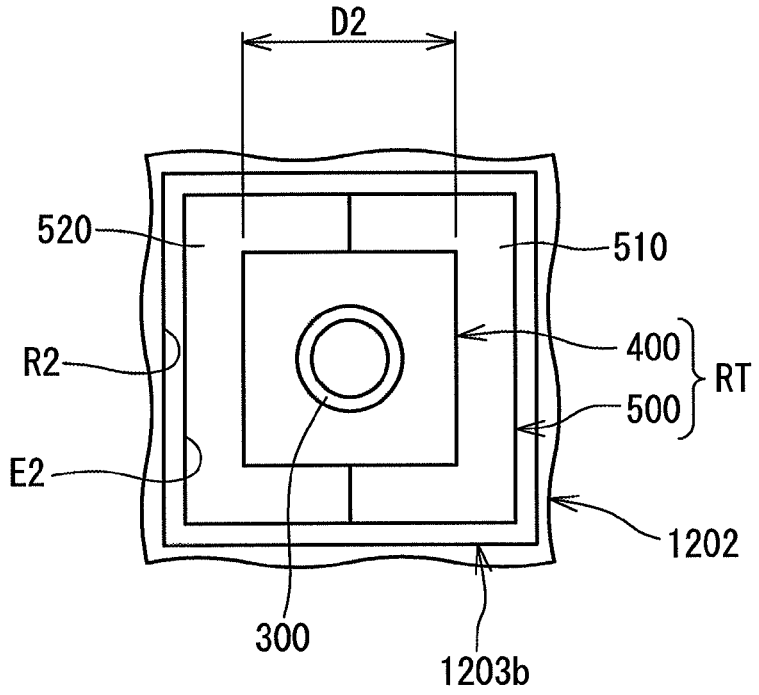
FIG. 14 is a bottom view of the vicinity of a tip engagement part of the golf club in FIG. 13.

FIG. 13 is a sectional view of a golf club 1100 according to another embodiment. FIG. 13 is a sectional view of the vicinity of a hosel part. FIG. 14 is a plan view of a tip engagement part RT of the golf club 1100 as viewed from the lower side (sole side).

The golf club 1100 includes a head 1200, a shaft 300, a sleeve 400, a spacer 500, and a grip (not shown in the drawings). The sleeve 400 and the spacer 500 constitute a tip engagement part RT. The tip engagement part RT is disposed at a tip end portion of the shaft 300. An outer surface of the tip engagement part RT is formed by the spacer 500. The shaft 300, the sleeve 400 and the spacer 500 are the same as those used for the golf club 100 according to the above-described first embodiment.

The head 1200 includes a hosel part 1202. The hosel part 1202 includes a hosel hole 1204. The hosel hole 1204 includes a reverse-tapered hole 1206. The shape of the reverse-tapered hole 1206 corresponds to the shape of the outer surface of the tip engagement part RT. The shape of the reverse-tapered hole 1206 corresponds to the shape of the outer surface of the spacer 500. In an engagement state, the outer surface of the tip engagement part RT (the outer surface of the spacer 500) is brought into surface-contact with the reverse-tapered hole 1206. The outer surface of the tip engagement part RT has a plurality of (four) planes, and all of the planes are brought into surface-contact with the reverse-tapered hole 1206.

The sleeve 400 is fixed to the tip end portion of the shaft 300. The sleeve 400 is fitted inside the spacer 500. As described above, the spacer 500 includes a first divided body 510 and a second divided body 520.

Similar to the above-described golf club 100, the minimum width D1 is larger than the maximum width D2 also in the golf club 1100 (see FIG. 13). The sleeve 400 can pass through the hosel hole 1204. The hosel part 1202 does not have a slit formed such that a part of the hosel part in the circumferential direction is lacking.

As shown in FIG. 13, the hosel part 1202 includes a hosel body 1202*h* and a resin part 1203. The hosel body 1202*h* is made of a metal. The resin part 1203 is made of a resin. The hosel body 1202*h* includes a body hole 1206*h*. The body hole 1206*h* is a reverse-tapered hole. The body hole 1206*h* is formed by a metal. Except for an upper end recess R1 and a lower end recess R2 described later, the body hole 1206*h* conforms to the hosel hole 1204.

The resin part 1203 includes an upper resin part 1203*a* and a lower resin part 1203*b*.

The body hole 1206*h* includes the upper end recess R1 and the lower end recess R2. The upper end recess R1 is formed on the upper end of the hosel hole 1204. The lower end recess R2 is formed on the lower end of the hosel hole 1204. The upper end recess R1 has a shape corresponding to the shape of the upper resin part 1203*a*. The lower end recess R2 has a shape corresponding to the shape of the lower resin part 1203*b*.

The upper resin part 1203*a* is fixed to the upper end recess R1. This fixation is attained by adhesion using an adhesive. The upper surface of the upper resin part 1203*a* fixed to the upper end recess R1 constitutes a part of a hosel upper end surface 1205. The inner surface of the upper resin part 1203*a* fixed to the upper end recess R1 constitutes a part (upper end portion) of the reverse-tapered hole 1206.

The lower resin part 1203*b* is fixed to the lower end recess R2. This fixation is attained by adhesion using an adhesive. The lower surface of the lower resin part 1203*b* fixed to the lower end recess R2 constitutes a part of a hosel lower end surface 1207. The inner surface of the lower resin part 1203*b* fixed to the lower end recess R2 constitutes a part (lower end portion) of the reverse-tapered hole 1206.

The fixation of the resin part 1203 may be attained by other methods than the adhesion using an adhesive, and for example, may be attained by an engagement between a projection and a recess. Examples of the engagement between a projection and a recess include a constitution in which a groove is provided on the body hole 1206*h*, and a protrusion of the resin part 1203 is fitted to the groove. This fitting can be attained by utilizing elastic deformation of the resin part 1203.

The upper resin part 1203*a* constitutes an upper end edge E1 of the hosel hole 1204. The upper end edge E1 is formed by the resin. The lower resin part 1203*b* constitutes a lower end edge E2 of the hosel hole 1204. The lower end edge E2 is formed by the resin.

As shown in FIG. 14, the lower resin part 1203*b* is an annular member. Corresponding to the shape of an opening at the lower end of the hosel hole 1204, the lower resin part 1203*b* has a tetragonal (square) shape. Similarly, the upper resin part 1203*a* is an annular member having a tetragonal (square) shape.

Figure 15:
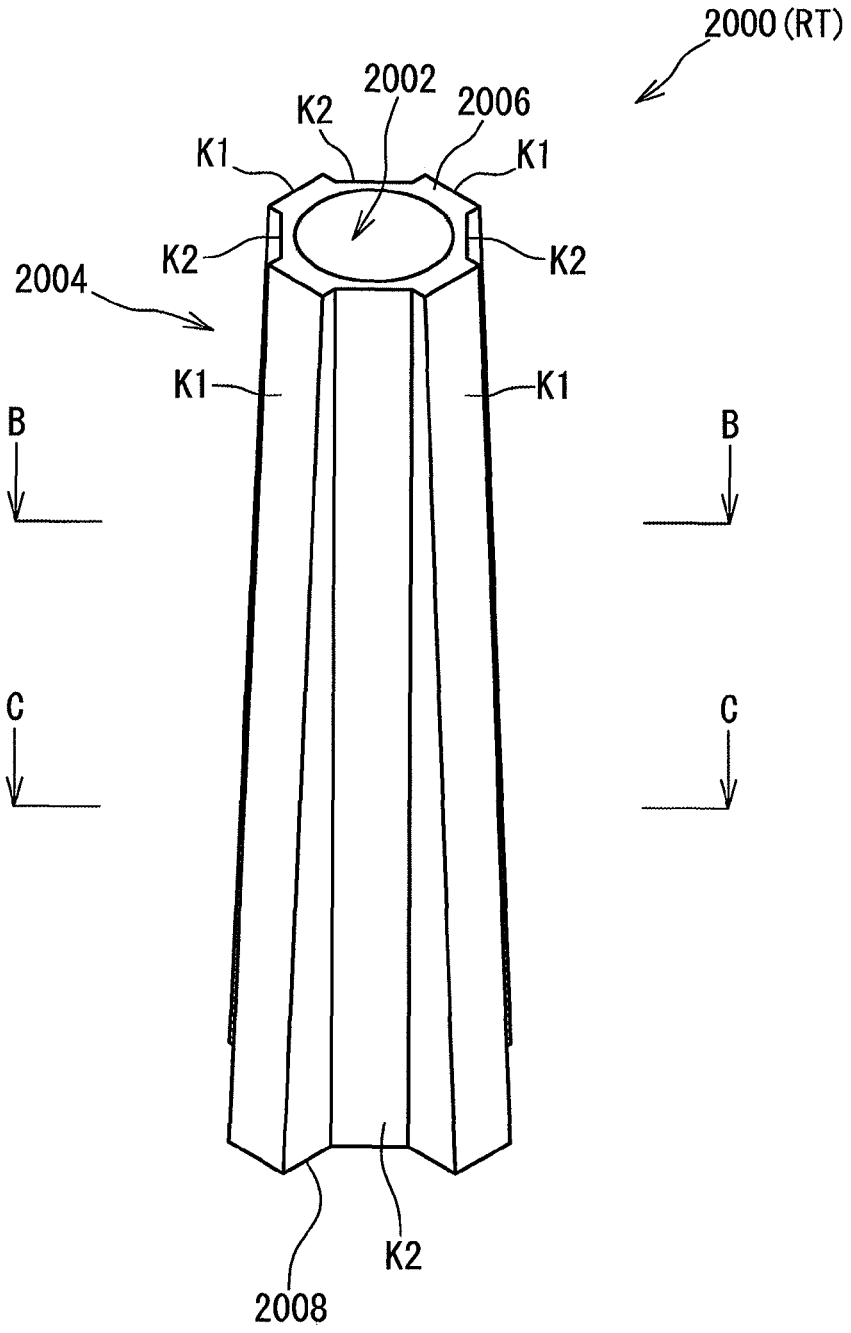
FIG. 15 is a perspective view of a sleeve according to another embodiment.
Figure 16A:
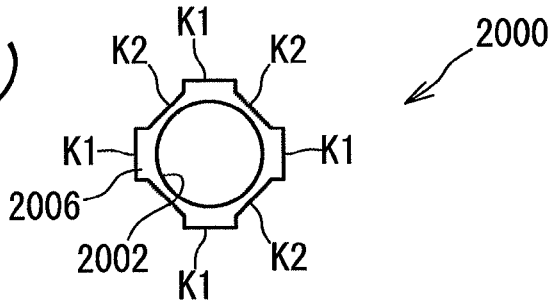
FIG. 16(*a*) is a plan view showing an upper end surface of the sleeve in FIG. 15, FIG. 16 (*b*) is a sectional view taken along line B-B in FIG. 15, FIG. 16(*c*) is a sectional view taken along line C-C in FIG. 15, and FIG. 16(*d*) is a bottom view showing a lower end surface of the sleeve in FIG. 15.
Figure 16B:
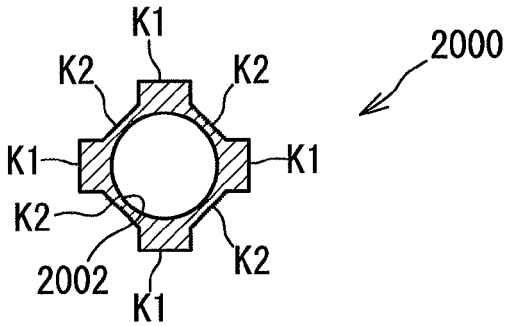
Figure 16C:
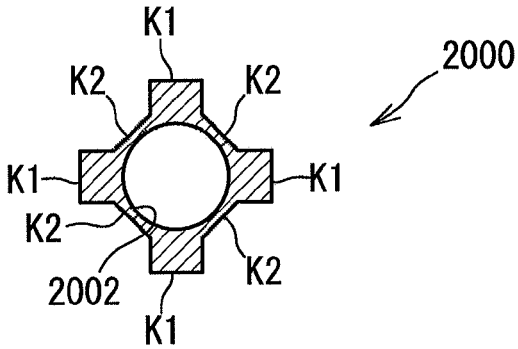
Figure 16D:
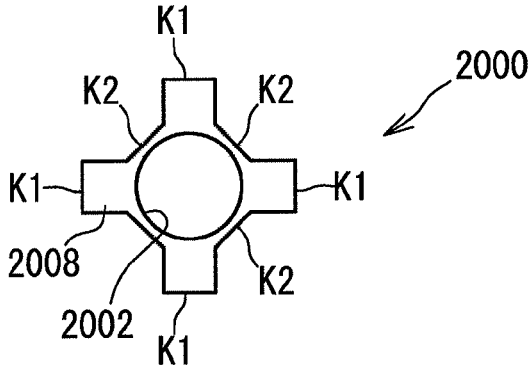
Figure 17A:
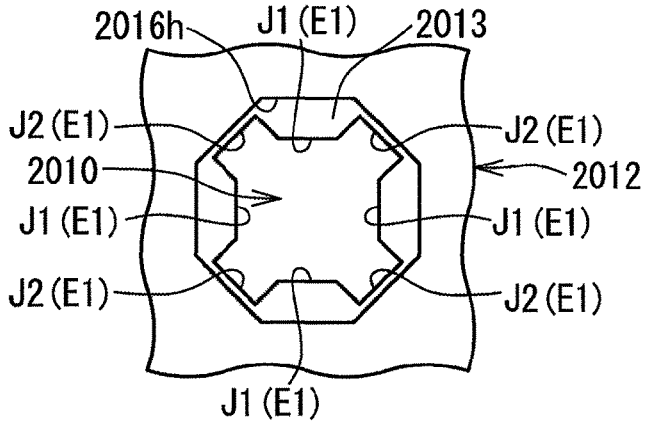
FIG. 17(*a*) is a plan view of a hosel hole of a head for which the sleeve in FIG. 15 is used as viewed from the upper side, FIG. 17(*b*) is a sectional view of the hosel hole of the head which is taken along line B-B in FIG. 15, FIG. 17(*c*) is a sectional view of the hosel hole of the head which is taken along line C-C in FIG. 15, and FIG. 17 (*d*) is a bottom view of the hosel hole of the head as viewed from the lower side.
Figure 17B:
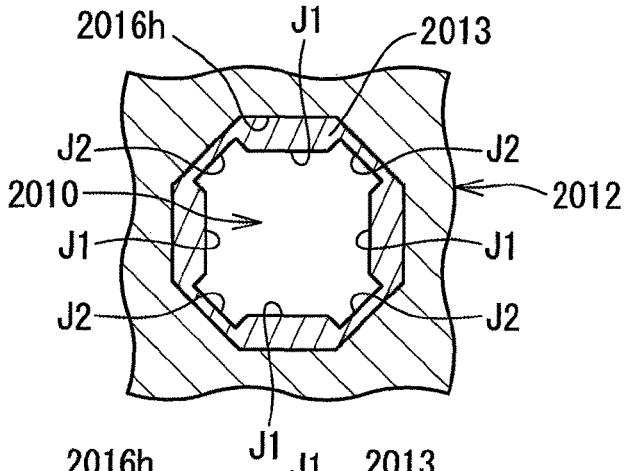
Figure 17C:
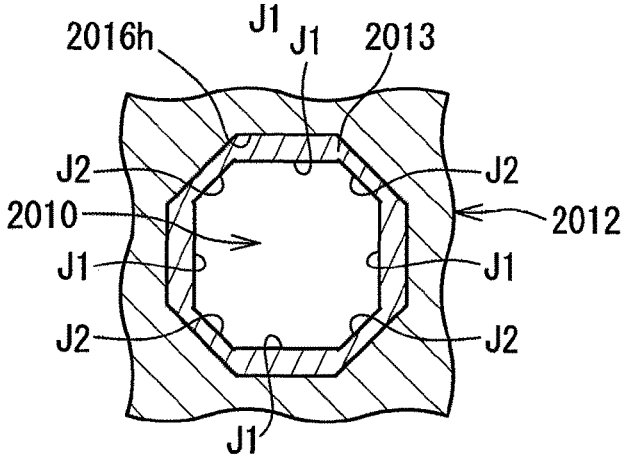
Figure 17D:
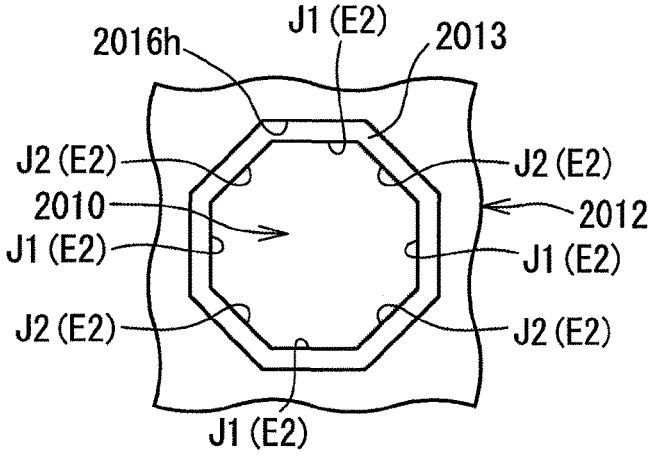

FIG. 15 is a perspective view of a sleeve 2000 according to another embodiment. FIG. 16(*a*) is a plan view of the sleeve 2000. FIG. 16(*b*) is a sectional view taken along line B-B in FIG. 15. FIG. 16(*c*) is a sectional view taken along line C-C in FIG. 15. FIG. 16(*d*) is a bottom view of the sleeve 2000.

The sleeve 2000 includes an inner surface 2002, an outer surface 2004, an upper end surface 2006 and a lower end surface 2008.

The inner surface 2002 is a circumferential surface. A shaft is adhered to the inner surface 2002.

The outer surface 2004 includes a reverse-tapered engagement face K1. A plurality of reverse-tapered engagement faces K1 are provided. The reverse-tapered engagement faces K1 are arranged at a plurality of positions in the circumferential direction. The reverse-tapered engagement faces K1 are arranged at predetermined intervals in the circumferential direction. The reverse-tapered engagement faces K1 are arranged at equal intervals in the circumferential direction. The reverse-tapered engagement faces K1 are arranged at intervals of a predetermined angle (90 degree) in the circumferential direction.

The outer surface 2004 includes a non-engagement face K2. A plurality of non-engagement faces K2 are provided. The non-engagement faces K2 are arranged at a plurality of positions in the circumferential direction. The non-engagement faces K2 are arranged at predetermined intervals in the circumferential direction. The non-engagement faces K2 are arranged at equal intervals in the circumferential direction. The non-engagement faces K2 are arranged at intervals of a predetermined angle (90 degree) in the circumferential direction.

The reverse-tapered engagement faces K1 and the non-engagement faces K2 are alternately arranged in the circumferential direction.

As understood from FIG. 16(*a*) to FIG. 16(*d*), the sectional area of the outer surface 2004 is increased as going to the lower end surface 2008 from the upper end surface 2006. The reverse-tapered engagement faces K1 are inclined so as to extend toward the radially outward direction as approaching to the lower end surface 2008. The reverse-tapered engagement faces K1 are reverse-tapered surfaces (see FIG. 15).

The sectional shape of the non-engagement faces K2 is the same regardless of the axial direction position thereof. The sectional shape of the non-engagement faces K2 is along a polygon (regular polygon). The sectional shape of the non-engagement faces K2 is along an octagon (regular octagon). The sectional shape of the non-engagement faces K2 coincides with respective alternate sides of the regular polygon. The radial direction position of the non-engagement faces K2 remains the same at any axial direction position. At any axial direction position, the reverse-tapered engagement faces K1 are located outside the non-engagement faces K2 in the radial direction.

The sectional shape of the outer surface 2004 has a rotation symmetric property at any axial direction position. At any axial direction position, the sectional shape of the outer surface 2004 has 4-fold rotation symmetry. When the sectional shape of the outer surface 2004 has n-fold rotation symmetry (n is an integer of greater than or equal to 2), n is preferably greater than or equal to 3 and less than or equal to 12, and more preferably greater than or equal to 4 and less than or equal to 8. In the present application, n means the maximum value in values n can take. For example, a square has 4-fold rotation symmetry, and also has 2-fold rotation symmetry. However, n of the square is the maximum value in the values n can take, that is, 4.

FIG. 17 (*a*) to FIG. 17 (*d*) show a hosel hole 2010. FIG. 17 (*a*) is a plan view of the hosel hole 2010, and shows the upper end of the hosel hole 2010. FIG. 17 (*d*) is a bottom view of the hosel hole 2010, and shows the lower end of the hosel hole 2010. FIG. 17 (*b*) and FIG. 17 (*c*) are sectional views of the hosel hole 2010. FIG. 17(*b*) is a sectional view of the hosel hole 2010 at a position corresponding to line B-B in FIG. 15. FIG. 17(*c*) is a sectional view of the hosel hole 2010 at a position corresponding to line C-C in FIG. 15.

The hosel hole 2010 corresponds to the sleeve 2000. The sleeve 2000 is fixed to a tip end portion of a shaft (not shown in the drawings). The shaft to which the sleeve 2000 is fixed is fixed to the hosel hole 2010 of the head. The hosel hole 2010 is provided on a hosel part 2012 of the head.

The hosel hole 2010 includes a reverse-tapered hole face J1. The reverse-tapered hole face J1 is a face corresponding to each reverse-tapered engagement face K1. A plurality of reverse-tapered hole faces J1 are provided. The reverse-tapered hole faces J1 are arranged at a plurality of positions in the circumferential direction. The reverse-tapered hole faces J1 are arranged at predetermined intervals in the circumferential direction. The reverse-tapered hole faces J1 are arranged at equal intervals in the circumferential direction. The reverse-tapered hole faces J1 are arranged at intervals of a predetermined angle (90 degree) in the circumferential direction. The reverse-tapered hole faces J1 are an example of the reverse-tapered hole.

The hosel hole 2010 includes an interference-avoiding face J2. A plurality of interference-avoiding faces J2 are provided. The interference-avoiding faces J2 are arranged at a plurality of positions in the circumferential direction. The interference-avoiding faces J2 are arranged at predetermined intervals in the circumferential direction. The interference-avoiding faces J2 are arranged at intervals of a predetermined angle (90 degree) in the circumferential direction.

The reverse-tapered hole faces J1 and the interference-avoiding faces J2 are alternately arranged in the circumferential direction.

As understood from FIG. 17 (*a*) to FIG. 17(*d*), the sectional area of the hosel hole 2010 is increased as going to the lower end from the upper end. The reverse-tapered hole faces J1 are inclined so as to extend toward the radially outward direction as going to the lower side. The reverse-tapered hole faces J1 are reverse-tapered surfaces.

The radial direction position and orientation of the interference-avoiding faces J2 are the same regardless of the axial direction position thereof. The sectional shape of the interference-avoiding faces J2 is along a polygon (regular polygon). The sectional shape of the interference-avoiding faces J2 is along an octagon (regular octagon). The sectional shape of the interference-avoiding faces J2 coincide with respective alternate sides of the regular polygon. The radial direction position of the interference-avoiding faces J2 remains the same at any axial direction position. At any axial direction position other than lower end surfaces of the interference-avoiding faces J2, the interference-avoiding faces J2 are positioned outside of the reverse-tapered hole faces J1 in the radial direction.

The sectional shape of the hosel hole 2010 has a rotation symmetric property at any axial direction position. At any axial direction position, the sectional shape of the hosel hole 2010 has 4-fold rotation symmetry. When the sectional shape of the hosel hole 2010 has n-fold rotation symmetry (n is an integer of greater than or equal to 2), n is preferably greater than or equal to 3 and less than or equal to 12, and more preferably greater than or equal to 4 and less than or equal to 8.

Figure 18A:
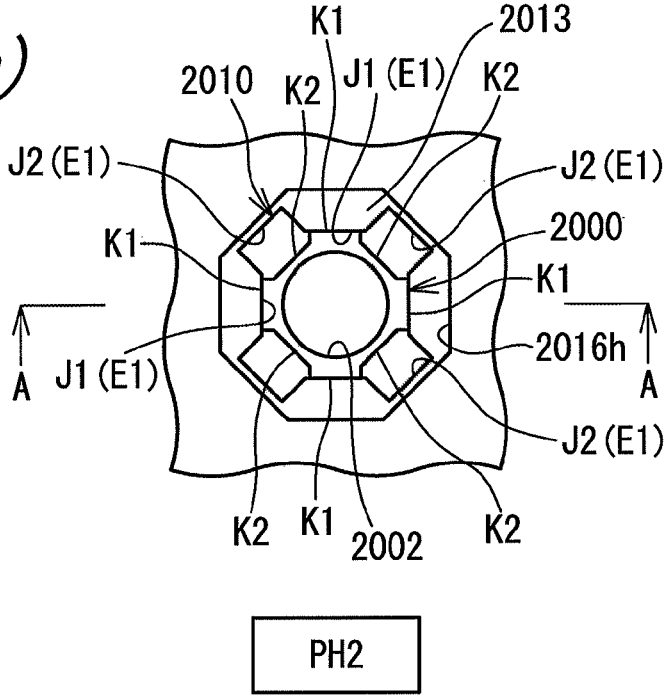
FIG. 18 (*a*) is a plan view of the hosel hole as viewed from the upper side when the sleeve of FIG. 15 is in an engagement state, and FIG. 18 (*b*) is a bottom view of the hosel hole as viewed from the lower side when the sleeve of FIG. 15 is in the engagement state.
Figure 18B:
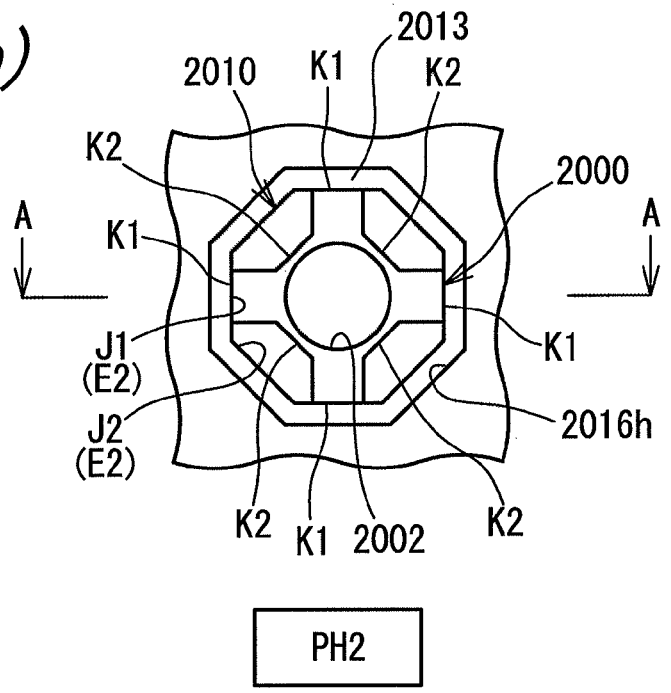
Figure 19:
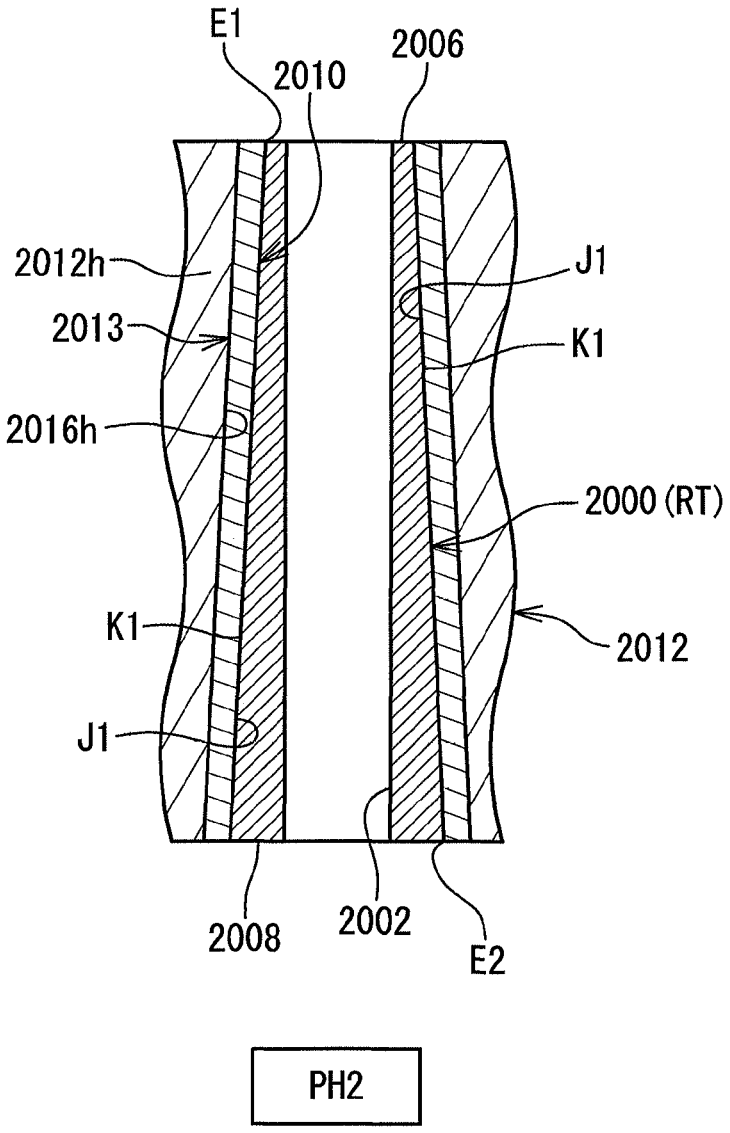
FIG. 19 is a sectional view of the vicinity of the hosel hole when the sleeve of FIG. 15 is in the engagement state.

FIG. 18(*a*) and FIG. 18(*b*) each show the sleeve 2000 and the hosel hole 2010 in the engagement state. FIG. 19 is a sectional view taken along line A-A in FIG. 18(*a*) and FIG. 18 (*b*). The golf club according to the present embodiment becomes usable by the engagement state.

In the engagement state, the reverse-tapered engagement faces K1 abut on the respective reverse-tapered hole faces J1. All the reverse-tapered engagement faces K1 abut on the respective reverse-tapered hole faces J1. The reverse-tapered engagement faces K1 are fitted to the reverse-tapered hole faces J1.

In the engagement state, the non-engagement faces K2 are opposed to the respective interference-avoiding faces J2. All the non-engagement faces K2 are opposed to the respective interference-avoiding faces J2. A gap (space) is present each between the non-engagement faces K2 and the respective interference-avoiding faces J2.

Figure 20:
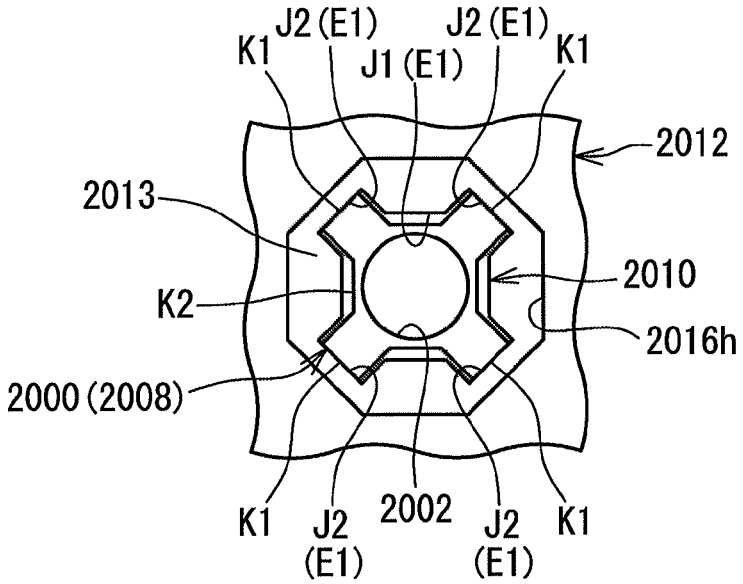
FIG. 20 is a plan view showing the sleeve and the hosel hole in a process of passing the sleeve of FIG. 15 through the hosel hole.

FIG. 20 is a plan view showing the sleeve 2000 and the hosel hole 2010 in a process of passing the sleeve 2000 through the hosel hole 2010. FIG. 20 shows a state at a starting time of the passing process. FIG. 20 shows the upper end of the hosel hole 2010 (FIG. 17(*a*)) and the lower end surface 2008 of the sleeve 2000.

In the present embodiment, a spacer is not used. In the present embodiment, only the sleeve 2000 constitutes the tip engagement part RT.

The tip engagement part RT can be made to pass through the hosel hole 2010. Also in the present embodiment, the tip engagement part RT can pass through the hosel hole 2010. FIG. 20 shows the fact that the passing can be performed. The sleeve 2000 has the maximum sectional area at the lower end surface 2008 of the sleeve 2000. On the other hand, the hosel hole 2010 has the minimum sectional area at the upper end of the hosel hole 2010. FIG. 20 shows that the lower end surface 2008 having the maximum sectional area can pass through the upper end of the hosel hole 2010 which has the minimum sectional area. The sleeve 2000 can pass through the hosel hole 2010. The sleeve 2000 can be inserted to the hosel hole 2010 from the upper side and can come out from the lower side of the hosel hole 2010.

In the present disclosure, a first phase state PH1 and a second phase state PH2 are defined. The first phase state PH1 and the second phase state PH2 show relative phase relationships between the hosel hole 2010 and the sleeve 2000. A mutual shifting between the first phase state PH1 and the second phase state PH2 can be performed by rotating the sleeve 2000 with respect to the hosel hole 2010.

In the first phase state PH1, the reverse-tapered engagement faces K1 are opposed to the respective interference-avoiding faces J2. FIG. 20 shows the first phase state PH1. As described above, in the first phase state PH1 (FIG. 20), the hosel hole 2010 allows the tip engagement part RT (sleeve 2000) to pass through the hosel hole 2010. Although not clearly shown in FIG. 20, a (slight) clearance is present each between the reverse-tapered engagement faces K1 and the respective interference-avoiding faces J2.

As shown in FIG. 20, in the first phase state PH1, the non-engagement faces K2 are opposed to the respective reverse-tapered hole faces J1. In the first phase state PH1, a gap is present each between the non-engagement faces K2 and the reverse-tapered hole faces J1.

In the second phase state PH2, the reverse-tapered engagement faces K1 are opposed to the respective reverse-tapered hole faces J1. FIG. 18(*a*) and FIG. 18(*b*) show the second phase state PH2. In the second phase state PH2, the engagement state is achieved. As described above, in the engagement state, the reverse-tapered engagement faces K1 are brought into surface-contact with the respective reverse-tapered hole faces J1. In the second phase state PH2, the reverse-tapered engagement faces K1 can be fitted to the respective reverse-tapered hole faces J1.

Thus, for assembling the golf club according to the present embodiment, the sleeve 2000 is fixed (adhered) to the tip end portion of the shaft. Next, the sleeve 2000 is inserted to the hosel hole 2010 from above, and is made to completely pass through the hosel hole 2010. By the passing, the sleeve 2000 reaches the lower side of the sole, and the shaft is inserted to the hosel hole 2010. In the passing process, the first phase state PH1 is adopted (see FIG. 20). Next, the sleeve 2000 fixed to the shaft is rotated so that the first phase state PH1 is shifted to the second phase state PH2. The sleeve 2000 is exposed to the outside, and thus can be freely rotated. In the present embodiment, the angle of the rotation is 45 degrees. Finally, the shaft to which the sleeve 2000 is fixed is pulled up, and the reverse-tapered engagement faces K1 are fitted to the respective reverse-tapered hole faces J1. This final state is shown in FIG. 18(*a*), FIG. 18(*b*) and FIG. 19.

Thus, the first phase state PH1 enables the sleeve 2000 to pass through the hosel hole 2010. The second phase state PH2 enables the sleeve 2000 to be fitted to the hosel hole 2010.

In the sleeve 2000, a center line of the sleeve inner surface 2002 is not inclined with respect to a center line of the sleeve outer surface. Of course, the center line of the sleeve inner surface 2002 may be inclined with respect to the center line of the sleeve outer surface. The center line of the sleeve inner surface 2002 may be parallel and eccentric with respect to the center line of the sleeve outer surface.

In the present embodiment, a spacer is not used. However, a spacer can be provided. For example, the shape of the sleeve 2000 can be formed by a spacer and a sleeve. In this case, the outer shape of this sleeve may be a regular eight-sided pyramid having a reverse-tapered shape. The spacer suited to the sleeve may have an inner shape of a regular eight-sided pyramid corresponding to the outer shape of the sleeve, and may have an outer shape which is the same as the shape of the sleeve 2000. When a spacer is used, an inclination angle can be set between the center line of the inner shape of the sleeve and the center line of the outer shape of the sleeve, and an inclination angle can be set between the center line of the inner shape of the spacer and the center line of the outer shape of the spacer.

As well shown in FIG. 19, the hosel part 2012 includes a hosel body 2012*h* and a resin part 2013. The hosel body 2012*h* is made of a metal. The resin part 2013 is made of a resin. The hosel body 2012*h* includes a body hole 2016*h*. The body hole 2016*h* is a reverse-tapered hole. The shape of the body hole 2016*h* is an eight-sided pyramid as a whole. As shown in FIG. 17(*a*) to FIG. 17(*d*), at any axial direction position, the sectional shape of the body hole 2016*h* is an octagon (regular octagon). The body hole 2016*h* is formed by a metal. The resin part 2013 is fixed inside the body hole 2016*h*. The resin part 2013 is adhered to the inside of the body hole 2016*h* by an adhesive.

The shape of the outer surface of the resin part 2013 corresponds to the shape of the body hole 2016*h*. That is, the outer surface of the resin part 2013 is a pyramid surface (a part of a regular eight-sided pyramid). The inner surface of the resin part 2013 constitutes the hosel hole 2010. In other words, the whole hosel hole 2010 is formed by the resin part 2013. The inner surface of the resin part 2013 includes all the reverse-tapered hole faces J1 and all the interference-avoiding faces J2. In each reverse-tapered hole face J1, the whole reverse-tapered hole face J1 is formed by the resin part 2013. In each interference-avoiding face J2, the whole interference-avoiding face J2 is formed by the resin part 2013.

As shown in FIG. 19, an upper end edge E1 of the hosel hole 2010 is formed by the resin part 2013. That is, the upper end edge E1 is formed by the resin. A lower end edge E2 of the hosel hole 2010 is formed by the resin part 2013. That is, the lower end edge E2 is formed by the resin.

Figure 21:
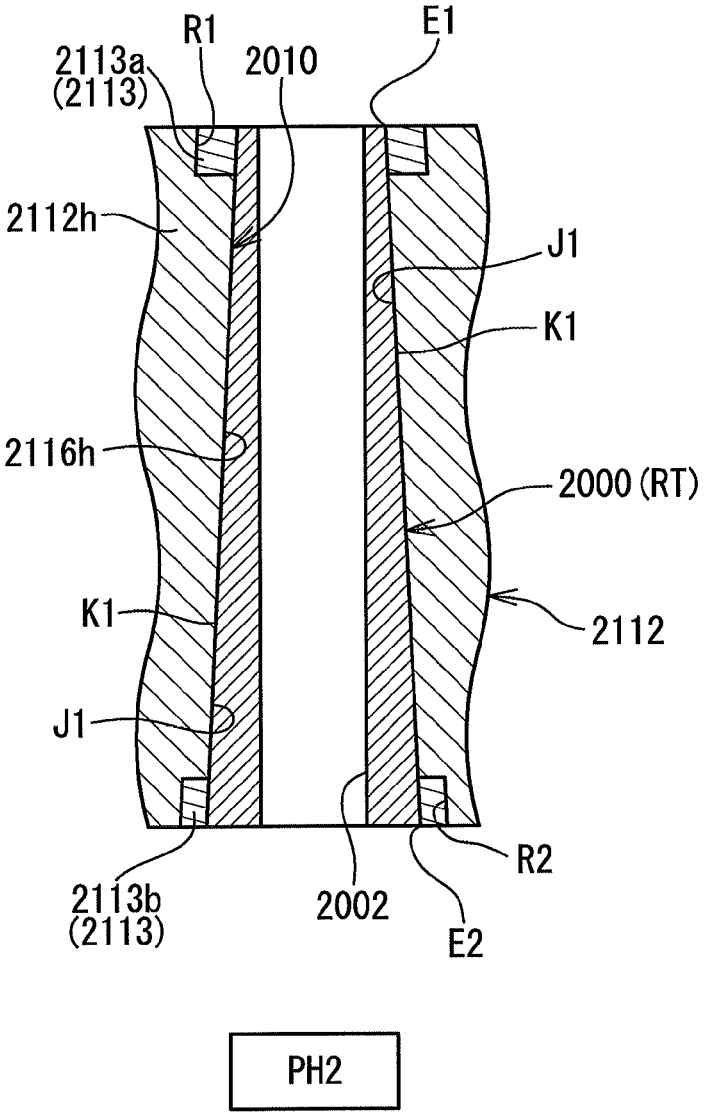
FIG. 21 is a sectional view of the vicinity of a hosel according to another embodiment.
Figure 22A:
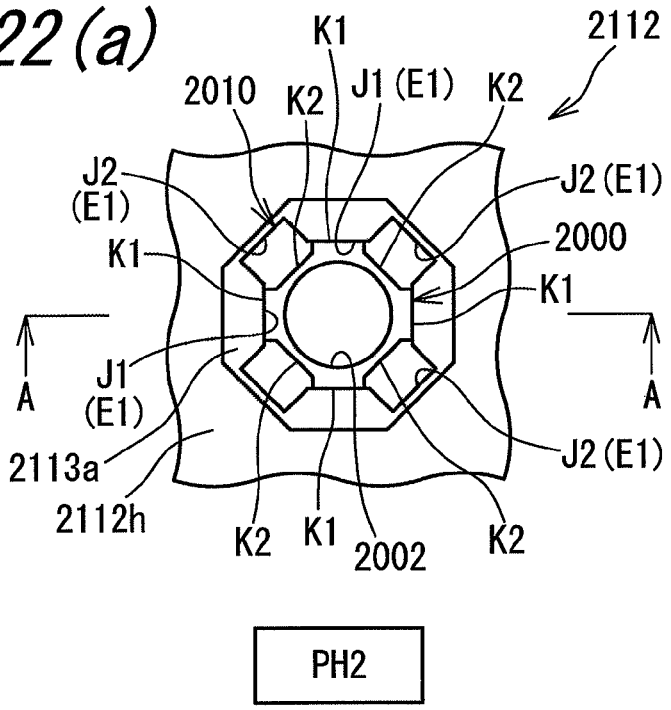
FIG. 22 (*a*) is a plan view of a hosel hole according to the embodiment of FIG. 21 as viewed from the upper side, FIG. 22 (*b*) is a bottom view of the hosel hole according to the embodiment as viewed from the lower side, and FIG. 22(*a*) and FIG. 22(*b*) show an engagement state.
Figure 22B:
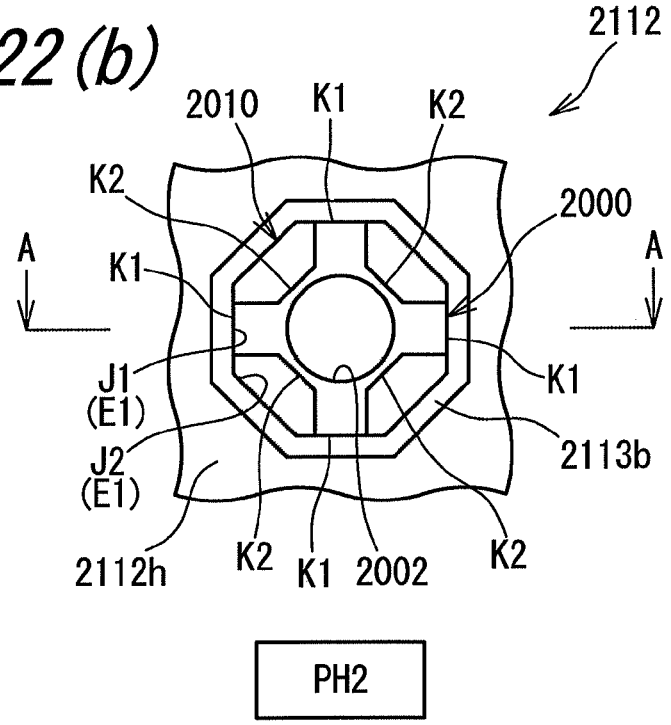

FIG. 21 shows a sectional view of a hosel part 2112 according to another embodiment. In FIG. 21, the sleeve 2000 engaged with the hosel part 2112 is also depicted. The structure of the sleeve 2000 is as described above (see FIG. 15). FIG. 22 (*a*) is a plan view of the hosel part 2112 in FIG. 21 as viewed from the upper side. FIG. 22(*b*) is a plan view of the hosel part 2112 in FIG. 21 as viewed from the lower side.

The hosel part 2112 includes a hosel body 2112*h* and a resin part 2113. The hosel body 2112*h* is made of a metal.

The resin part 2113 is made of a resin. The resin part 2113 includes an upper resin part 2113*a* and a lower resin part 2113*b*.

The hosel body 2112*h* includes a body hole 2116*h*. The body hole 2116*h* includes an upper end recess R1 and a lower end recess R2. The upper end recess R1 is formed on the upper end of the hosel hole 2010. The lower end recess R2 is formed on the lower end of the hosel hole 2010. The shape of the upper end recess R1 corresponds to the shape of the upper resin part 2113*a*. The shape of the lower end recess R2 corresponds to the shape of the lower resin part 2113*b*.

The upper resin part 2113*a* is fixed to the upper end recess R1. This fixation is attained by adhesion using an adhesive. The upper surface of the upper resin part 2113*a* fixed to the upper end recess R1 constitutes a part of the hosel upper end surface. The inner surface of the upper resin part 2113*a* fixed to the upper end recess R1 constitutes a part (upper end portion) of the hosel hole 2010.

The lower resin part 2113*b* is fixed to the lower end recess R2. This fixation is attained by adhesion using an adhesive. The lower surface of the lower resin part 2113*b* fixed to the lower end recess R2 constitutes a part of the hosel lower end surface. The inner surface of the lower resin part 2113*b* fixed to the lower end recess R2 constitutes a part (lower end portion) of the hosel hole 2010.

The upper resin part 2113*a* constitutes the upper end edge E1 of the hosel hole 2010. The lower resin part 2113*b* constitutes the lower end edge E2 of the hosel hole 2010. As shown in FIG. 22 (*a*), the upper resin part 2113*a* is an annular member. As shown in FIG. 22 (*b*), the lower resin part 2113*b* is an annular member.

The upper end edge E1 and the lower end edge E2 are formed by the resin. In the present embodiment, the upper end portion of the hosel hole which includes the upper end edge E1, and the lower end portion of the hosel hole which includes the lower end edge E2 are formed by the resin.

Figure 23:
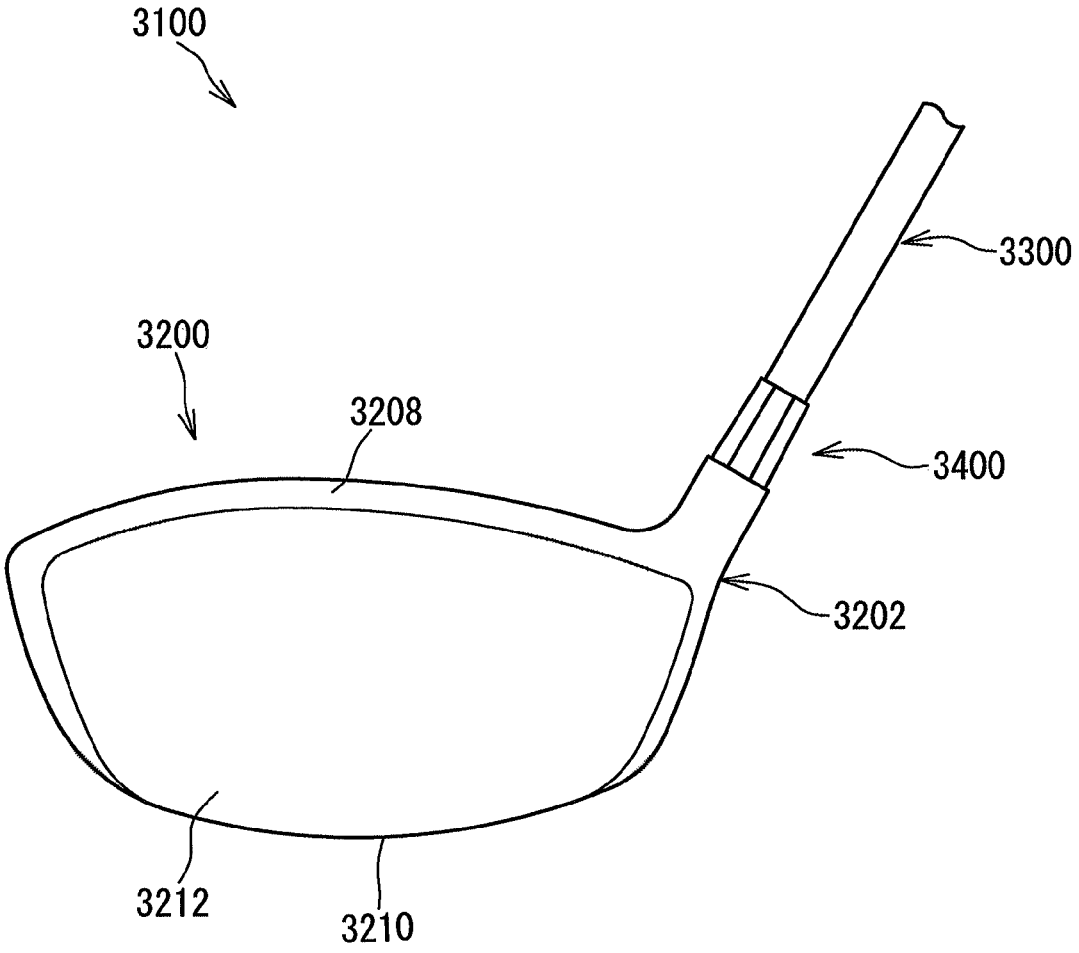
FIG. 23 shows a golf club according to another embodiment.
Figure 24:
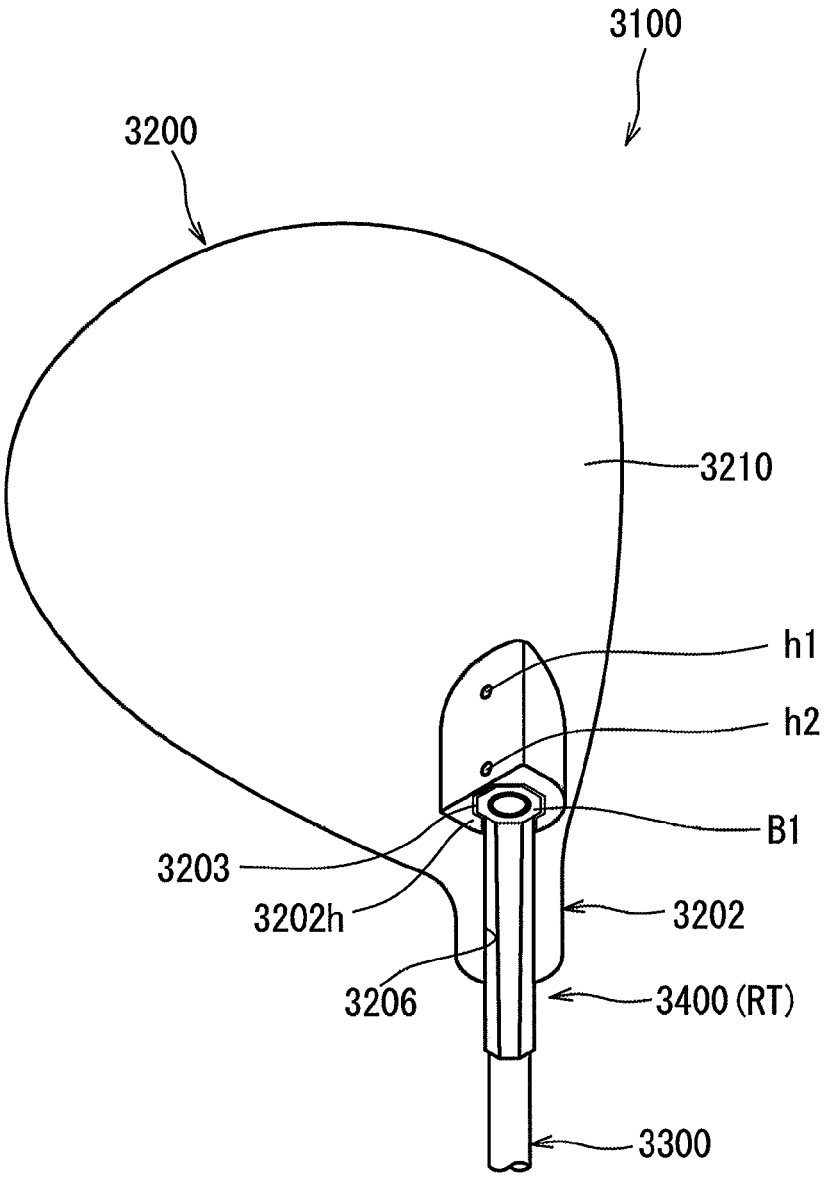
FIG. 24 is a perspective view of the golf club in FIG. 23 as viewed from the sole side.
Figure 25:
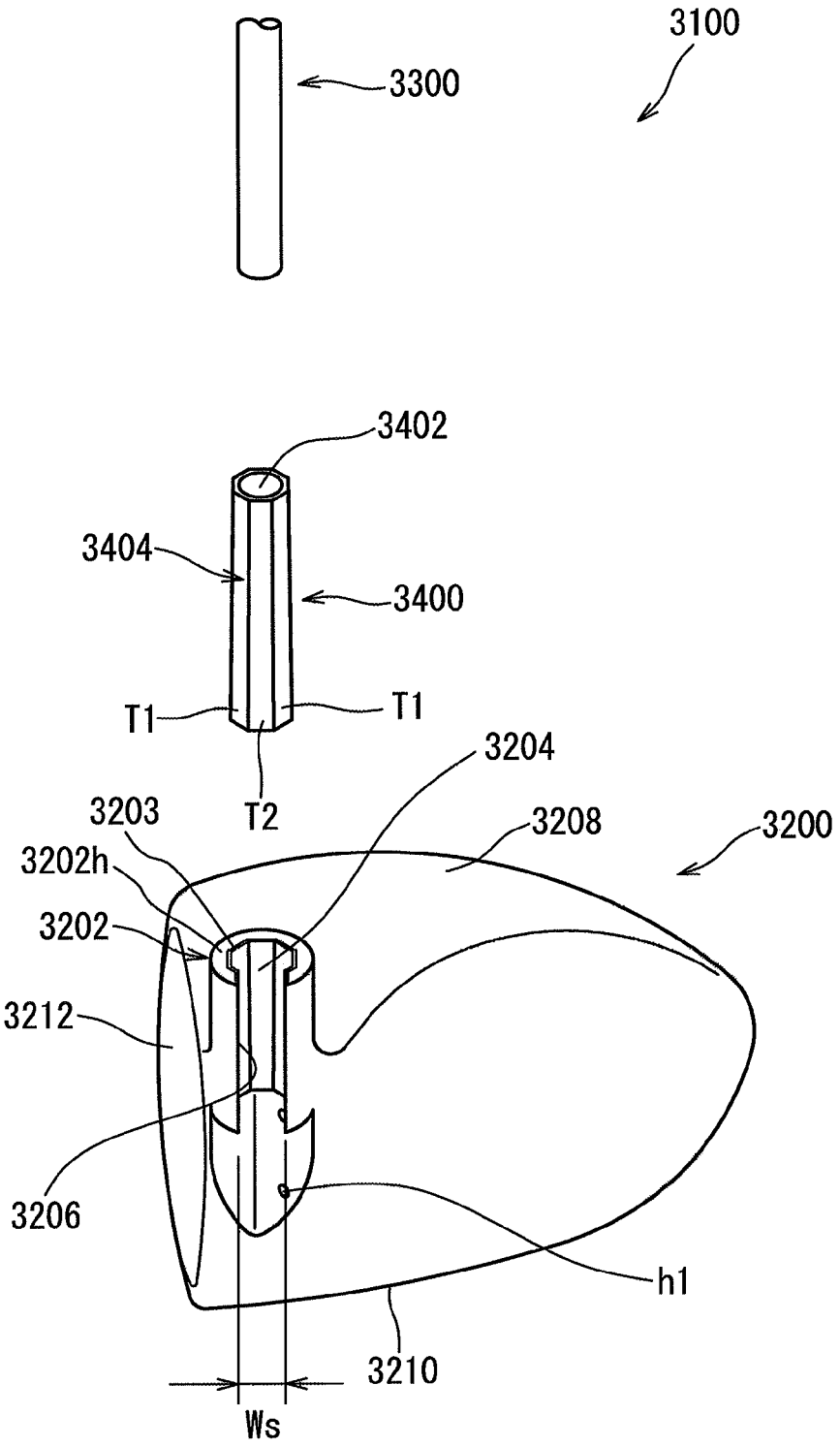
FIG. 25 is an exploded view of the golf club in FIG. 23.

FIG. 23 shows a golf club 3100 according to another embodiment. FIG. 23 shows only the vicinity of a head of the golf club 3100. FIG. 24 is a perspective view of the golf club 3100 as viewed from the sole side. FIG. 25 is an exploded perspective view of the golf club 3100.

The golf club 3100 includes a head 3200, a shaft 3300, a sleeve 3400, and a grip (not shown in the drawings). The sleeve 3400 constitutes a tip engagement part RT. The tip engagement part RT is disposed on a tip end portion of the shaft 3300. The outer surface of the tip engagement part RT is formed by the sleeve 3400.

The golf club 3100 according to the present embodiment does not include a spacer (described later). Therefore, the tip engagement part RT is constituted by only the sleeve 3400. Note that a spacer may be provided between the sleeve and the head.

The head 3200 includes a hosel part 3202. The hosel part 3202 includes a hosel hole 3204 (see FIG. 25). The hosel hole 3204 constitutes the inner surface of a reverse-tapered hole. The shape of the inner surface 3204 corresponds to the shape of the outer surface of the tip engagement part RT. In other words, the shape of the inner surface 3204 corresponds to the shape of the outer surface of the sleeve 3400. In the engagement state, the outer surface of the tip engagement part RT (the outer surface of the sleeve 3400) is brought into surface-contact with the hosel hole 3204. The outer surface of the tip engagement part RT has a plurality of (eight) planes, and a half (four) of the planes are brought into surface-contact with the hosel hole 3204. This is described in detail later.

The hosel part 3202 includes a hosel slit 3206. The hosel slit 3206 is provided lateral to the hosel part 3202. The hosel slit 3206 is an opening that allows communication between the inside of the hosel hole 3204 and the outside of the head. The hosel slit 3206 is opened to the axial-direction upper side, and is also opened to the axial-direction lower side. The hosel slit 3206 is provided on a heel side of the hosel part 3202. Although a part of the inner surface 3204 is lacking because of the presence of the hosel slit 3206, the tip engagement part RT can be held without problems.

FIG. 25 shows a width Ws of the hosel slit 3206. The width Ws is larger than the diameter of the shaft 3300. The width Ws is larger than at least the diameter of the thinnest portion of the shaft 3300. Therefore, the hosel slit 3206 allows the shaft 3300 to pass therethrough. The hosel slit 3206 allows the shaft 3300 moving in the axial perpendicular direction to pass therethrough. The axial perpendicular direction is a direction orthogonal to the axial line of the shaft 3300.

Because of the hosel slit 3206, a part in the circumferential direction of the hosel hole 3204 is lacking. From the viewpoint of enhancing the retention for the tip engagement part RT, the width Ws is preferably small. For example, it is sufficient that the width Ws is larger than the diameter of the thinnest portion of an exposed part of the shaft 3300 (for example, a portion adjacent to the tip engagement part RT). The exposed part of the shaft 3300 means a part to which a sleeve or a grip is not attached, and is exposed to the outside. Needless to say, the width Ws is set so as not to allow passage of the tip engagement part RT. The tip engagement part RT cannot pass through the hosel slit 3206.

As with a usual head, the head 3200 includes a crown 3208, a sole 3210, and a face 3212 (see FIGS. 23 to 25).

As shown in FIG. 25, the sleeve 3400 has an inner surface 3402 and an outer surface 3404. The inner surface 3402 forms a shaft hole. The sectional shape of the inner surface 3402 is a circle. The shape of the inner surface 3402 corresponds to the shape of the outer surface of the shaft 3300. The inner surface 3402 is fixed to the tip end portion of the shaft 3300. That is, the sleeve 3400 is fixed to the tip end portion of the shaft 3300. An adhesive is used for the fixation.

The outer surface 3404 is a pyramid outer surface. The outer surface 3404 is an eight-sided pyramid surface. The sectional shape of the outer surface 3404 is a non-circle. The sectional shape of the outer surface 3404 is a polygon. As described later, the sectional shape of the outer surface 3404 is a substantially polygon (substantially regular polygon). The "substantially" means that a length adjustment mechanism described later is added. In the present embodiment, the "pyramid surface" is a concept that includes a pyramid surface (substantially pyramid surface) to which the length adjustment mechanism (described later) is added.

The area of a figure (substantially regular polygon) formed by a sectional line of the outer surface 3404 is increased toward the lower side (sole side). That is, the sleeve 3400 has a reverse-tapered shape. The shape of the figure formed by the sectional line of the outer surface 3404 remains the same at any axial direction position.

Figure 26:
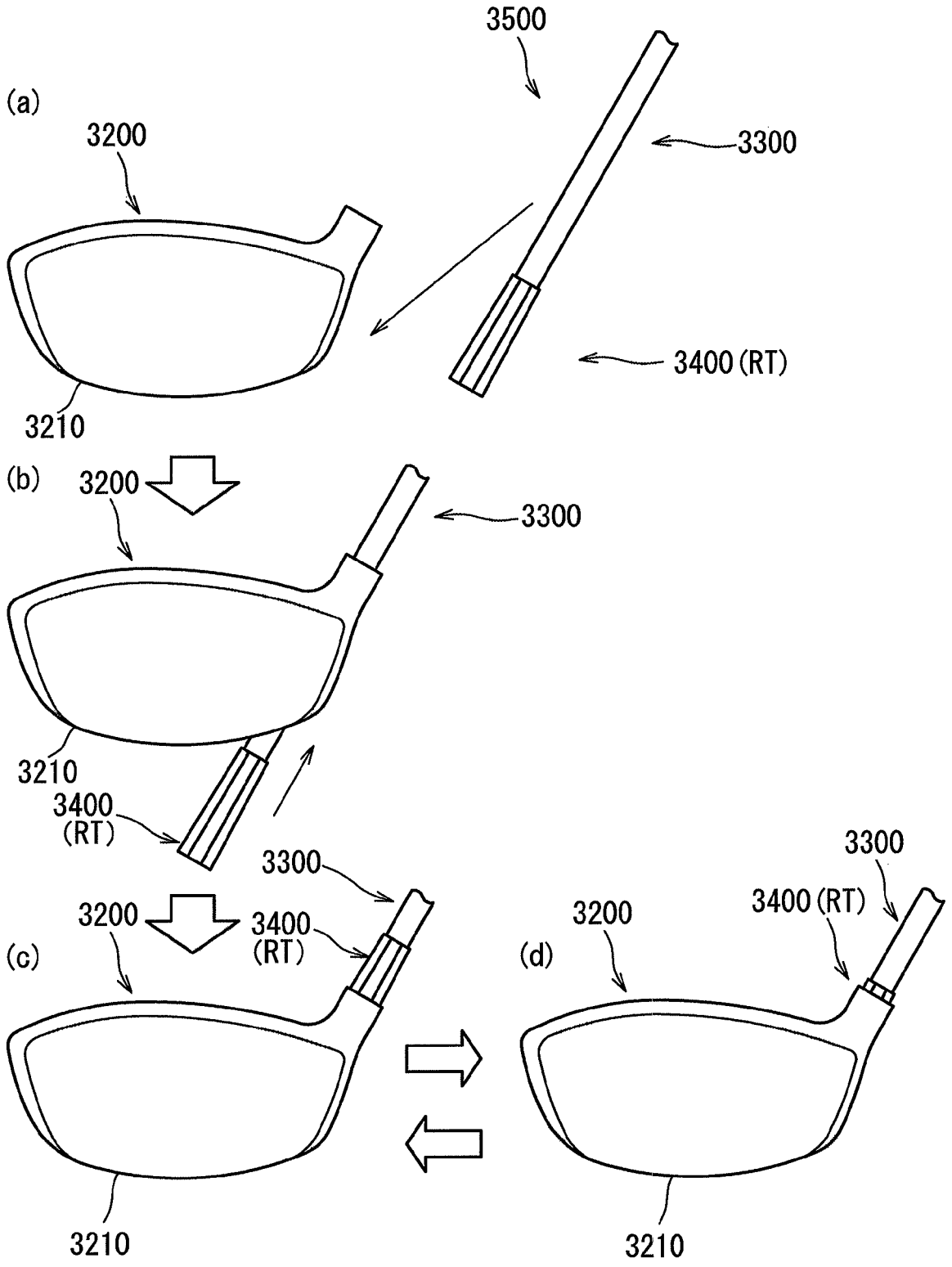
FIG. 26 is a process view showing a process of attaching a shaft in the golf club of FIG. 23.

FIG. 26 shows a procedure of mounting the shaft 3300 to the head 3200 for the golf club 3100.

In the mounting procedure, a sleeve-attached shaft 3500 is first prepared (symbol (a) in FIG. 26; first step). The sleeve-attached shaft 3500 includes the shaft 3300 and the sleeve 3400. The sleeve-attached shaft 3500 is obtained by fixing the sleeve 3400 to the tip end portion of the shaft 3300.

Next, the shaft 3300 is made to pass through the hosel slit 3206 to shift the shaft 3300 to the inside of the inner surface 3204 (symbol (b) in FIG. 26; second step). As a result of the shift of the shaft 3300, the tip engagement part RT is shifted to the sole 3210 side of the head 3200.

Finally, the shaft 3300 (the sleeve-attached shaft 3500) is moved to the grip side along the axial direction, and thereby the tip engagement part RT is fitted to the inner surface 3204 (symbol (c) in FIG. 26; third step). The mounting of the shaft 3300 to the head 3200 is achieved by the fitting. In other words, an engagement state is achieved by the fitting. The engagement state is a state where the tip engagement part RT is engaged with the inner surface 3204 so that the golf club 3100 becomes usable. In the engagement state, a reverse-tapered fitting is achieved.

Thus, in the golf club 3100, the shaft 3300 is detachably attached to the head 3200. The shaft 3300 (sleeve-attached shaft 3500) is easily attached to the head 3200. In addition, the shaft 3300 (sleeve-attached shaft 3500) is easily detached from the head 3200.

Figure 27:
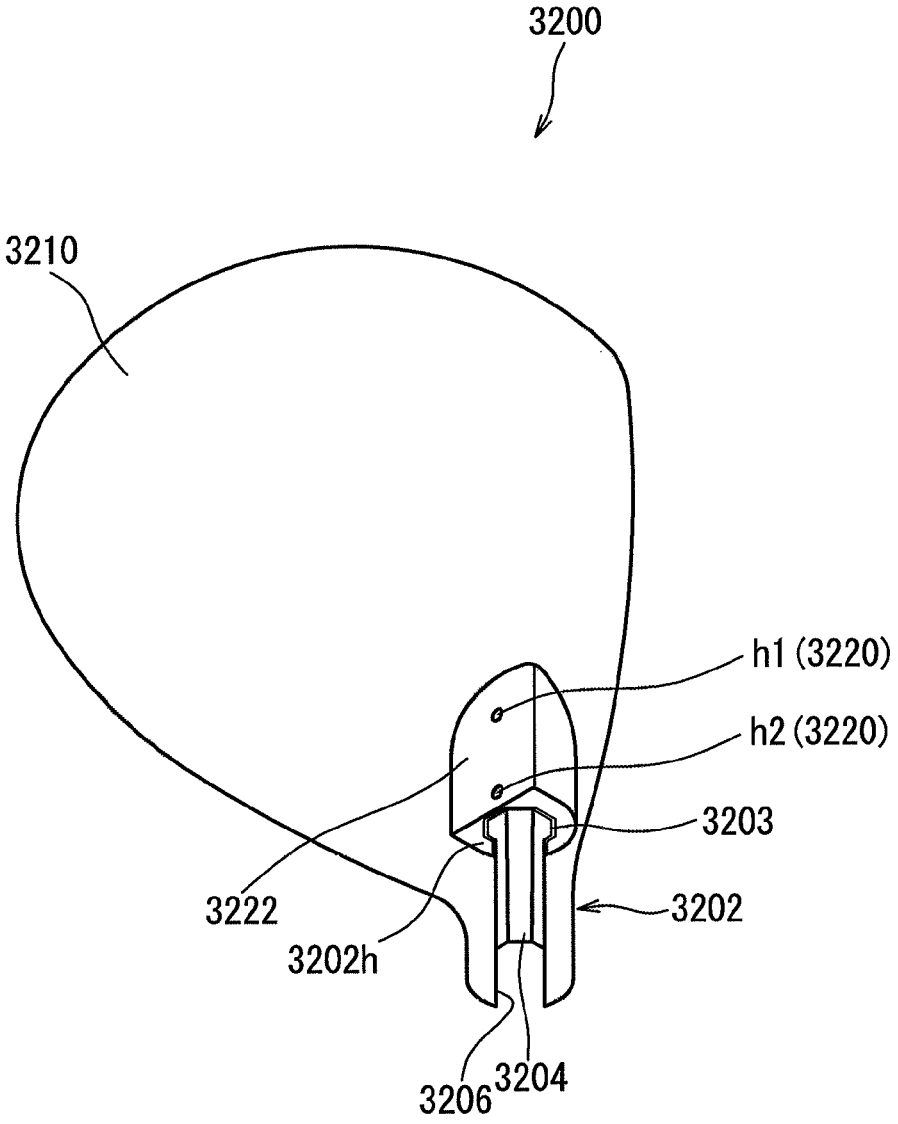
FIG. 27 is a perspective view of a head used for the golf club of FIG. 23 as viewed from the sole side.

FIG. 27 is a perspective view of the head 3200 as viewed from the sole side. The head 3200 includes a falling-off prevention part 3220. The falling-off prevention part 3220 is provided on an installation surface 3222. The installation surface 3222 is a surface extending along the axial direction. The falling-off prevention part 3220 can support a bottom surface B1 of the sleeve-attached shaft 3500 at a plurality of (two) positions. The falling-off prevention part 3220 regulates the moving of the tip engagement part RT in the engagement releasing direction.

The falling-off prevention part 3220 of the present embodiment can support the bottom surface B1 at the plurality of positions. A first screw hole h1 and a second screw hole h2 are provided on the installation surface 3222. A falling-off prevention screw (not shown in FIG. 24 or FIG. 27) is screwed to either one of the screw holes h1 and h2. The sleeve-attached shaft 3500 is prevented from falling off by abutting the falling-off prevention screw (screw sc1 in FIG. 30 described later) on the bottom surface B1 (FIG. 24) of the sleeve-attached shaft 3500.

In the golf club 3100 in the engagement state, the reverse-tapered fitting is formed between the tip engagement part RT and the inner surface 3204. A force in the engaging direction cannot release the reverse-tapered fitting, and on the contrary, enhances the contact pressure of the reverse-tapered fitting. The force in the engaging direction further ensures the engagement between the tip engagement part RT and the inner surface 3204.

A large force acting on the head 3200 of the golf club 3100 is a centrifugal force during swinging, and an impact shock force upon impact. Of the forces, the centrifugal force is the above-mentioned force in the engaging direction. Because of the loft angle of the head 3200, a component force of the impact shock force in the axial direction is also the force in the engaging direction. Therefore, the centrifugal force and the impact shock force cannot release the engagement between the tip engagement part RT and the inner surface 3204, and further ensures the engagement conversely. Since each of the tip engagement part RT and the inner surface 3204 has a non-circular sectional shape, relative rotation between the two cannot occur. As a result, although the tip engagement part RT and the inner surface 3204 are not fixed to each other by using an adhesive or the like, retention and anti-rotation required as a golf club are achieved. The structure of the reverse-tapered fitting can achieve both holding properties and attaching/detaching easiness.

Therefore, in the situation of a shot (swinging), the falling-off prevention part 3220 is not necessarily needed.

Meanwhile, in situations other than swinging, a force in the engagement releasing direction may act on the golf club 3100. Examples of the situations include a state where the golf club 3100 is inserted into a golf bag. In this state, the golf club 3100 is stood with the head 3200 up. In this case, the gravity acting on the head 3200 acts as the force in the engagement releasing direction. Even when the force in the engagement releasing direction acts under the presence of the falling-off prevention part, the head 3200 does not fall off.

The force in the engagement releasing direction is smaller than the force in the engaging direction caused by the centrifugal force, the impact shock force, etc. Therefore, a large force does not act on the falling-off prevention part 3220. The falling-off prevention part 3220 may be a simple mechanism.

Figure 28:
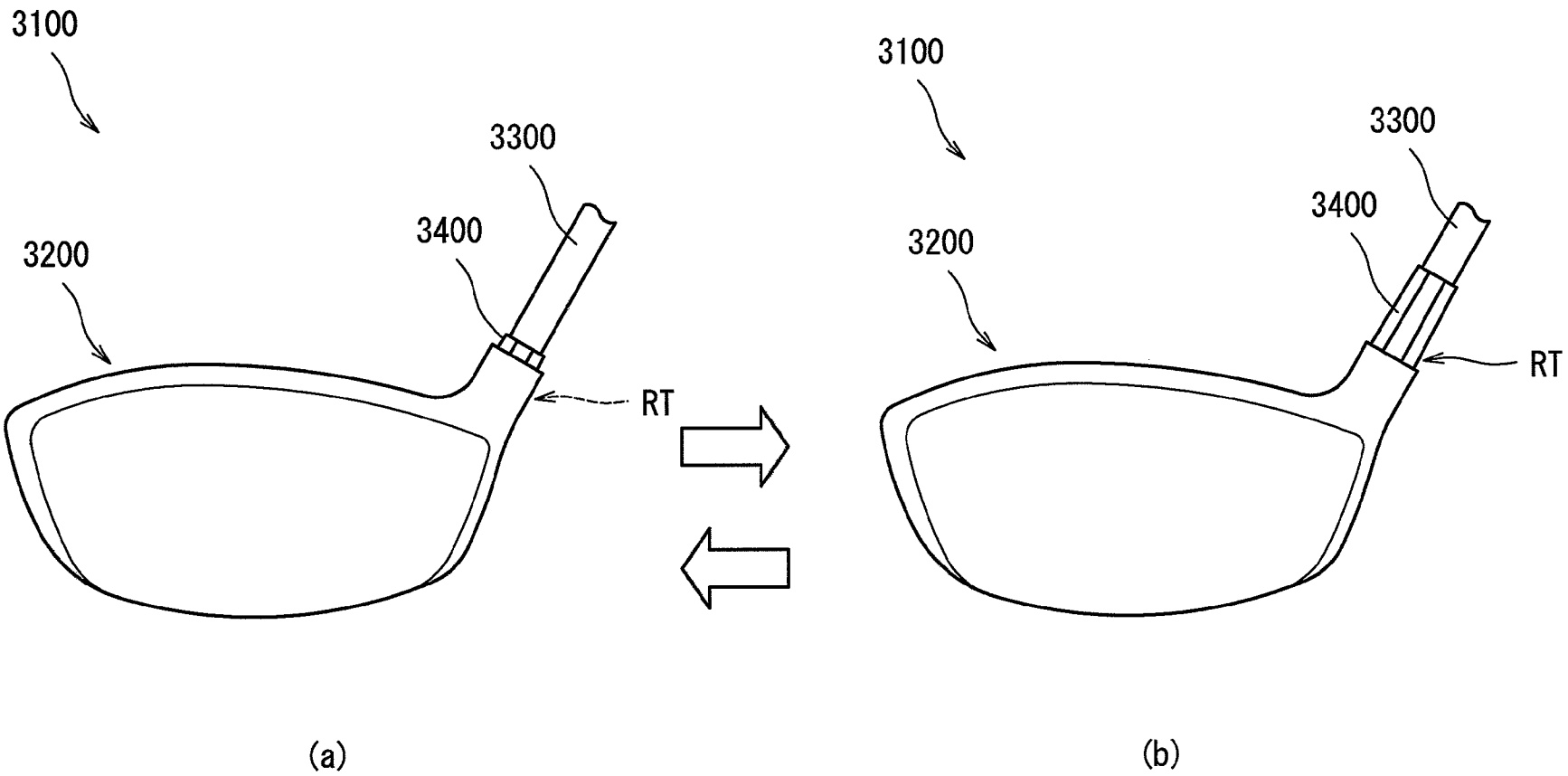
FIG. 28 is a diagram for illustrating adjustment of club length.

FIG. 28 shows two states of the golf club 3100. A symbol (a) in FIG. 28 shows a first state of the golf club 3100. A symbol (b) in FIG. 28 shows a second state of the golf club 3100. The club length in the first state is shorter than the club length in the second state. Two kinds of lengths can be selected in the golf club 3100.

Figure 29:
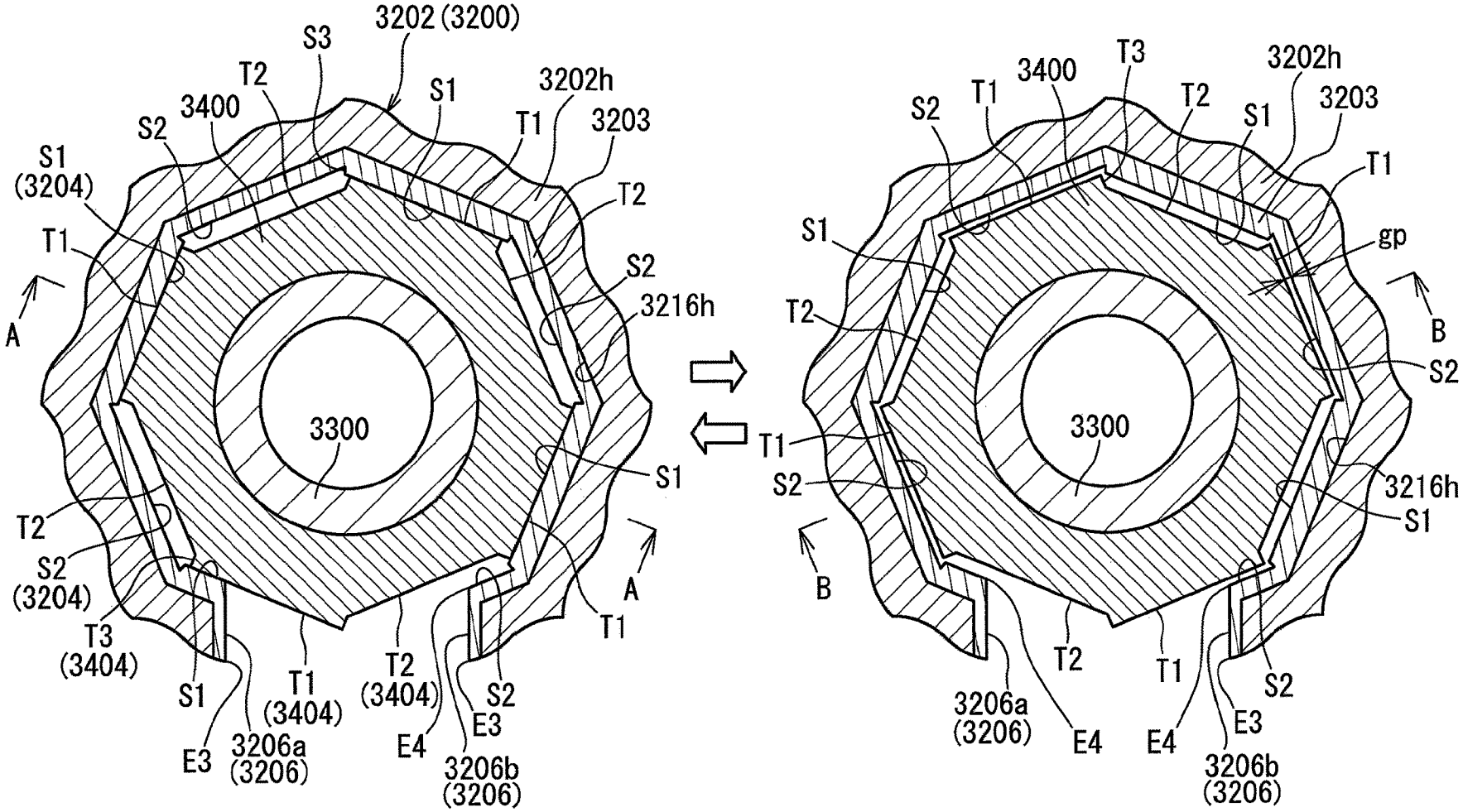
FIG. 29 is a radial-direction sectional view for illustrating the adjustment of club length.

FIG. 29 is sectional views at the hosel part 3202 of the golf club 3100, which illustrates a length adjustment mechanism.

A symbol (a) in FIG. 29 is a sectional view in the first state (short state). As shown in the symbol (a) of FIG. 29, the hosel hole 3204 includes a first abutting face S1 and the second abutting face S2.

A plurality of (four) first abutting faces S1 are provided. A plurality of (four) second abutting faces S2 are provided. The first abutting faces S1 and the second abutting faces S2 are alternately arranged. In the present embodiment, the number of the first abutting faces S1 is four, and the number of the second abutting faces S2 is four. The sum of the number of the first abutting faces S1 and the number of the second abutting faces S2 is eight.

In the sectional view of the symbol (a) in FIG. 29, the first abutting faces S1 coincide with respective alternate sides of a regular polygon (regular octagon). The regular polygon (regular octagon) coinciding with the first abutting faces S1 is defined as a first virtual regular polygon (not shown in the drawing). In the sectional view of the symbol (a) in FIG. 29, the second abutting faces S2 coincide with respective alternate sides of a regular polygon (regular octagon). The regular polygon (regular octagon) coinciding with the second abutting faces S2 is defined as a second virtual regular polygon (not shown in the drawing).

A radial direction position of the second abutting faces S2 is outside with respect to a radial direction position of the first abutting faces S1. The first virtual regular polygon (virtual regular octagon) is smaller than the second virtual regular polygon (virtual regular octagon). The first virtual regular polygon (virtual regular octagon) and the second virtual regular polygon (virtual regular octagon) have the common central point and the same phase.

Thus, the first abutting faces S1 and the second abutting faces S2 are alternately arranged along respective sides of a regular polygon (regular octagon), and the radial direction position of the first abutting faces S1 is (slightly) inside of the radial direction position of the second abutting faces S2. A step surface S3 is formed on each boundary between the first abutting faces S1 and the second abutting faces S2. The step surface S3 may not be present.

As shown in the symbol (a) in FIG. 29, the outer surface 3404 of the sleeve 3400 includes an abutting engagement face T1 and a non-abutting engagement face T2.

A plurality of (four) abutting engagement faces T1 are provided. A plurality of (four) non-abutting engagement faces T2 are provided. The abutting engagement faces T1 and the non-abutting engagement faces T2 are alternately arranged. In the present embodiment, the number of the abutting engagement faces T1 is four, and the number of the non-abutting engagement faces T2 is four. The sum of the number of the abutting engagement faces T1 and the number of the non-abutting engagement faces T2 is eight.

In the sectional view of the symbol (a) in FIG. 29, the abutting engagement faces T1 coincide with respective alternate sides of a regular polygon (regular octagon). The regular polygon (regular octagon) coinciding with the abutting engagement faces T1 is defined as a third virtual regular polygon (not shown in the drawing). In the sectional view of the symbol (a) in FIG. 29, the non-abutting engagement faces T2 coincide with respective alternate sides of a regular polygon (regular octagon). The regular polygon (regular octagon) coinciding with the non-abutting engagement faces T2 is defined as a fourth virtual regular polygon (not shown in the drawing).

A radial direction position of the abutting engagement faces T1 is outside with respect to a radial direction position of the non-abutting engagement faces T2. Therefore, the third virtual regular polygon (virtual regular octagon) is greater than the fourth virtual regular polygon (virtual regular octagon). The third virtual regular polygon (virtual regular octagon) and the fourth virtual regular polygon (virtual regular octagon) have the common central point and the same phase.

Thus, the abutting engagement faces T1 and the non-abutting engagement faces T2 are alternately arranged along respective sides of a regular polygon (regular octagon), and the radial direction position of the abutting engagement faces T1 is (slightly) outside of the radial direction position of the non-abutting engagement faces T2. A step surface T3 is formed on each boundary between the abutting engagement faces T1 and the non-abutting engagement faces T2. The step surface T3 may not be present.

The symbol (a) in FIG. 29 is a sectional view in the first state (a state where the club length is short). In the first state (a), the sleeve 3400 (the outer surface 3404 of the tip engagement part RT) is set on a first rotation position.

In the first state (a), the abutting engagement faces T1 abut on the respective first abutting faces S1. In the first state (a), the abutting engagement faces T1 are opposed to the respective first abutting faces S1, and the non-abutting engagement faces T2 are opposed to the respective second abutting faces S2. The abutting engagement faces T1 abut on the respective first abutting faces S1, whereas the non-abutting engagement faces T2 do not abut on the respective second abutting faces S2. A gap is formed each between the non-abutting engagement faces T2 and the respective second abutting faces S2.

A symbol (b1) in FIG. 29 is a sectional view showing a shifting state for shifting to the second state. In the symbol (b1) of FIG. 29, the sleeve 3400 (outer surface 3404) is set on a second rotation position.

The shifting state (b1) means a state in which the sleeve 3400 (sleeve-attached shaft 3500) is rotated by a predetermined angle θ (45 degrees) without changing the axial direction position of the sleeve 3400 with respect to the hosel part 3202. The shifting state (b1) is depicted in order to facilitate the understanding of the length adjustment mechanism. When the rotation of the predetermined angle θ is actually performed, the rotation can be made after once moving the tip engagement part RT in the engagement releasing direction. The rotation position of the sleeve 3400 (outer surface 3404) is shifted to the second rotation position from the first rotation position by rotating the sleeve 3400 (outer surface 3404) by the predetermined angle θ.

In the shifting state (b1), the abutting engagement faces T1 are opposed to the respective second abutting faces S2, and the non-abutting engagement faces T2 are opposed to the respective first abutting faces S1. In this state, the abutting engagement faces T1 do not abut on the respective second abutting faces S2. As a matter of course, the non-abutting engagement faces T2 do not abut on the respective first abutting faces S1, either. A width of each gap gp between the abutting engagement face T1 and the second abutting face S2 is smaller than a width of each gap between the non-abutting engagement face T2 and the first abutting face S1.

The fact that the abutting engagement faces T1 do not abut on the respective second abutting faces S2 in the shifting state (b1) of FIG. 29 shows the feasibility of two kinds of club lengths. That is, the gap gp realizes a second club length (greater club length). This point is explained below by using FIG. 30.

Figure 30:
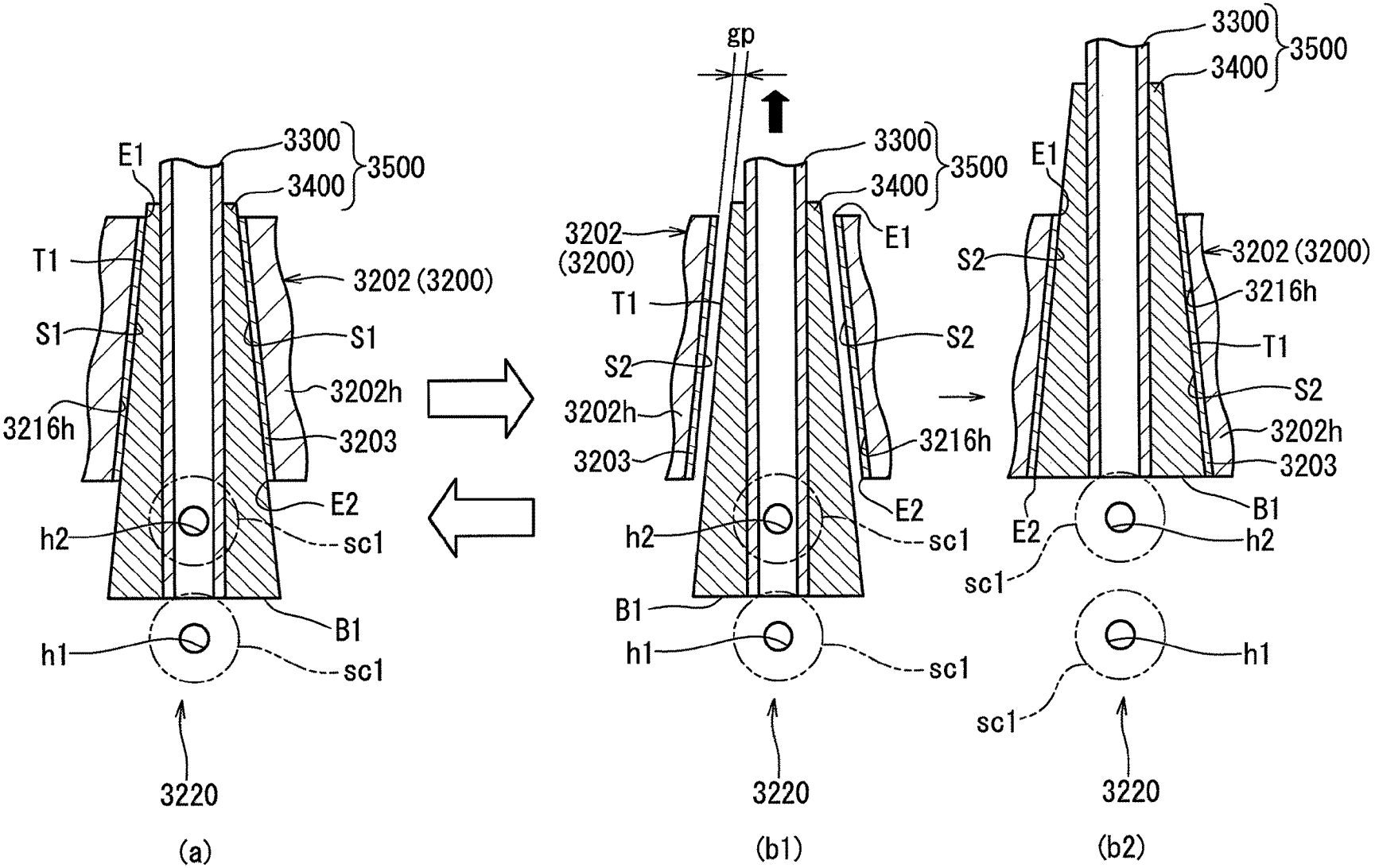
FIG. 30 is an axial-direction sectional view for illustrating the adjustment of club length.

A symbol (a) in FIG. 30 is a sectional view taken along line A-A in the symbol (a) of FIG. 29. A symbol (b1) in FIG. 30 is a sectional view taken along line B-B in the symbol (b1) of FIG. 29. As also shown in the symbol (b1) of FIG. 30, in the shifting state, a gap gp is present between the abutting engagement faces T1 and the respective second abutting faces S2. For eliminating the gap gp to make the abutting engagement faces T1 abut on the respective second abutting faces S2, the sleeve-attached shaft 3500 (tip engagement part RT) should be moved to the axial-direction upper side. That is, the abutting engagement faces T1 abut on the respective second abutting faces S2 by moving the sleeve-attached shaft 3500 in the shifting state to the axial-direction upper side with respect to the hosel part 3202. As a result, the second state is realized. A symbol (b2) in FIG. 30 shows the second state.

As described above, in the golf club 3100, the axial direction position of the outer surface 3404 with respect to the inner surface 3204 in the first state is different from that of the second state. The first state (a) in which the club length is short and the second state (b2) in which the club length is long are realized by the difference. In the golf club 3100, a mutual shifting between the first state and the second state is enabled by rotating the tip engagement part RT with respect to the inner surface 3204.

As shown in FIG. 30, the falling-off prevention part 3220 includes the plurality of screw holes h1 and h2, and a screw sc1 capable of being screwed to the screw holes h1 and h2. Plan views of a head part of the screw sc1 are shown by using two-dot chain lines in FIG. 30. The head part of the screw sc1 abuts on the lower end surface B1 of the sleeve-attached shaft 3500. As shown in the symbol (a) in FIG. 30, in the first state in which the club is short, the screw sc1 is screwed to the first screw hole h1 and abuts on the lower end surface B1 in the first state. As shown in the symbol (b2) in FIG. 30, in the second state in which the club is long, the screw sc1 is screwed to the second screw hole h2 and abuts on the lower end surface B1 in the second state. Thus, the falling-off prevention part 3220 can support the bottom surface (lower end surface) B1 of the sleeve-attached shaft 3500 at the plurality of axial direction positions.

As well shown in FIG. 29 and FIG. 30, the hosel part 3202 includes a hosel body 3202*h* and a resin part 3203. The hosel body 3202*h* is made of a metal. The resin part 3203 is made of a resin. The hosel body 3202*h* includes a body hole 3216*h*. The body hole 3216*h* is a reverse-tapered hole. As a whole, the shape of the body hole 3216*h* is an eight-sided pyramid, a part of which in the circumferential direction is lacking. The body hole 3216*h* is formed by a metal. The resin part 3203 is fixed inside the body hole 3216*h*. The resin part 3203 is adhered to the inside of the body hole 3216*h* by an adhesive.

The shape of the outer surface of the resin part 3203 corresponds to the shape of the body hole 3216*h*. That is, the outer surface of the resin part 3203 is a pyramid surface (a part of a regular eight-sided pyramid surface). The inner surface of the resin part 3203 constitutes the hosel hole 3204. In other words, the whole hosel hole 3204 is formed by the resin part 3203.

As shown in FIG. 30, an upper end edge E1 of the hosel hole 3204 is formed by the resin part 3203. That is, the upper end edge E1 is formed by the resin. A lower end edge E2 of the hosel hole 3204 is formed by the resin part 3203. That is, the lower end edge E2 is formed by the resin.

As shown in FIG. 29, the hosel slit 3206 includes a slit surfaces 3206*a* and 3206*b* opposed to each other. The slit surfaces 3206*a* and 3206*b* are covered by the resin part 3203. The slit surfaces 3206*a* and 3206*b* are formed by the resin.

An outer edge E3 of the hosel slit 3206 is formed by the resin. An inner edge E4 of the hosel slit 3206 is formed by the resin.

Figure 31:
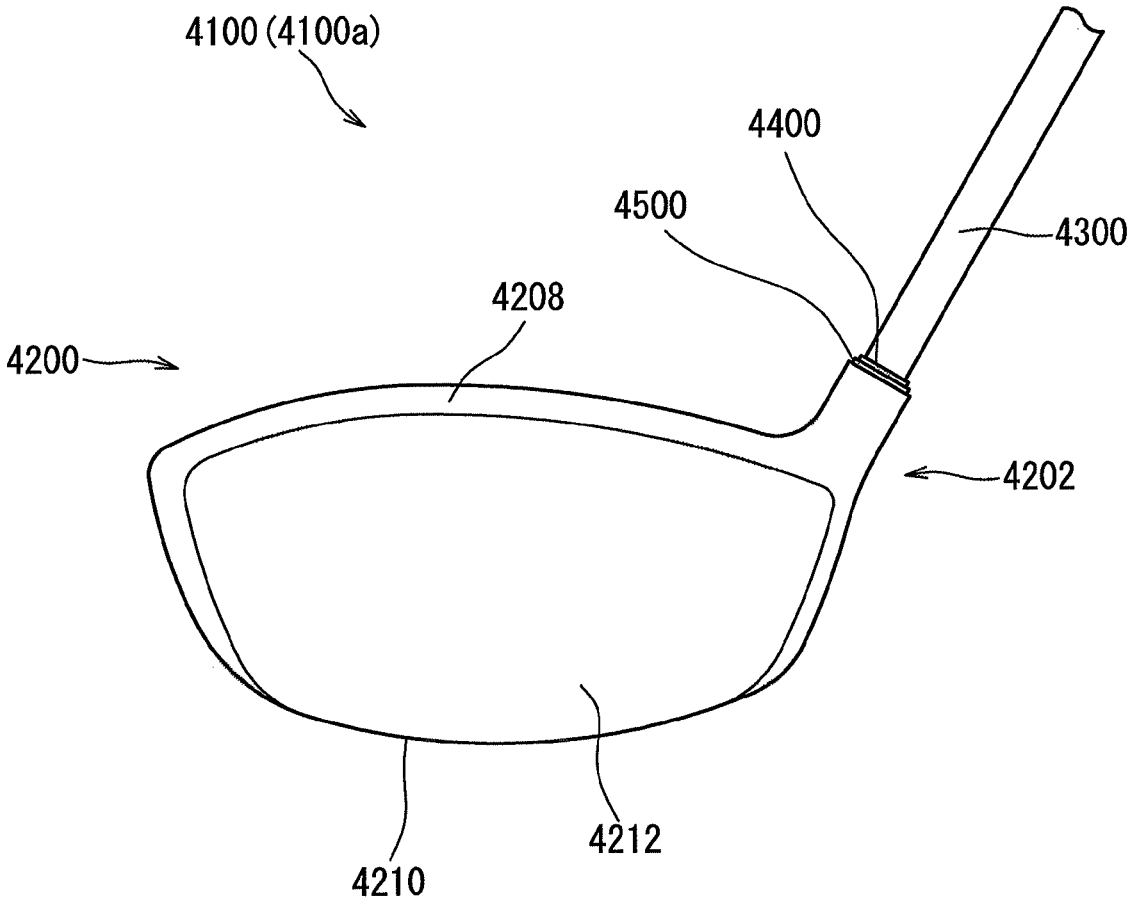
FIG. 31 shows a golf club according to another embodiment.
Figure 32:
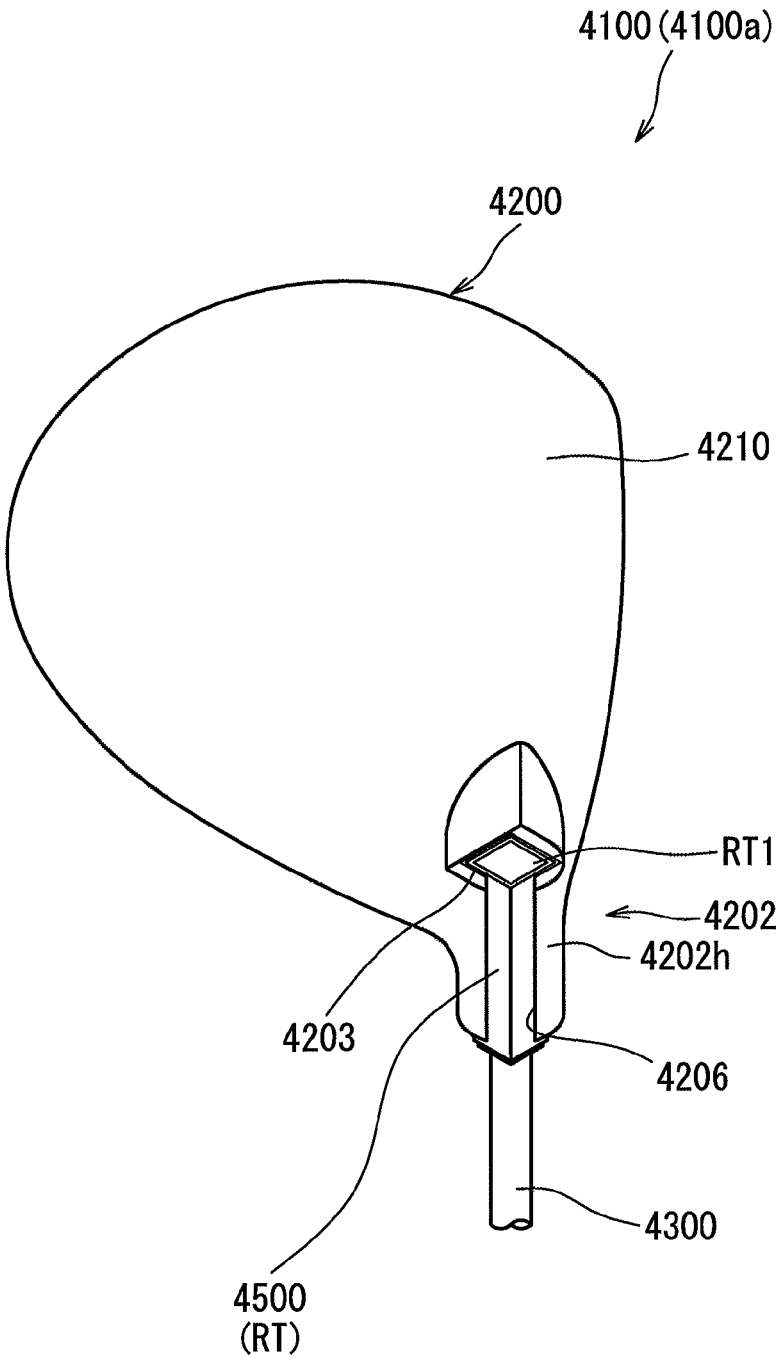
FIG. 32 is a perspective view of the golf club in FIG. 31 as viewed from the sole side.
Figure 33:
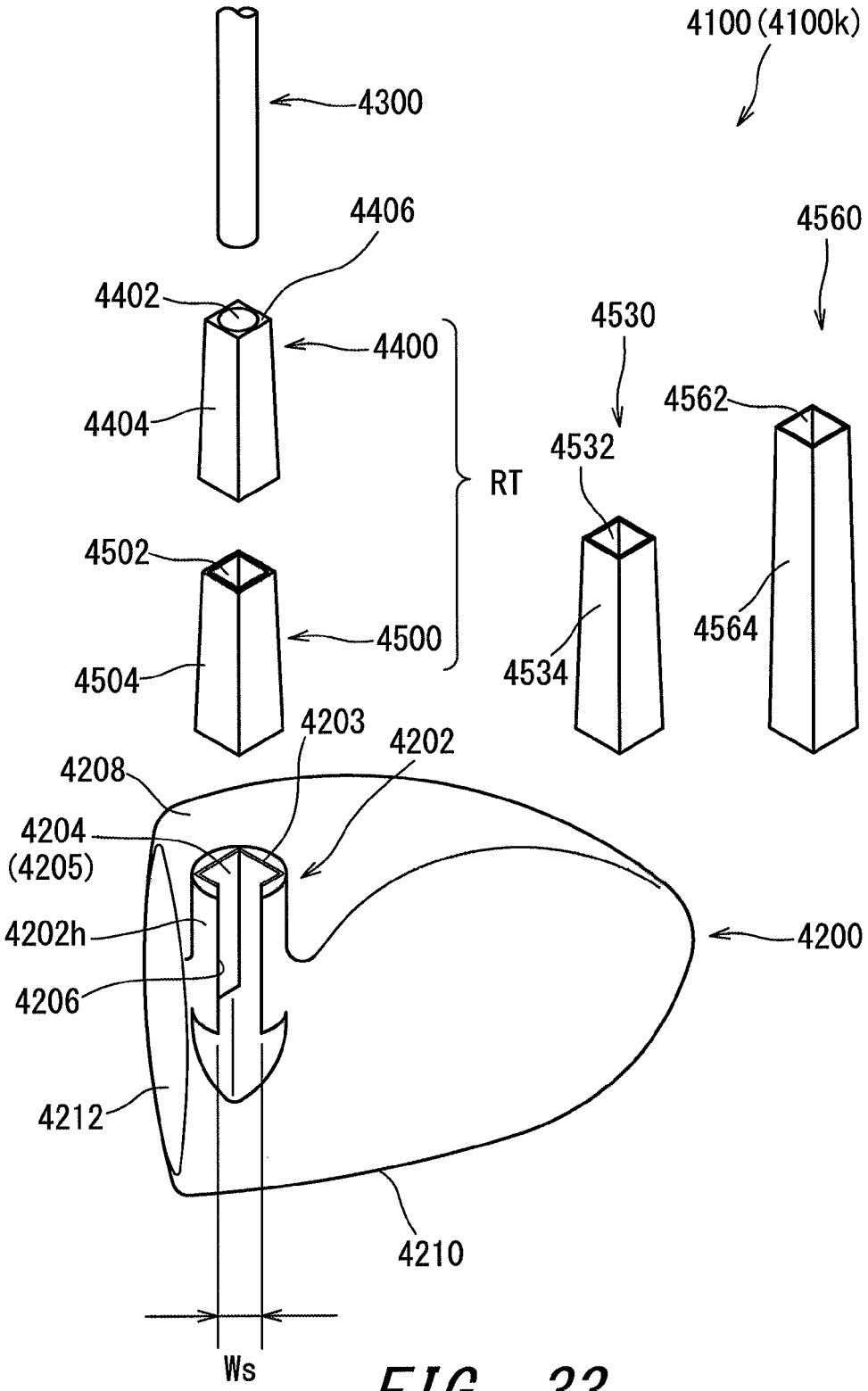
FIG. 33 is an exploded view of the golf club in FIG. 31.

FIG. 31 shows a golf club 4100 according to another embodiment. FIG. 32 is a perspective view of the golf club 4100 as viewed from the sole side. FIG. 33 is an exploded perspective view of the golf club 4100. The golf club 4100 includes a head 4200, a shaft 4300, a sleeve 4400, a spacer 4500, and a grip (not shown in the drawings).

The number of the spacers 4500 actually used in the golf club 4100 is one. However, replacement spacers 4530 and 4560 are prepared.

As shown in FIG. 33, a golf club kit 4100*k* according to the golf club 4100 includes the replacement spacers 4530 and 4560 in addition to the spacer 4500. The golf club kit 4100*k* is constituted by at least one replacement spacer and the golf club 4100. The golf club kit 4100*k* includes the plurality of (three) spacers 4500, 4530 and 4560. The respective three spacers including the two replacement spacers are also referred to as a first spacer 4500, a second spacer 4530, and a third spacer 4560. The number of the replacement spacers is preferably greater than or equal to 1, and more preferably greater than or equal to 2. The number of the replacement spacers is preferably less than or equal to 5, more preferably less than or equal to 4, and still more preferably less than or equal to 3.

In the golf club 4100, the club length can be adjusted. In the golf club 4100, the club length can be adjusted to three kinds of lengths.

The head 4200 includes a crown 4208, a sole 4210, and a face 4212. The head 4200 further includes a hosel part 4202. As shown in FIG. 33, the hosel part 4202 includes a hosel hole 4204. The hosel hole 4204 includes a reverse-tapered hole 4205. The shape of the reverse-tapered hole 4205 corresponds to the shape of the outer surface of the tip engagement part RT. In other words, the shape of the reverse-tapered hole 4205 corresponds to the shape of the outer surface of the spacer 4500.

As shown in FIG. 32 and FIG. 33, the hosel part 4202 includes a hosel slit 4206. The hosel slit 4206 is provided lateral to the hosel part 4202. The hosel slit 4206 is an opening that allows communication between the inside of the hosel hole 4204 and the outside of the head. The hosel slit 4206 allows the shaft 300 to pass through the hosel slit 4206.

As shown in FIG. 33, the sleeve 4400 includes an inner surface 4402, an outer surface 4404, and an upper end surface 4406. The inner surface 4402 forms a shaft hole. The sectional shape of the inner surface 4402 is a circle. The shape of the inner surface 4402 corresponds to the shape of an outer surface of the shaft 4300. The inner surface 4402 is fixed to the tip end portion of the shaft 4300.

The outer surface 4404 is a pyramid surface. The outer surface 4404 is a four-sided pyramid surface. The sectional shape of the outer surface 4404 is a non-circle. The sectional shape of the outer surface 4404 is a polygon (regular polygon). The sectional shape of the outer surface 4404 is a tetragon. The sectional shape of the outer surface 4404 is a square.

The spacer 4500 (first spacer 4500) has an inner surface 4502 and an outer surface 4504. The inner surface 4502 forms a sleeve hole. The sectional shape of the inner surface 4502 corresponds to the sectional shape of the outer surface 4404 of the sleeve 4400. The outer surface 4404 of the sleeve 4400 is fitted to the inner surface 4502.

The shape of the inner surface 4502 corresponds to the shape of the outer surface 4404 of the sleeve 4400. The inner surface 4502 is a pyramid surface. The inner surface 4502 is a four-sided pyramid surface. The sectional shape of the inner surface 4502 is a non-circle. The sectional shape of the inner surface 4502 is a polygon (regular polygon). The sectional shape of the inner surface 4502 is a tetragon. The sectional shape of the inner surface 4502 is a square.

The shape of the outer surface 4504 corresponds to the shape of the reverse-tapered hole 4205. The outer surface 4504 is a pyramid surface. The outer surface 4504 is a four-sided pyramid surface. The sleeve 4400 and the spacer 4500 constitute the tip engagement part RT.

The second spacer 4530 can be used by replacing the first spacer 4500 with the second spacer 4530. The second spacer 4530 is the same as the first spacer 4500 except for a length L and a wall thickness T. The second spacer 4530 has an inner surface 4532 and an outer surface 4534. The inner surface 4532 forms the sleeve hole. The sectional shape of the inner surface 4532 corresponds to the sectional shape of the outer surface 4404 of the sleeve 4400. The outer surface 4404 of the sleeve 4400 is fitted to the inner surface 4532.

The shape of the inner surface 4532 corresponds to the shape of the outer surface 4404 of the sleeve 4400. The inner surface 4532 is a pyramid surface. The inner surface 4532 is a four-sided pyramid surface. The sectional shape of the inner surface 4532 is a polygon (regular polygon).

The shape of the outer surface 4534 corresponds to the shape of the reverse-tapered hole 4205. The outer surface 4534 is a pyramid surface. The outer surface 4534 is a four-sided pyramid surface. The sectional shape of the outer surface 4534 is a non-circle. The sectional shape of the outer surface 4534 is a polygon (regular polygon). The sectional shape of the outer surface 4534 is a square. The sleeve 4400 and the spacer 4530 constitute the tip engagement part RT.

The third spacer 4560 can be used by replacing the first spacer 4500 with the third spacer 4560. The third spacer 4560 is the same as the first spacer 4500 except for the length L and the wall thickness T. The third spacer 4560 is the same as the second spacer 4530 except for the length L and the wall thickness T. The third spacer 4560 has an inner surface 4562 and an outer surface 4564. The inner surface 4562 forms the sleeve hole. The sectional shape of the inner surface 4562 corresponds to the sectional shape of the outer surface 4404 of the sleeve 4400. The outer surface 4404 of the sleeve 4400 is fitted to the inner surface 4562.

The shape of the inner surface 4562 corresponds to the shape of the outer surface 4404 of the sleeve 4400. The inner surface 4562 is a pyramid surface. The inner surface 4562 is a four-sided pyramid surface. The sectional shape of the inner surface 4562 is a non-circle. The sectional shape of the inner surface 4562 is a polygon (regular polygon). The sectional shape of the inner surface 4562 is a tetragon. The sectional shape of the inner surface 4562 is a square.

The shape of the outer surface 4564 corresponds to the shape of the reverse-tapered hole 4205. The outer surface 4564 is a pyramid surface. The outer surface 4564 is a four-sided pyramid surface. The sectional shape of the outer surface 4564 is a square. The sleeve 4400 and the spacer 4560 constitute the tip engagement part RT.

A procedure of mounting the shaft 4300 to the head 4200 for the golf club 4100 is as described above (see FIG. 4).

Figure 34:
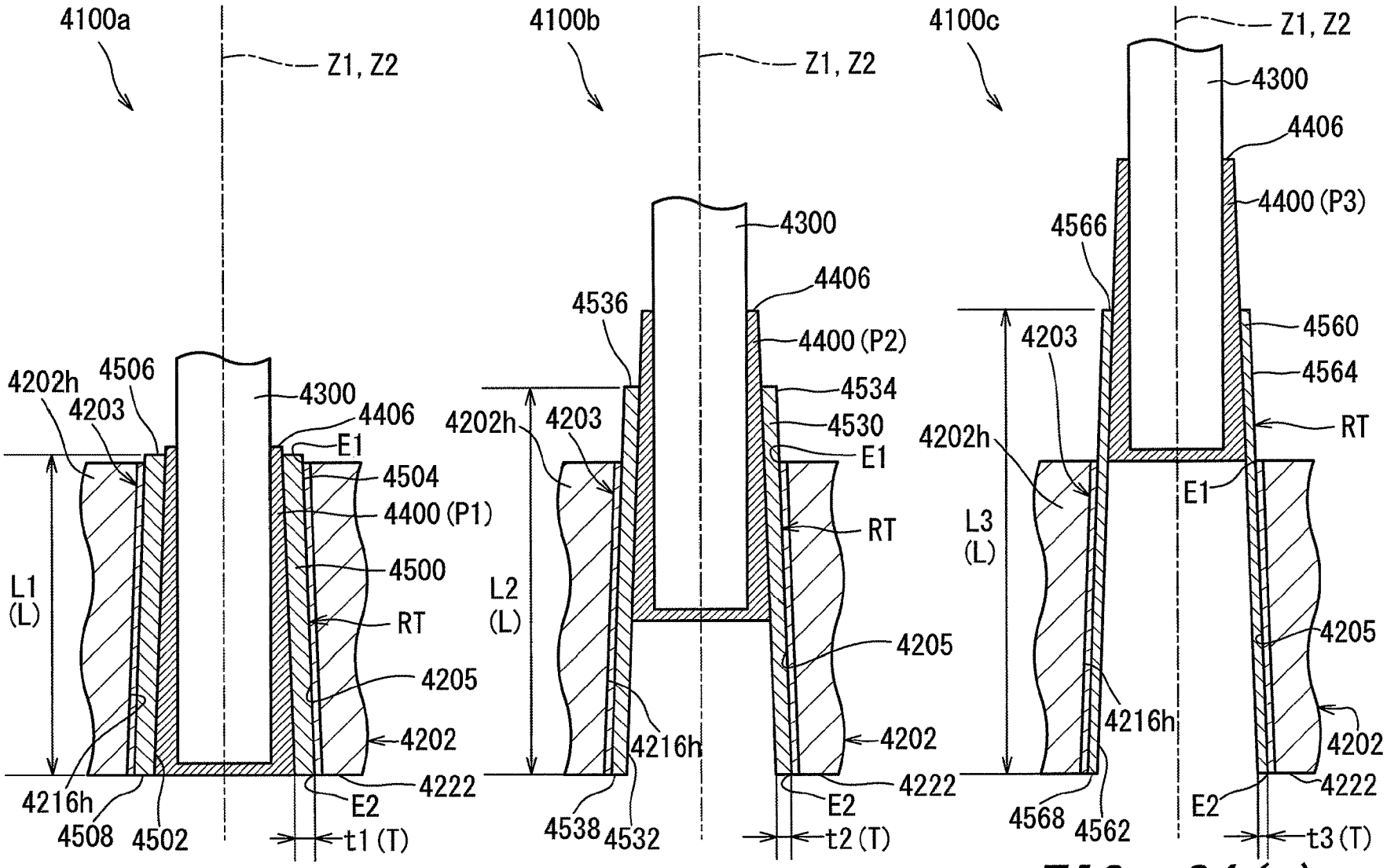
FIG. 34(*a*), FIG. 34 (*b*) and FIG. 34 (*c*) are axial-direction sectional views for illustrating adjustment of club length.

FIG. 34(*a*) to FIG. 34(*c*) are sectional views of the golf club 4100 taken along the axial direction. Hereinafter, among the spacers 4500, 4530, and 4560, a case where the spacer 4500 is used is defined as a golf club 4100*a*. The golf club 4100*a* is in a state where the club length is the minimum. In the golf club 4100*a*, the tip engagement part RT is constituted by the sleeve 4400 and the spacer 4500. Among the spacers 4500, 4530, and 4560, a case where the spacer 4530 is used is defined as a golf club 4100*b*. The golf club 4100*b* is in a state where the club length is medium. In the golf club 4100*b*, the tip engagement part RT is constituted by the sleeve 4400 and the spacer 4530. Among the spacers 4500, 4530, and 4560, a case where the spacer 4560 is used is defined as a golf club 4100*c*. The golf club 4100*c* is in a state where the club length is the maximum. In the golf club 4100*c*, the tip engagement part RT is constituted by the sleeve 4400 and the spacer 4560.

FIG. 34 (*a*) is a sectional view of the golf club 4100*a* taken along the axial direction. The golf club 4100 shown in FIG. 31 and FIG. 32 is the golf club 4100*a*. FIG. 34 (*b*) is a sectional view of the golf club 4100*b* taken along the axial direction. FIG. 34(*c*) is a sectional view of the golf club 4100*c* taken along the axial direction.

As shown in FIG. 34(*a*) to FIG. 34(*c*), the spacers 4500, 4530 and 4560 are varied in wall thickness T. A wall thickness t2 of the second spacer 4530 is thinner than a wall thickness t1 of the first spacer 4500. A wall thickness t3 of the third spacer 4560 is thinner than the wall thickness t2 of the second spacer 4530.

As shown in FIG. 34(*a*) to FIG. 34(*c*), the spacers 4500, 4530 and 4560 are varied in length L. A length L2 of the second spacer 4530 is greater than a length L1 of the first spacer 4500. A length L3 of the third spacer 4560 is greater than the length L2 of the second spacer 4530. The thinner the spacer is, the longer the spacer is. That is, the smaller the wall thickness T of the spacer is, the greater the length L of the spacer is.

Because of the variations of the wall thicknesses T in the spacers, the spacers are varied in sectional area of the inner surface thereof. In a comparison of the spacers at a same axial-direction position, the thinner the wall thickness T of the spacer is, the greater the sectional area of the inner surface of the spacer is. Specifically, in the comparison of the spacers at the same axial-direction position, the sectional area of the inner surface 4532 of the second spacer 4530 is greater than the sectional area of the inner surface 4502 of the first spacer 4500. In the comparison of the spacers at the same axial-direction position, the sectional area of the inner surface 4562 of the third spacer 4560 is greater than the sectional area of the inner surface 4532 of the second spacer 4530.

Therefore, in the engagement state, the axial-direction positions of the sleeve 4400 with respect to the respective spacers varies from each other. The axial-direction position of the sleeve 4400 which is engaged with the first spacer 4500 is defined as P1, the axial-direction position of the sleeve 4400 which is engaged with the second spacer 4530 is defined as P2, and the axial-direction position of the sleeve 4400 which is engaged with the third spacer 4560 is defined as P3. As shown in FIG. 34(*a*) to FIG. 34(*c*), the axial-direction position P2 is located on an upper side relative to the axial-direction position P1. The axial-direction position P3 is located on an upper side relative to the axial-direction position P2.

Because of the variations of the axial-direction positions, club length is varied. The golf club 4100*b* is longer than the golf club 4100*a*. The golf club 4100*c* is longer than the golf club 4100*b*.

Thus, in the golf club 4100, the club length is varied by changing the wall thicknesses T of the spacers 4500, 4530 and 4560.

In the golf club 4100, lengths L of the spacers 4500, 4530 and 4560 varies with the variations of the wall thicknesses T thereof. That is, the smaller the wall thickness T is, the greater the length L is. For this reason, although the axial-direction position of the sleeve 4400 is shifted, the engaging area of the sleeve 4400 with each of the spacers is maintained. The engaging area of each of the spacers with the reverse-tapered hole 4205 is also maintained. Therefore, in all the golf club 4100*a*, the golf club 4100*b*, and the golf club 4100*c*, the fixation of the shaft 4300 to the head 4200 is attained to such an extent that the fixation endures actual hits.

Figure 35:
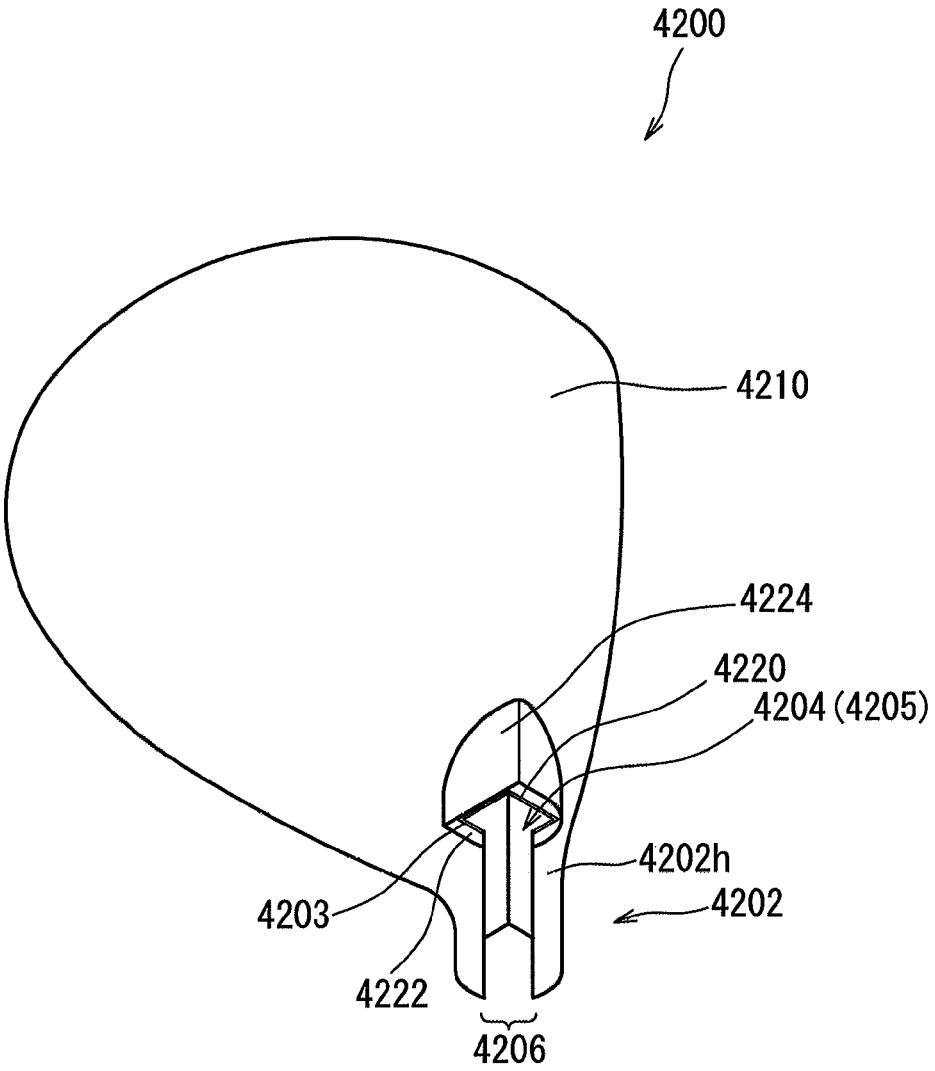
FIG. 35 is a perspective view of a head used for the golf club of FIG. 31 as viewed from the sole side.

FIG. 35 is a perspective view of the head 4200. The head 4200 includes a lower opening 4220 located at a lower end of the reverse-tapered hole 4205, an opening bottom surface 4222 that extends in the axial orthogonal direction from the lower opening 4220, and an extension surface 4224 that extends toward the sole side from the opening bottom surface 4222.

The spacers 4500, 4530 and 4560 each preferably have the divided structure. The divided structure facilitates the replacement of the spacers. Examples of the spacer having the divided structure include the above-described spacer 500 (FIG. 8) and spacer 700 (FIG. 10).

Figures 36A, 36B, 36C:
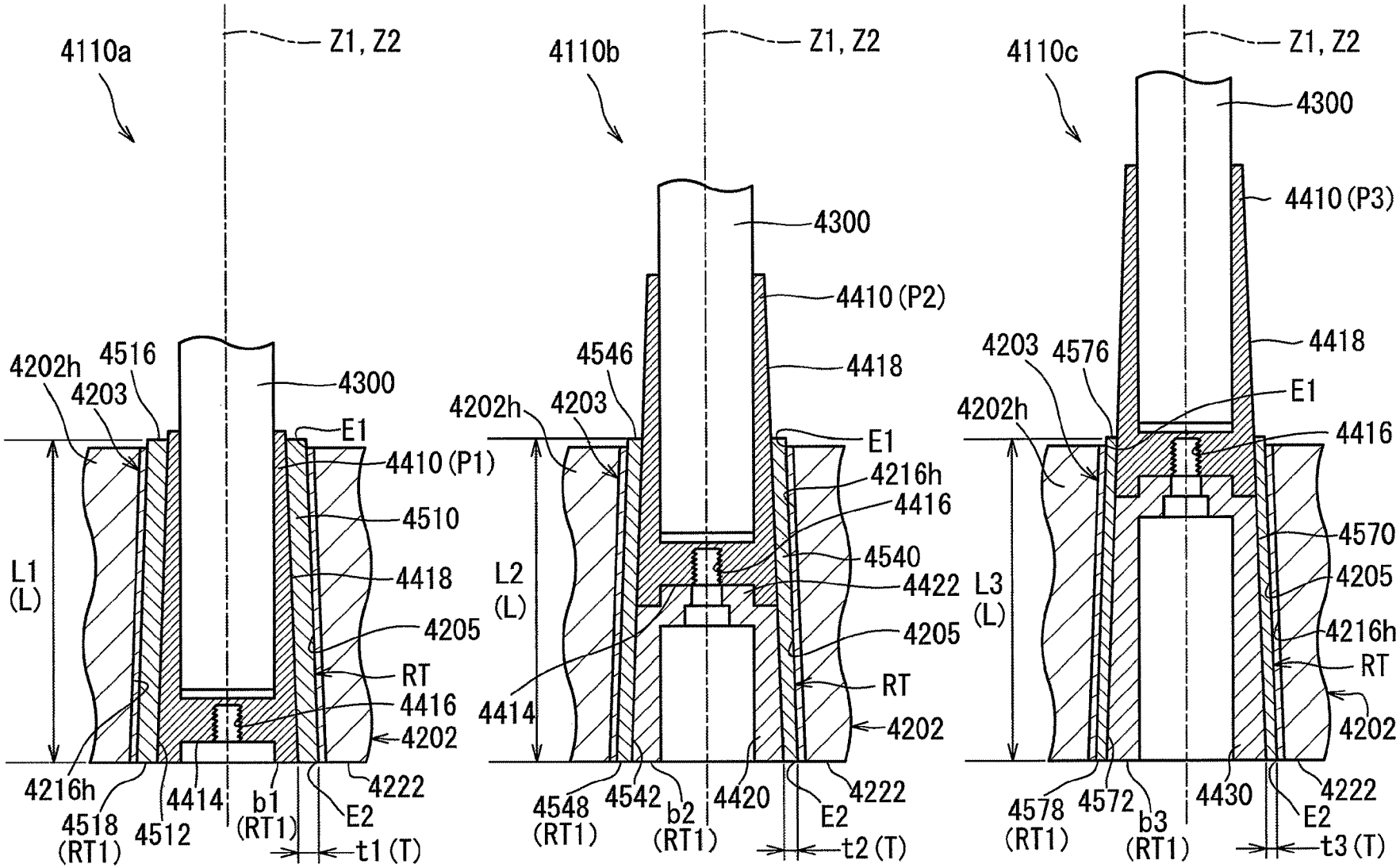
FIG. 36(*a*), FIG. 36(*b*) and FIG. 36(*c*) are axial-direction sectional views for illustrating adjustment of club length in another embodiment.
Figure 37:
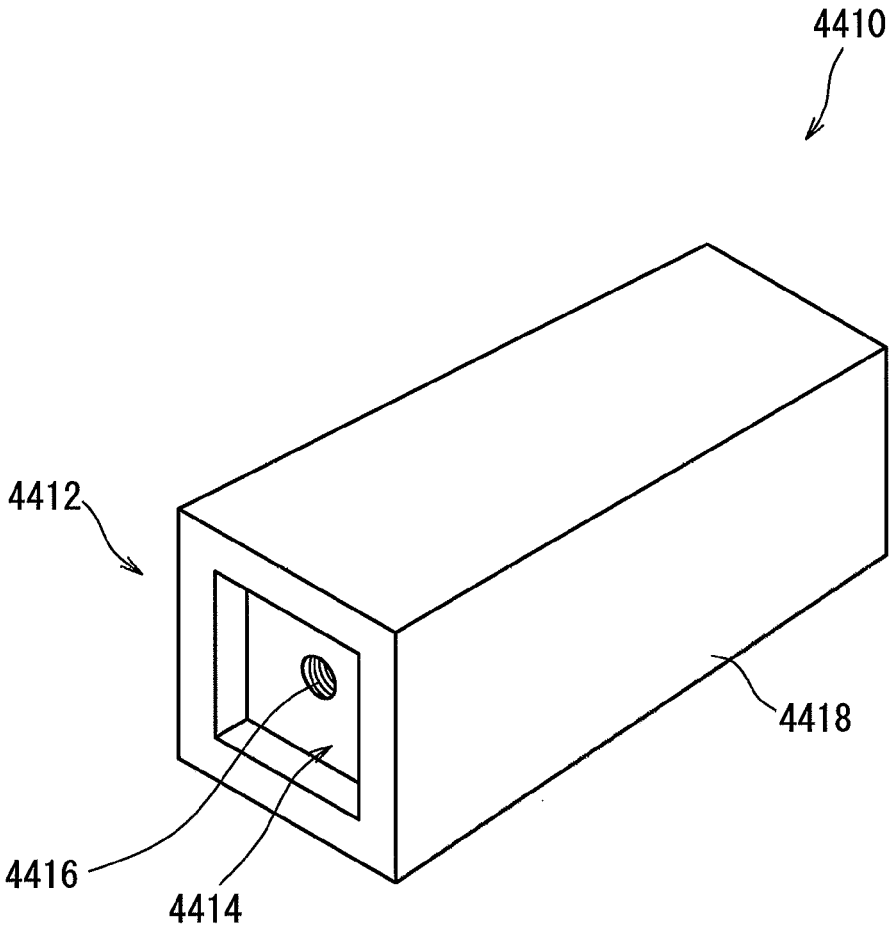
FIG. 37 is a perspective view of a sleeve used in the embodiment of FIG. 36.
Figure 38:
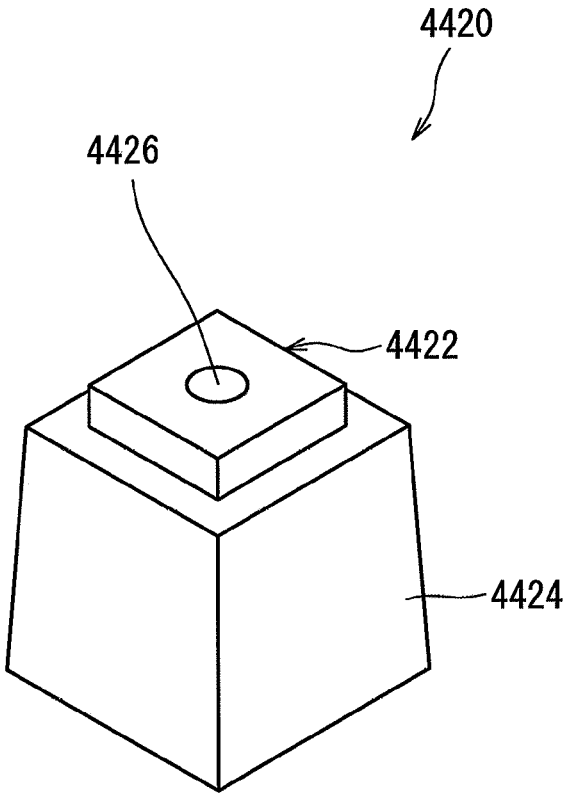
FIG. 38 is a perspective view of an extension sleeve used in the embodiment of FIG. 36.
Figure 39A:
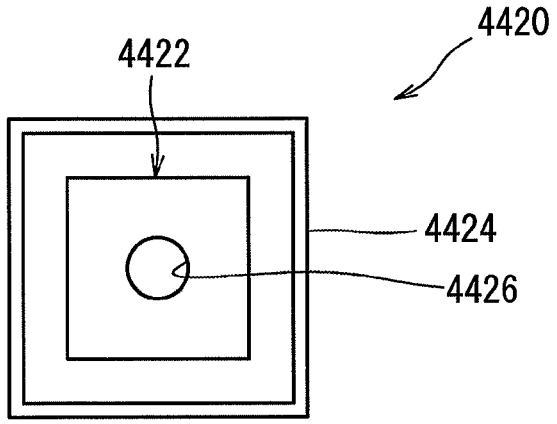
FIG. 39(*a*) is a plan view of the extension sleeve in FIG. 38, FIG. 39(*b*) is a side view of the extension sleeve in FIG. 38, and FIG. 39(*c*) is a bottom view of the extension sleeve in FIG. 38.
Figure 39B:
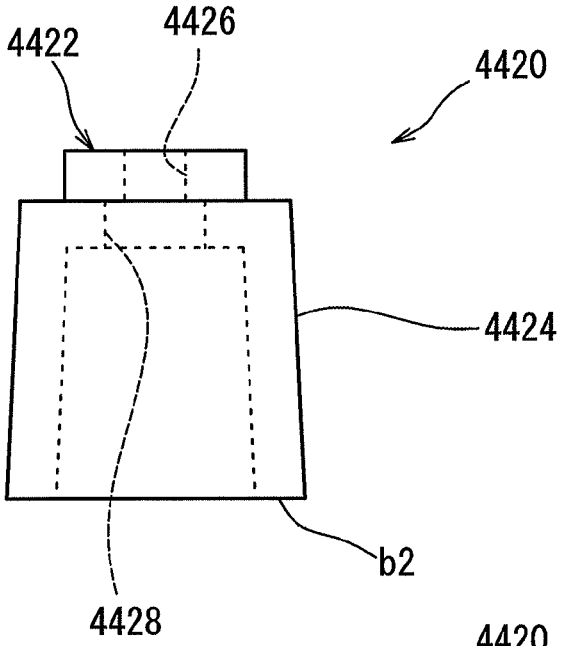
Figure 39C:
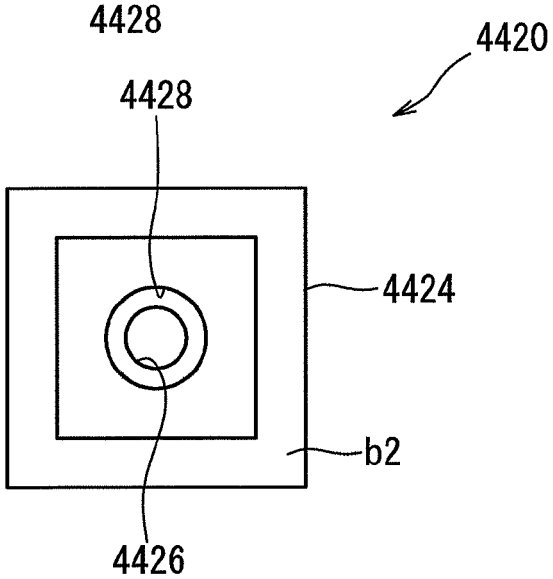

FIG. 36(*a*) to FIG. 36(*c*) are sectional views of a golf club 4110 according to another embodiment. FIG. 37 is a perspective view of a sleeve 4410 used for the golf club 4110. FIG. 38 is a perspective view of an extension sleeve 4420 used for the golf club 4110. FIG. 39(*a*) is a plan view of the extension sleeve 4420, FIG. 39(*b*) is a side view of the extension sleeve 4420, and FIG. 39(*c*) is a bottom view of the extension sleeve 4420.

The golf club 4110 in the engagement state includes one spacer and one sleeve. A golf club kit according to the golf club 4110 includes a plurality of (three) spacers. Any one of the three spacers is used. The other two are spacers for replacement.

Hereinafter, among the plurality of spacers 4510, 4540 and 4570, a case where the spacer 4510 is used is defined as a golf club 4110*a*. The golf club 4110*a* is in a state where the club length is the minimum. Among the plurality of spacers 4510, 4540 and 4570, a case where the spacer 4540 is used is defined as a golf club 4110*b*. The golf club 4110*b* is in a state where the club length is medium. Among the plurality of spacers 4510, 4540 and 4570, a case where the spacer 4570 is used is defined as a golf club 4110*c*. The golf club 4110*c* is in a state where the club length is the maximum.

FIG. 36(*a*) is a sectional view of the golf club 4110*a* taken along the axial direction. FIG. 36(*b*) is a sectional view of the golf club 4110*b* taken along the axial direction. FIG. 36(*c*) is a sectional view of the golf club 4110*c* taken along the axial direction.

As shown in FIG. 36(*a*) to FIG. 36(*c*), the spacers 4510, 4540 and 4570 are varied in wall thickness T. A wall thickness t2 of the second spacer 4540 is thinner than a wall thickness t1 of the first spacer 4510. A wall thickness t3 of the third spacer 4570 is thinner than the wall thickness t2 of the second spacer 4540.

As shown in FIG. 36(*a*) to FIG. 36(*c*), the spacers 4510, 4540 and 4570 are not varied in length L. The golf club 4110 is different in this point from the above-described golf club 4100. A length L2 of the second spacer 4540 is the same as a length L1 of the first spacer 4510. A length L3 of the third spacer 4570 is the same as the length L2 of the second spacer 4540. The spacers have the same length regardless of wall thicknesses thereof. The spacers have a same external shape regardless of wall thicknesses thereof.

In the engagement state, the axial-direction positions of the sleeve 4410 with respect to the respective spacers varies from each other. The axial-direction position of the sleeve 4410 which is engaged with the first spacer 4510 is defined as P1, the axial-direction position of the sleeve 4410 which is engaged with the second spacer 4540 is defined as P2, and the axial-direction position of the sleeve 4410 which is engaged with the third spacer 4570 is defined as P3. As shown in FIG. 36(*a*) to FIG. 36(*c*), the axial-direction position P2 is located on an upper side relative to the axial-direction position P1. The axial-direction position P3 is located on an upper side relative to the axial-direction position P2.

Because of the variations of the axial-direction positions, club length is varied. The golf club 4110*b* is longer than the golf club 4110*a*. The golf club 4110*c* is longer than the golf club 4110*b*.

Thus, in the golf club 4110, the club length is changed by changing wall thicknesses T of the spacers 4510, 4540 and 4570.

The golf club kit according to the golf club 4110 includes two extension sleeves 4420 and 4430. That is, the golf club kit according to the golf club 4110 includes the two extension sleeves 4420 and 4430 in addition to the three spacers 4510, 4540 and 4570. Any one of the extension sleeves is used as necessary.

As shown in FIG. 36(*b*), the first extension sleeve 4420 is used for the golf club 4110*b* having a club length of medium. The extension sleeve 4420 is used together with the second spacer 4540. The extension sleeve 4420, together with the sleeve 4410, is fitted inside the spacer 4540. As a result, in the golf club 4110*b*, the tip engagement part is constituted by the sleeve 4410, the extension sleeve 4420, and the spacer 4540. Any extension sleeve is not used in the golf club 4110*a* having a club length of the minimum.

As shown in FIG. 36(*c*), the second extension sleeve 4430 is used for the golf club 4110*c* having a club length of the maximum. The extension sleeve 4430 is longer than the extension sleeve 4420. The extension sleeve 4430 is used together with the third spacer 4570. The extension sleeve 4430, together with the sleeve 4410, is fitted inside the spacer 4570. As a result, in the golf club 4110*c*, the tip engagement part is constituted by the sleeve 4410, the extension sleeve 4430, and the spacer 4570.

After all, in the golf club 4110, three sorts of spacers and two sorts of extension sleeves are used. The golf club kit according to the golf club 4110 includes the plurality (three sorts) of spacers and the plurality (two sorts) of extension sleeves.

As shown in FIG. 37, the sleeve 4410 includes a bottom part 4412. The bottom part 4412 includes an engaging recessed part 4414 and a screw hole 4416. The engaging recessed part 4414 is provided at a center of the bottom part 4412. The engaging recessed part 4414 has a sectional shape of a non-circle (a tetragon, a square). The screw hole 4416 is provided at a center of the engaging recessed part 4414. The sleeve 4410 further includes a side surface 4418. The side surface 4418 is a pyramid surface (four-sided pyramid surface).

As shown in FIG. 38 and FIG. 39(*a*) to FIG. 39(*c*), the extension sleeve 4420 includes an engaging projection part 4422 and a side surface 4424. The engaging projection part 4422 is provided on an upper surface of the extension sleeve 4420. The engaging projection part 4422 is upwardly projected. The engaging projection part 4422 has a sectional shape of a non-circle (a tetragon, a square). A through hole 4426 is provided at a center of the engaging projection part 4422.

As shown in FIG. 39 (*b*), the inside of the extension sleeve 4420 is hollow. The hollow is downwardly opened. A screw-housing hole 4428 is provided on an upper part of an inner surface of the extension sleeve 4420. The screw-housing hole 4428 is disposed so as to be continuous with the through hole 4426. The through hole 4426 and the screw-housing hole 4428 are coaxially disposed. As shown in FIG. 39(*c*), an inner diameter of the screw-housing hole 4428 is larger than an inner diameter of the through hole 4426. A head part of a screw (not shown in the drawing) is housed in the screw-housing hole 4428.

As shown in FIG. 36(*b*), the extension sleeve 4420 is connected to the lower side of the sleeve 4410. In the connected state, the engaging projection part 4422 is engaged with the engaging recessed part 4414. The engaging projection part 4422 is fitted to the engaging recessed part 4414.

Although not shown in the drawings, the extension sleeve 4420 is fixed to the sleeve 4410 by a connection mechanism. In the present embodiment, the connection mechanism is a screw mechanism. The screw, which is not shown in the drawings, is inserted into the extension sleeve 4420 from the lower side thereof, penetrates through the screw-housing hole 4428 and the through hole 4426, and is screwed to the screw hole 4416. By the screwing, the extension sleeve 4420 is fixed to the sleeve 4410 to complete a connected state.

As described above, in the connected state, the engaging projection part 4422 is fitted to the engaging recessed part 4414. The engaging projection part 4422 has an external shape corresponding to a shape of the engaging recessed part 4414. In the connected state in which the engaging projection part 4422 is fitted to the engaging recessed part 4414, the position of the extension sleeve 4420 is determined with respect to the sleeve 4410. Because of the engagement of the engaging projection part 4422 and the engaging recessed part 4414, the extension sleeve 4420 cannot be rotated with respect to the sleeve 4410 in the connected state.

In the connected state, the side surface 4418 of the sleeve 4410 is flush with the side surface 4424 of the extension sleeve 4420. That is, faces of the side surface 4418 are flush with respective faces of the side surface 4424. As a result, a connected sleeve, an outer surface of which is a reverse-tapered surface (pyramid surface), is formed by the connected state in which the sleeve 4410 is connected to the extension sleeve 4420. The connected sleeve is fitted inside the spacer 4540 (FIG. 36 (*b*)). In this case, the outer surface of the spacer 4540 is the outer surface of the tip engagement part RT.

As described above, the extension sleeve 4430 is used for the golf club 4110*c* in which club length is the maximum. Except for the difference in length, the extension sleeve 4430 has the same shape as the shape of the extension sleeve 4420. In accordance with the fact that the position P3 of the sleeve 4410 is located above relative to the position P2, the extension sleeve 4430 is made longer than the extension sleeve 4420. A connection mechanism of the extension sleeve 4430 to the sleeve 4410 is the same as that of the extension sleeve 4420 (see FIG. 36(*c*)).

In the golf club 4110*a* in the engagement state, a lower end surface b1 of the sleeve 4410 is exposed to the outside (see FIG. 36(*a*)). In the golf club 4110*b* in the engagement state, a lower end surface b2 of the extension sleeve 4420 is exposed to the outside (see FIG. 36(*b*)). In the golf club 4110*c* in the engagement state, a lower end surface b3 of the extension sleeve 4430 is exposed to the outside (see FIG. 36(*c*)). In the engagement state, the axial-direction position of the lower end surface b1 is the same as the axial-direction position of the lower end surface b2. In the engagement state, the axial-direction position of the lower end surface b2 is the same as the axial-direction position of the lower end surface b3.

In the golf club 4110*b*, the sleeve 4410 is upwardly shifted as compared with the golf club 4110*a*. Because of the shift, in the golf club 4110*b*, a contact area of the sleeve 4410 and the spacer 4540 is decreased. However, the connected sleeve in which the extension sleeve 4420 is connected to the sleeve 4410 is formed in the golf club 4110*b*. Considering the whole connected sleeve, the contact area with the spacer 4540 is maintained. As a result, the sleeve 4410 is securely held also in the golf club 4110*b*.

In the golf club 4110*c*, the sleeve 4410 is upwardly shifted as compared with the golf club 4110*b*. Because of the shift, a contact area of the sleeve 4410 and the spacer 4570 is further decreased in the golf club 4110*c*. However, in the golf club 4110*c*, the connected sleeve in which the extension sleeve 4430 is connected to the sleeve 4410 is formed. Considering the whole connected sleeve, the contact area with the spacer 4570 is maintained. As a result, the sleeve 4410 is securely held also in the golf club 4110*c*.

As shown in FIG. 36(*a*) to FIG. 36(*c*), the first spacer 4510 has an upper end surface 4516 and a lower end surface 4518. The second spacer 4540 has an upper end surface 4546 and a lower end surface 4548. The third spacer 4570 has an upper end surface 4576 and a lower end surface 4578.

As shown in FIG. 36(*a*) to FIG. 36 (*c*), in the golf clubs 4110*a*, 4110*b*, and 4110*c*, the axial-direction positions of the lower end surfaces 4518, 4548 and 4578 of the respective spacers are the same. In the golf clubs 4110*a*, 4110*b* and 4110*c*, the axial-direction positions of the lower end surfaces b1, b2, and b3 are the same. The axial-direction positions of the lower end surfaces 4518, 4548 and 4578 of the respective spacers coincide with the respective axial-direction positions of the lower end surfaces b1, b2, and b3. In the golf club 4110, the axial-direction position of the lower end surface RT1 of the tip engagement part RT is the same regardless of club length.

As well shown in FIG. 34(*a*) to FIG. 34(*c*) and FIG. 36(*a*) to FIG. 36 (*c*), the hosel part 4202 includes a hosel body 4202*h* and a resin part 4203. The hosel body 4202*h* is made of a metal. The resin part 4203 is made of a resin. The hosel body 4202*h* includes a body hole 4216*h*. The body hole 4216*h* is a reverse-tapered hole. The body hole 4216*h* is formed by a metal. The resin part 4203 is fixed inside the body hole 4216*h*. The resin part 4203 is adhered to the inside of the body hole 4216*h* by an adhesive.

The shape of the outer surface of the resin part 4203 corresponds to the shape of the body hole 4216*h*. The inner surface of the resin part 4203 constitutes the hosel hole 4204. The whole hosel hole 4204 is formed by the resin part 4203. The whole inner surface of the hosel hole 4204 is formed by the resin.

As shown in FIG. 34 (*a*) to FIG. 34 (*c*) and FIG. 36 (*a*) to FIG. 36(*c*), an upper end edge E1 of the hosel hole 4204 is formed by the resin part 4203. The upper end edge E1 is formed by the resin. A lower end edge E2 of the hosel hole 4204 is formed by the resin part 4203. The lower end edge E2 is formed by the resin.

Figure 40:
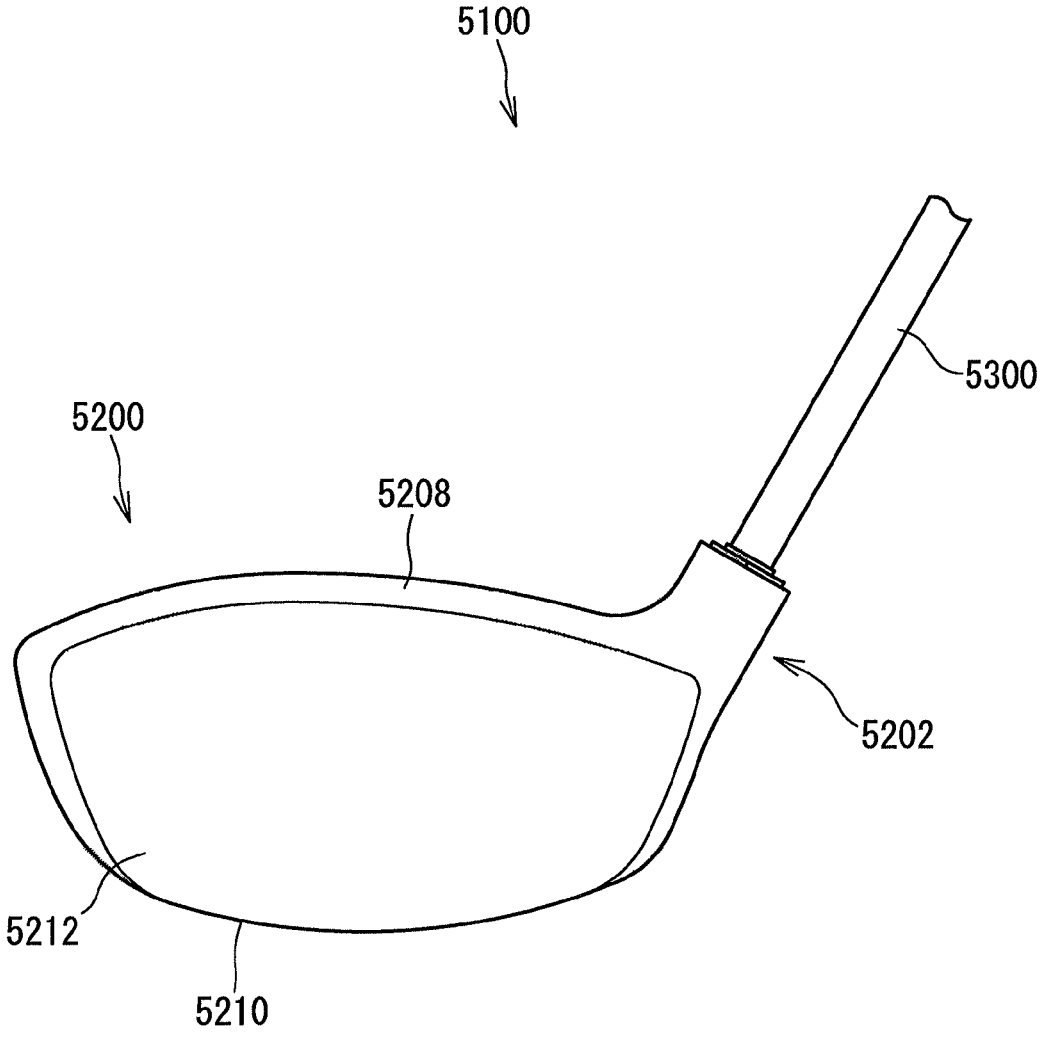
FIG. 40 shows a golf club according to another embodiment.
Figure 41:
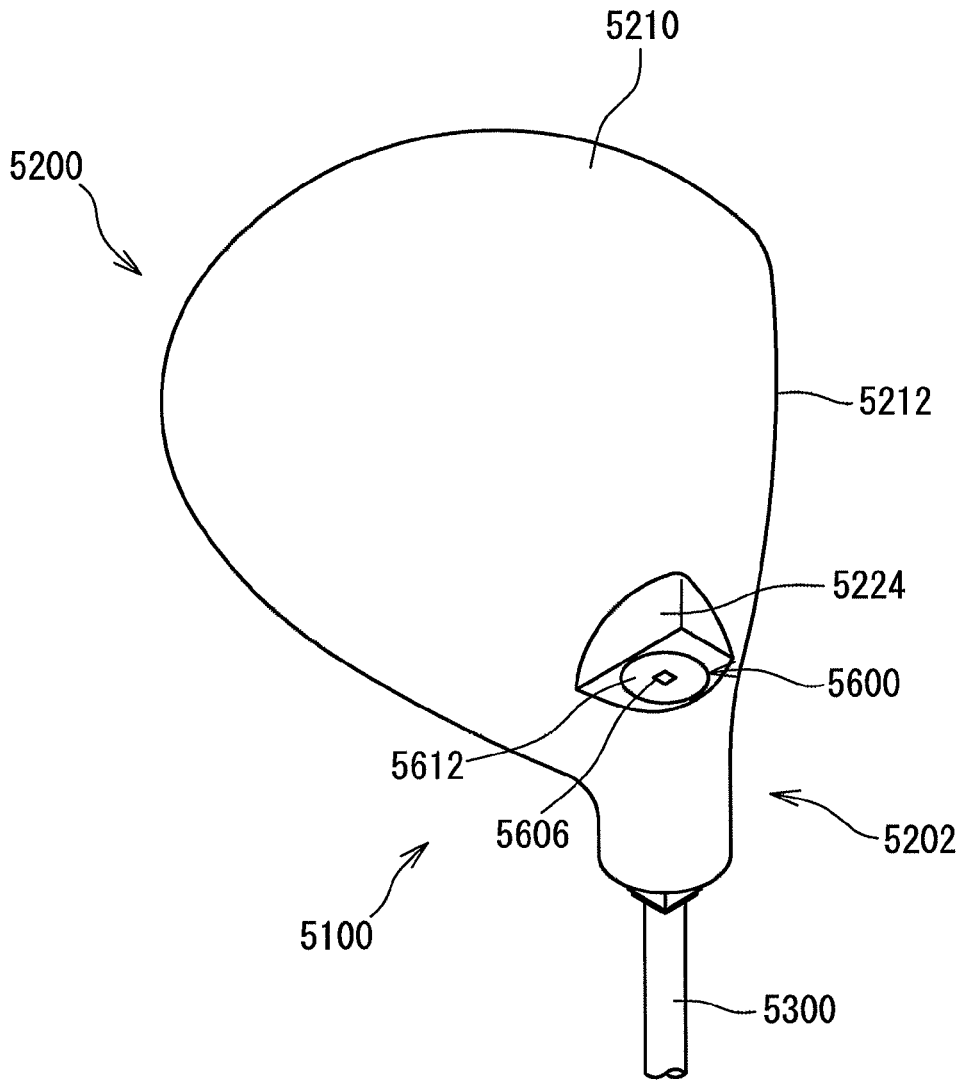
FIG. 41 is a perspective view of the golf club in FIG. 40 as viewed from the sole side.
Figure 42:
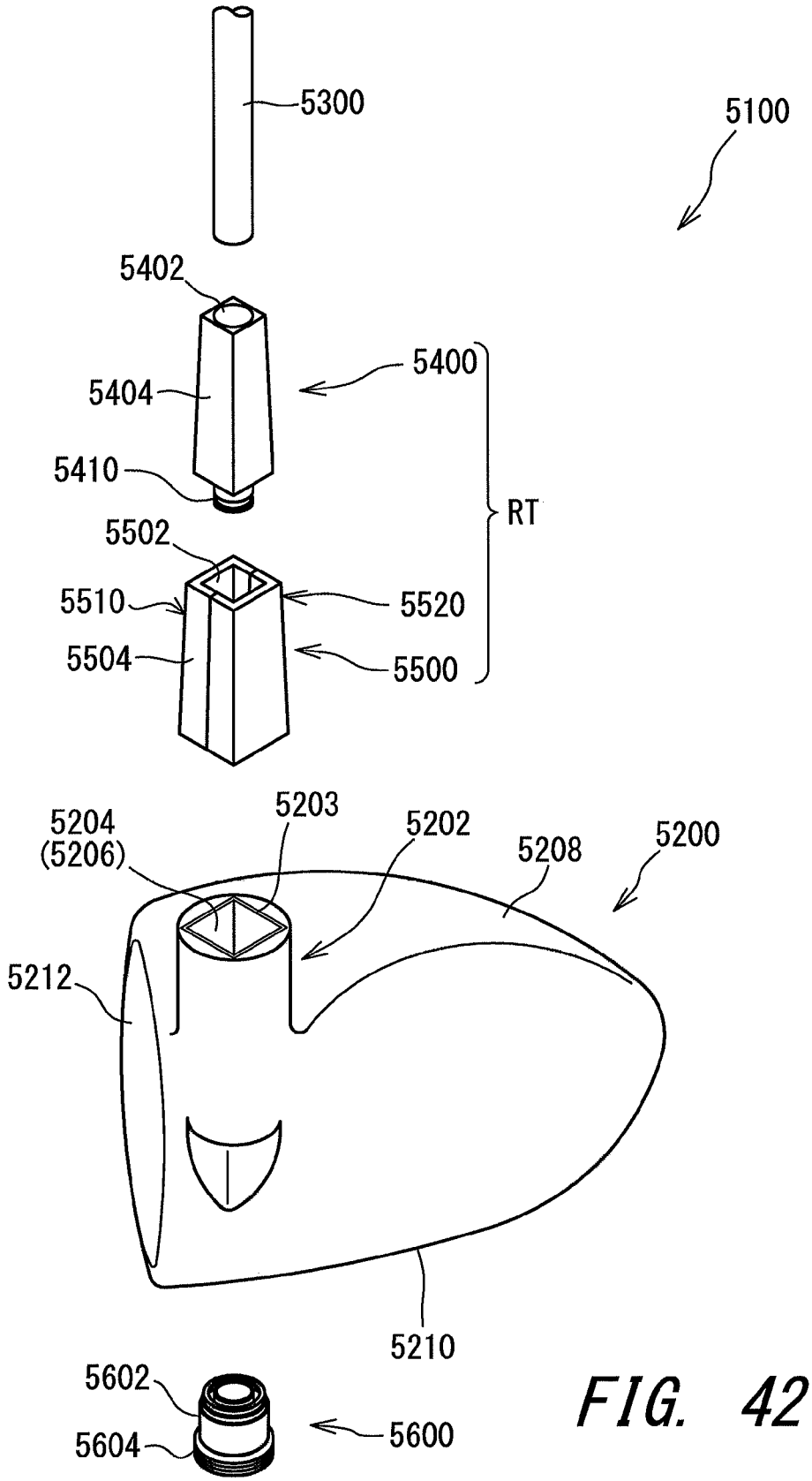
FIG. 42 is an exploded view of the golf club in FIG. 40.

FIG. 40 shows a golf club 5100 according to another embodiment. FIG. 41 is a perspective view of the golf club 5100 as viewed from the sole side. FIG. 42 is an exploded perspective view of the golf club 5100.

The golf club 5100 includes a head 5200, a shaft 5300, a sleeve 5400, a spacer 5500, and a grip (not shown in the drawings). The sleeve 5400 and the spacer 5500 constitute a tip engagement part RT. The tip engagement part RT is disposed at a tip end portion of the shaft 5300. An outer surface of the tip engagement part RT is formed by the spacer 5500.

The head 5200 includes a crown 5208, a sole 5210, and a face 5212. The head 5200 further includes a hosel part 5202. The hosel part 5202 includes a hosel hole 5204. The hosel hole 5204 includes a reverse-tapered hole 5206. The shape of the reverse-tapered hole 5206 corresponds to the shape of the outer surface of the tip engagement part RT. The shape of the reverse-tapered hole 5206 corresponds to the shape of the outer surface of the spacer 5500.

The hosel part 5202 (reverse-tapered hole 5206) exists over the whole circumferential direction. The hosel part 5202 (reverse-tapered hole 5206) is continuous without a gap in the whole circumferential direction. The hosel part 5202 is not split in the circumferential direction. The hosel part 5202 does not have a hosel slit formed such that a part of the hosel part in the circumferential direction is lacking.

As shown in FIG. 42, the sleeve 5400 includes an inner surface 5402 and an outer surface 5404. The inner surface 5402 forms a shaft hole. The sectional shape of the inner surface 5402 is a circle. The shape of the inner surface 5402 corresponds to the shape of an outer surface of the shaft 5300. The inner surface 5402 is fixed to the tip end portion of the shaft 5300. That is, the sleeve 5400 is fixed to the tip end portion of the shaft 5300.

The outer surface 5404 is a pyramid surface. The outer surface 5404 is a four-sided pyramid surface. The sectional shape of the outer surface 5404 is a non-circle. The sectional shape of the outer surface 5404 is a polygon (regular polygon). The sectional shape of the outer surface 5404 is a tetragon. The sectional shape of the outer surface 5404 is a square.

Figure 44:
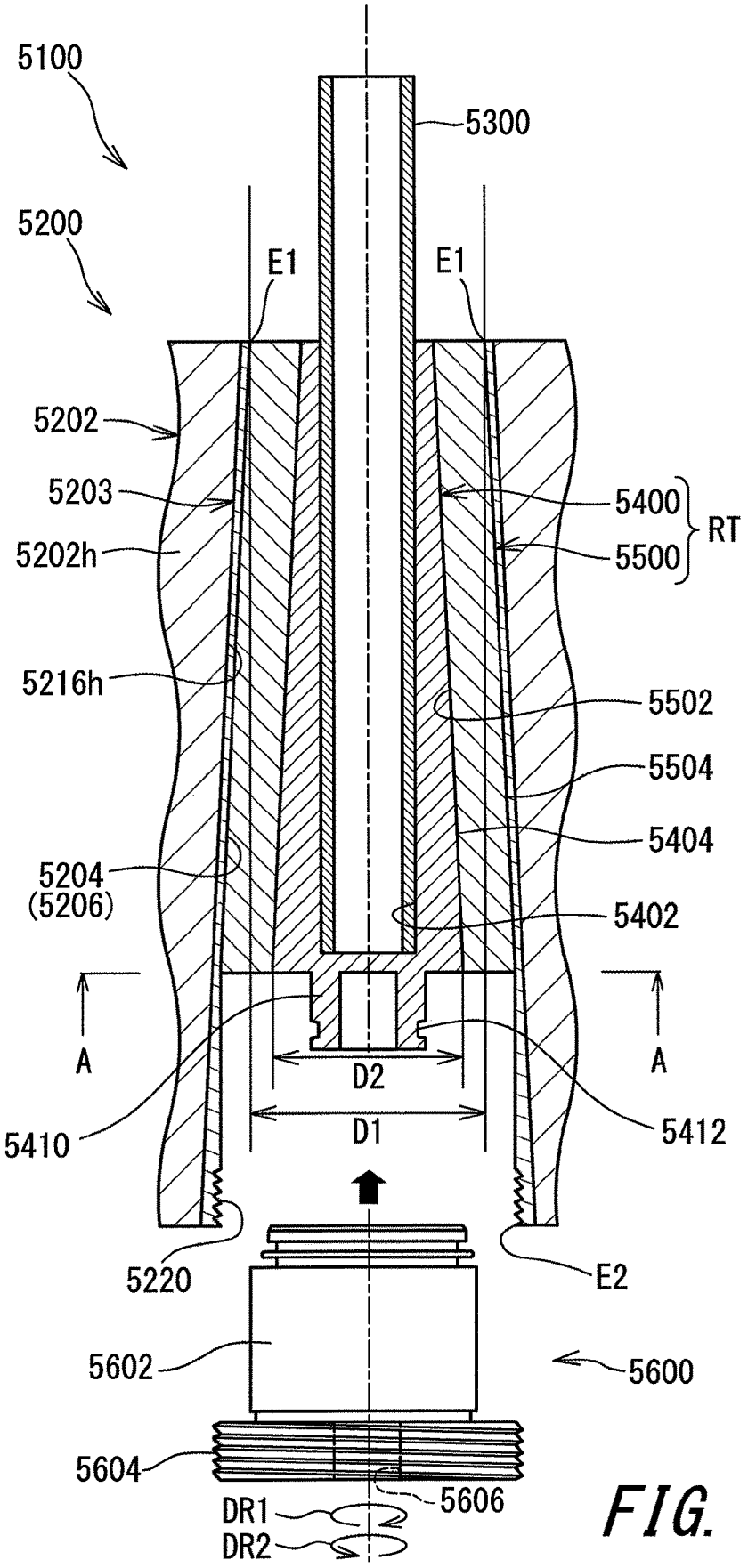
FIG. 44 is a sectional view of the golf club in FIG. 40 to which a screw member has not yet attached.

The sleeve 5400 includes a sleeve-side connection part 5410. The sleeve-side connection part 5410 is provided at a tip end portion (lower end portion) of the sleeve 5400. The sleeve-side connection part 5410 has a cylindrical shape as a whole. As shown in FIG. 44 described later, the sleeve-side connection part 5410 includes an engagement recess 5412. The engagement recess 5412 is provided on an outer circumferential surface of the sleeve-side connection part 5410. The engagement recess 5412 is a circumferential groove.

As shown in FIG. 42, the spacer 5500 has an inner surface 5502 and an outer surface 5504. The inner surface 5502 forms a sleeve hole. The sectional shape of the inner surface 5502 corresponds to the sectional shape of the outer surface 5404 of the sleeve 5400. The outer surface 5404 of the sleeve 5400 is fitted to the inner surface 5502.

The shape of the inner surface 5502 corresponds to the shape of the outer surface 5404 of the sleeve 5400. The inner surface 5502 is a pyramid surface. The inner surface 5502 is a four-sided pyramid surface. The sectional shape of the inner surface 5502 is a non-circle. The sectional shape of the inner surface 5502 is a polygon (regular polygon). The sectional shape of the inner surface 5502 is a tetragon. The sectional shape of the inner surface 5502 is a square.

The shape of the outer surface 5504 (outer surface of the tip engagement part RT) corresponds to the shape of the reverse-tapered hole 5206. The outer surface 5504 is a pyramid surface. The outer surface 5504 is a four-sided pyramid surface. The sectional shape of the outer surface 5504 is a non-circle. The sectional shape of the outer surface 5504 is a polygon (regular polygon). The sectional shape of the outer surface 5504 is a tetragon. The sectional shape of the outer surface 5504 is a square.

The golf club 5100 includes a screw member 5600. The screw member 5600 includes a screw-side connection part 5602 and a male screw part 5604. The screw-side connection part 5602 is positioned on the sleeve side (upper side) of the male screw part 5604. The male screw part 5604 constitutes a rear end portion (lower end portion) of the screw member 5600. The screw-side connection part 5602 can be detachably connected to the sleeve-side connection part 5410. As a result, the screw member 5600 can be detachably connected to the sleeve 5400. The connection between the sleeve 5400 and the screw member 5600 can be easily made. The connection can be achieved by simply pressing the screw member 5600 against the sleeve 5400. In other words, the screw member 5600 can be connected to the sleeve 5400 by a one-touch operation. The connection is automatically completed by simply inserting the sleeve-side connection part 5410 to the screw-side connection part 5602. In addition, the connection can be easily released. The screw member 5600 can also be easily removed from the sleeve 5400. The details of the connecting mechanism between the sleeve 5400 and the screw member 5600 will be described later.

Figure 43:
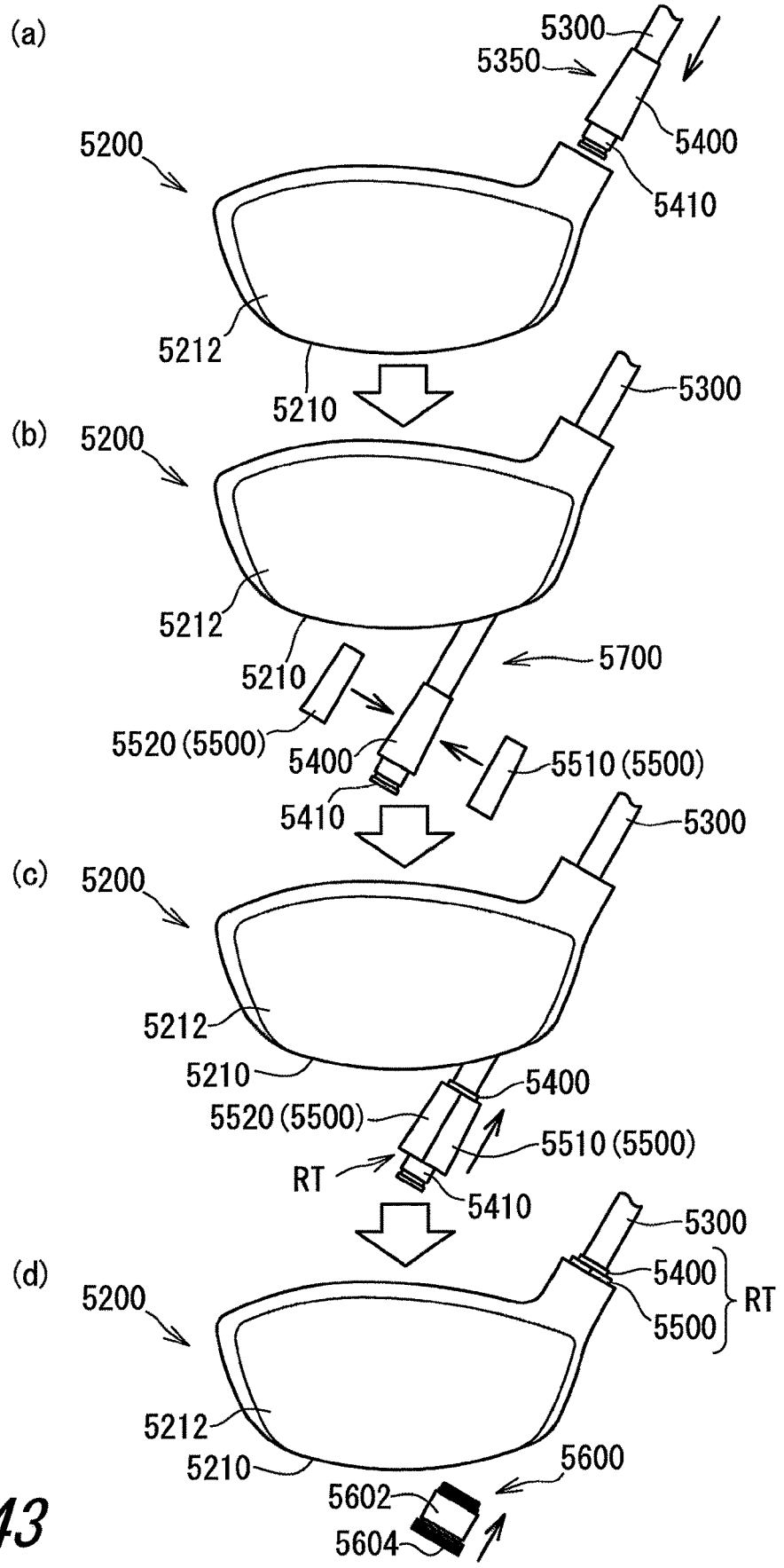
FIG. 43 is a process view showing a process of attaching a shaft in the golf club of FIG. 40.

FIG. 43 shows a procedure of mounting the shaft 5300 to the head 5200.

In the mounting procedure, a sleeve-attached shaft 5350 is first prepared (step (a) in FIG. 43). The sleeve-attached shaft 5350 includes a shaft 5300 and a sleeve 5400. In the sleeve-attached shaft 5350, the sleeve 5400 is fixed (adhered) to the tip end portion of the shaft 5300.

Next, the sleeve 5400 of the sleeve-attached shaft 5350 is made to pass through the hosel hole 5204 (step (b) in FIG. 43). The sleeve 5400 is made to completely pass through the hosel hole 5204. The sleeve 5400 is inserted to the hosel hole 5204 from the upper side and is made to come out from the lower side of the hosel hole 5204. The sleeve 5400 is moved to a lower side of the sole 5210 by the passing (step (b) in FIG. 43).

Next, the spacer 5500 is attached to the sleeve 5400 (step (b) in FIG. 43). The spacer 5500 is attached to the sleeve 5400 in a state where the sleeve 5400 has passed through the hosel hole 5204. The spacer 5500 is externally attached to the sleeve 5400. The spacer 5500 is attached to externally cover the sleeve 5400. The tip engagement part RT is completed by attaching the spacer 5500 to the sleeve 5400. The spacer 5500 has the divided structure. Examples of the divided structure include the structures of the above-described spacer 500 (FIG. 8) and spacer 700 (FIG. 10).

Next, the sleeve-attached shaft 5350 is moved to the upper side with respect to the head 5200, whereby the tip engagement part RT (spacer 5500) is fitted to the reverse-tapered hole 5206 (step (c) in FIG. 43). As a result, the shaft 5300 is attached to the head 5200. The mounting of the shaft 5300 to the head 5200 is achieved by the fitting. An engagement state is achieved by the fitting.

Next, the screw member 5600 is attached to the head 5200 (step (d) in FIG. 43). The screw member 5600 is attached to the head 5200 from the lower side. The screw member 5600 is rotated in a first direction, and is screwed into a female screw part of the head 5200. For the rotation, a tool such as a wrench may be used. The first direction is a direction in which the screw member 5600 is fastened. As the screw-connection progresses, the screw member 5600 is moved to a direction (the upper side) approaching the hosel hole 5204. With this movement, the screw member 5600 presses the tip engagement part RT in the engaging direction (to the upper side). The pressing ensures the above-described engagement state. The pressing makes it possible to eliminate backlash.

The screw member 5600 includes a rotating engagement part 5606 for engaging the tool (see FIG. 41). The rotating engagement part 5606 is a non-circular hole.

As described above, the screw member 5600 presses the tip engagement part RT. Simultaneously with the pressing, the screw member 5600 is connected to the sleeve 5400. When the screw member 5600 is moved toward the tip engagement part RT, the sleeve-side connection part 5410 is inserted to the screw-side connection part 5602 of the screw member 5600. By this insertion, the sleeve-side connection part 5410 is automatically connected to the screw-side connection part 5602. As a result, the sleeve 5400 is connected to the screw member 5600.

The connection between the sleeve 5400 and the screw member 5600 facilitates the removal of the shaft 5300. To detach the shaft 5300 from the head 5200, the above-described procedure is performed in the reverse order. In the reverse procedure, first, the screw member 5600 is rotated in a second direction. The second direction is a direction opposite to the first direction. The second direction is a direction in which the screw member 5600 is loosened. By this rotation, the screw member 5600 is moved to the lower side. The screw member 5600 is moved in a direction away from the hosel hole 5204. At this time, the connection between the sleeve 5400 and the screw member 5600 is maintained. While maintaining the connection between the sleeve 5400 and the screw member 5600, the screw member 5600 is rotated in the second direction. By this movement, the screw member 5600 pulls the tip engagement part RT in the engagement releasing direction. The tip engagement part RT is pulled out from the hosel hole 5204 by the screw member 5600.

FIG. 44 is a sectional view of the golf club 5100 taken along the axial direction. FIG. 44 is an enlarged sectional view of the vicinity of the tip engagement part RT.

As shown in FIG. 44, the head 5200 includes a female screw part 5220. The female screw part 5220 is coaxial with the reverse-tapered hole 5206. The male screw part 5604 of the screw member 5600 is screw-connected to the female screw part 5220. The details of the screw-connection will be described later.

As described above, in order to press the sleeve 5400 in the engaging direction by the screw member 5600, the screw member 5600 is rotated in a first direction DR1, whereby the screw member 5600 is screwed into the female screw part 5220 (see FIG. 44). In contrast, in order to pull the sleeve 5400 in the engagement releasing direction by the screw member 5600, the screw member 5600 is rotated in a second direction DR2.

A double-pointed arrow D1 in FIG. 44 shows the minimum width of the hosel hole 5204. In the present embodiment, the sectional shape of the hosel hole 5204 is a square, and the minimum width D1 is the length of one side of the square at the upper end of the hosel hole 5204.

A double-pointed arrow D2 in FIG. 44 shows the maximum width of the sleeve 5400. In the present embodiment, the sectional shape of the outer surface 5404 of the sleeve 5400 is a square, and the maximum width D2 is the length of one side of the square at the lower end surface of the sleeve 5400.

In the present embodiment, the minimum width D1 is larger than the maximum width D2. In other words, the minimum value of the sectional area of the hosel hole 5204 is larger than the maximum value of the sectional area of the sleeve 5400. The lower end of the sleeve 5400 can pass through an opening of the upper end of the hosel hole 5204. As a result, the sleeve 5400 can pass through the hosel hole 5204.

As well shown in FIG. 44, the hosel part 5202 includes a hosel body 5202*h* and a resin part 5203. The hosel body 5202*h* is made of a metal. The resin part 5203 is made of a resin. The hosel body 5202*h* includes a body hole 5216*h*. The body hole 5216*h* is a reverse-tapered hole. The body hole 5216*h* is formed by a metal. The resin part 5203 is fixed inside the body hole 5216*h*. The resin part 5203 is adhered to the inside of the body hole 5216*h* by an adhesive. The resin part 5203 forms a resin layer on the inner surface of the body hole 5216*h*.

The shape of the outer surface of the resin part 5203 corresponds to the shape of the body hole 5216*h*. The inner surface of the resin part 5203 constitutes the hosel hole 5204. The whole hosel hole 5204 is formed by the resin part 5203. The whole inner surface of the hosel hole 5204 is formed by the resin. The resin part 5203 forms the hosel hole 5204 from its upper end through its lower end. The female screw part 5220 is formed on the resin part 5203.

As shown in FIG. 44, an upper end edge E1 of the hosel hole 5204 is formed by the resin part 5203. The upper end edge E1 is formed by the resin. A lower end edge E2 of the hosel hole 5204 is formed by the resin part 4203. The lower end edge E2 is formed by the resin.

In the present embodiment, when the male screw part 5604 is rotated in the first direction with respect to the female screw part 5220, the screw member 5600 presses the tip engagement part RT in the engaging direction. In addition, when the male screw part 5604 is rotated in the second direction with respect to the female screw part 5220 while maintaining connection between the sleeve-side connection part 5410 and the screw-side connection part 5602, the screw member 5600 pulls the tip engagement part RT in the engagement releasing direction. Furthermore, by the rotation in the first direction, the screw member 5600 presses the tip engagement part RT in the engaging direction, and the sleeve-side connection part 5410 is inserted to the screw-side connection part 5602, whereby the connection is automatically completed.

Figure 45:
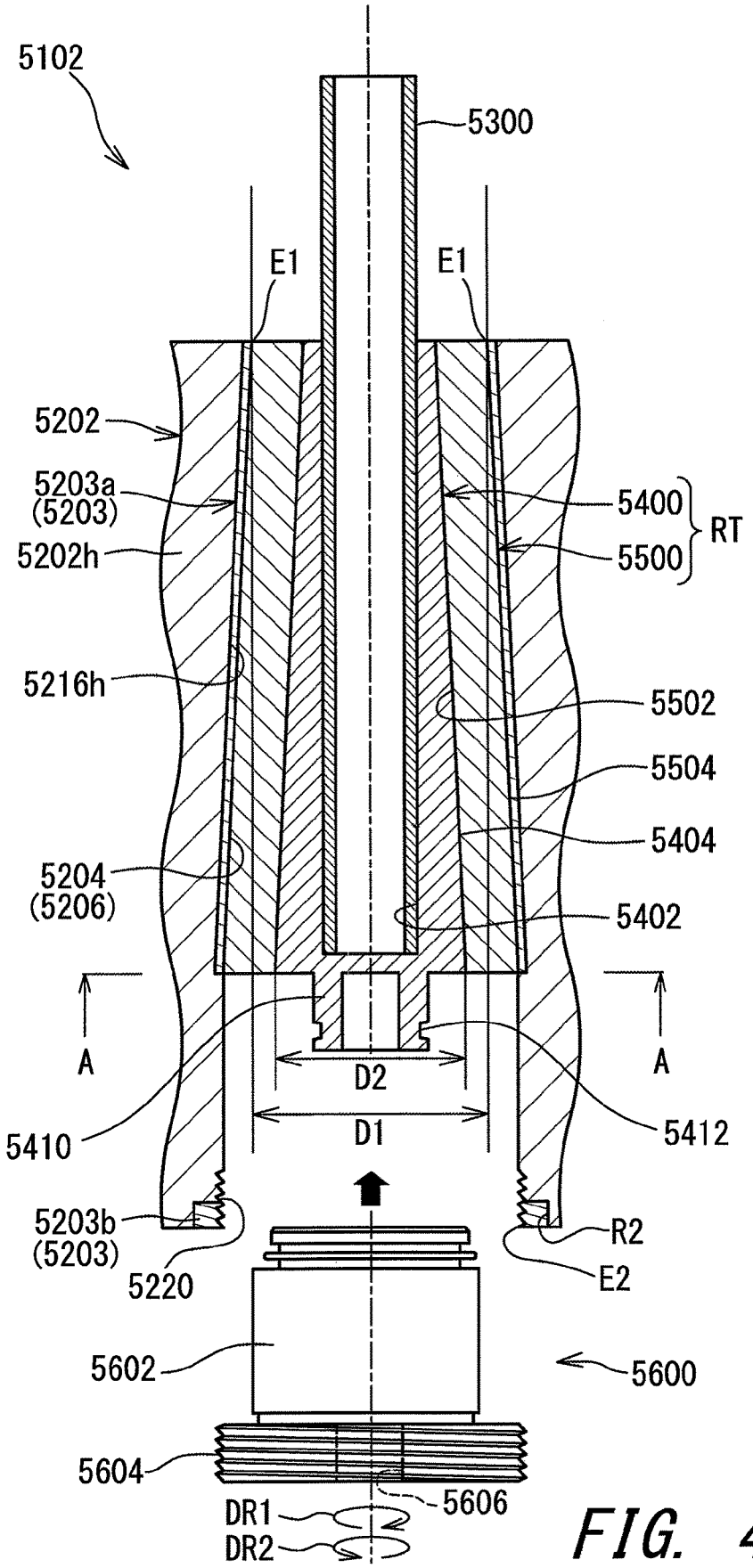
FIG. 45 is a sectional view of a modification example of the golf club according to FIG. 44.

FIG. 45 is a sectional view of a golf club 5102 according to a modification example of the embodiment of FIG. 44.

In the present embodiment, the resin part 5203 includes an upper resin part 5203*a* and a lower resin part 5203*b*. The upper resin part 5203*a* forms the whole reverse-tapered hole 5206 in the hosel hole 5204. The upper resin part 5203*a* forms the whole of a portion that is brought into contact with the tip engagement part RT in the engagement state. The lower resin part 5203*b* is disposed on the lower end of the hosel hole 5204. The lower resin part 5203*b* is fixed to a lower end recess R2 formed on the lower end of the hosel hole 5204. The lower resin part 5203*b* forms a part of the female screw part 5220. Except the above-described constitutions, the golf club 5102 is the same as the golf club 5100 (FIG. 44). The upper end edge E1 and the lower end edge E2 are formed by the resin also in the golf club 5102 according to the present embodiment.

Figure 46:
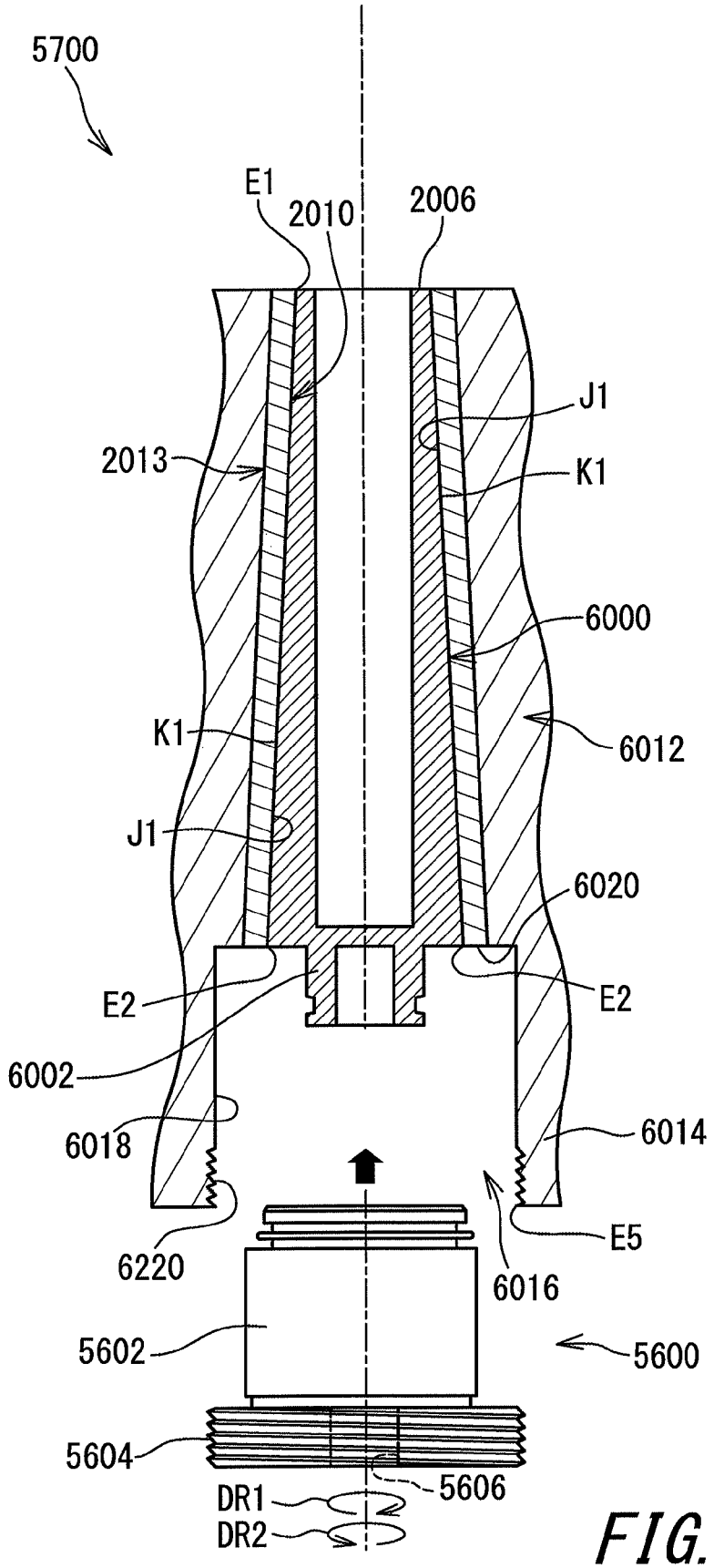
FIG. 46 is a sectional view of another modification example.

FIG. 46 is a sectional view of a golf club 5700 according to another embodiment. The golf club 5700 is a modification example of the golf club (FIG. 15 to FIG. 20) including the sleeve 2000. In the present embodiment, a sleeve 6000 in which a sleeve-side connection part is added to the sleeve 2000 is used. Furthermore, in the present embodiment, a lower extension part 6014 is added to a hosel part 6012. The lower extension part 6014 is located on the lower side of the hosel hole 2010. A female screw part 6220 is formed on the lower extension part 6014. The present embodiment is configured such that the screw member 5600 which is screw-connected to the female screw part 6220 can be connected to a sleeve-side connection part 6002. The function of the screw member 5600 is the same as those of embodiments in FIG. 44 and FIG. 45. Except these constitutions, the present embodiment is the same as the embodiments shown in FIG. 15 to FIG. 20.

The upper end edge E1 of the hosel hole 2010 is formed by the resin part 2013. The lower end edge E2 of the hosel hole 2010 is formed by the resin part 2013. The upper end edge E1 and the lower end edge E2 are formed by the resin.

The inner diameter of the lower extension part 6014 is designed so as to have a dimension capable of housing the screw member 5600. The lower extension part 6014 forms a screw-member housing part 6016 inside thereof. The inner diameter of the lower extension part 6014 is greater than the dimension of the lower end of the hosel hole 2010. The inner surface 6018 of the lower extension part 6014 is located on a radial-direction outside of the lower end edge E2. The screw-member housing part 6016 includes a bottom surface 6020. The bottom surface 6020 is a step surface located on the boundary between the hosel hole 2010 and the lower extension part 6014. The lower end edge E2 constitutes an inner edge of the bottom surface 6020. A part of the bottom surface 6020 is the lower end surface of the resin part 2013.

Figure 47:
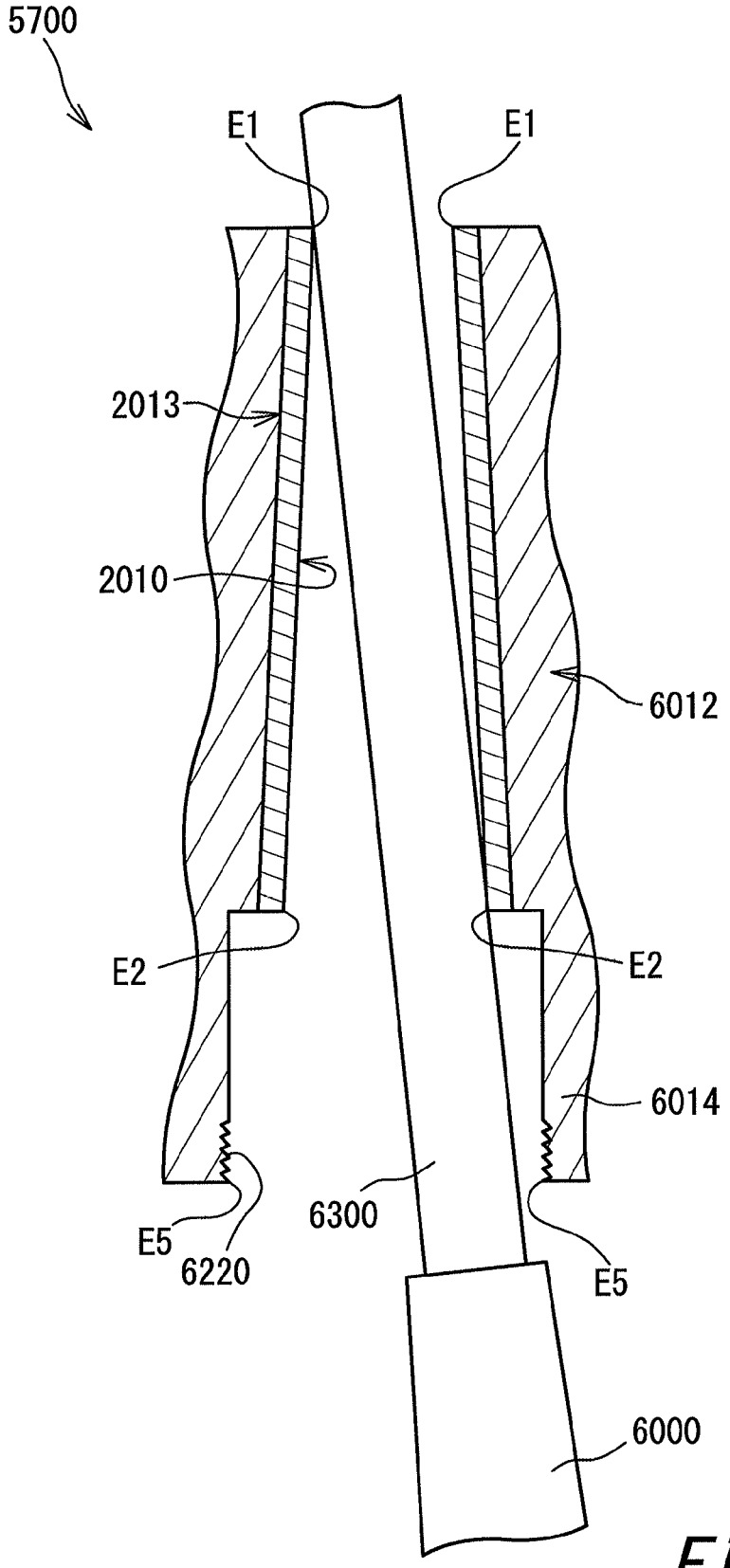
FIG. 47 is a sectional view showing a state which may occur in the golf club of FIG. 46.

In the present embodiment, a shaft 6300 attached to the sleeve 6000 is not brought into contact with a lower end edge E5 of the lower extension part 6014. As shown in FIG. 47, even when the shaft 6300 which is passed through the hosel hole 2010 is inclined with respect to the hosel hole 2010 as much as possible, the shaft 6300 cannot be brought into contact with the lower end edge E5. Therefore, even when the lower end edge E5 is made of a metal, the shaft 6300 is less likely to be damaged. Thus, it is preferable that the lower end edge E5 is located on a position with which the shaft 6300 passed through the hosel hole 2010 cannot be brought into contact.

Figure 48:
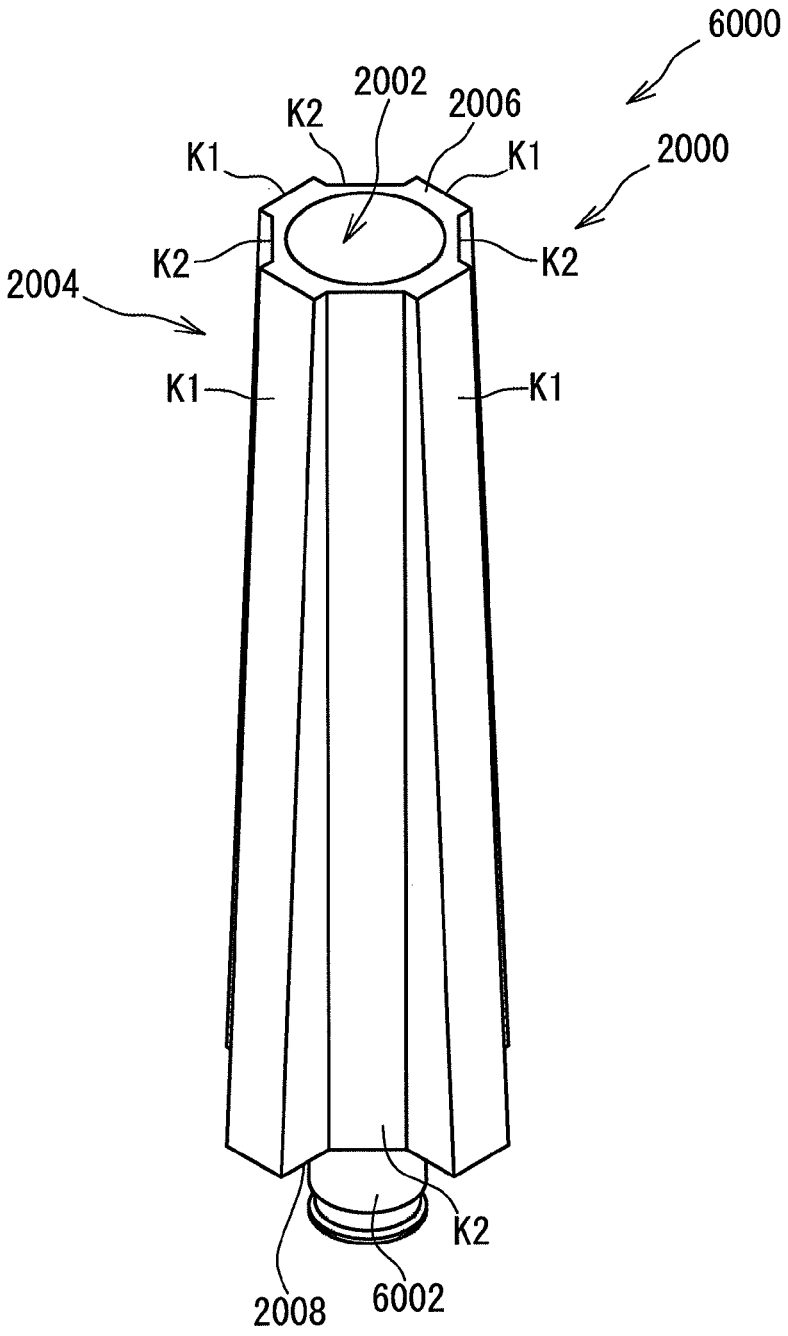
FIG. 48 is a perspective view showing a sleeve of a modification example.

FIG. 48 is a perspective view of the sleeve 6000. As described above, the sleeve 6000 is a sleeve in which the sleeve-side connection part 6002 is added to the lower end surface 2008 of the sleeve 2000. As exemplified in the embodiment of FIG. 46, the screw member 5600 can be used also in the sleeve 6000. The screw member 5600 can be connected to the sleeve-side connection part 6002. Thus, the above-described constitution, in which such a screw member is used, can be applied to other embodiments by providing the sleeve-side connection part at the lower end of the sleeve, and by providing the female screw part used for the screw member on the head-body side.

Figure 49:
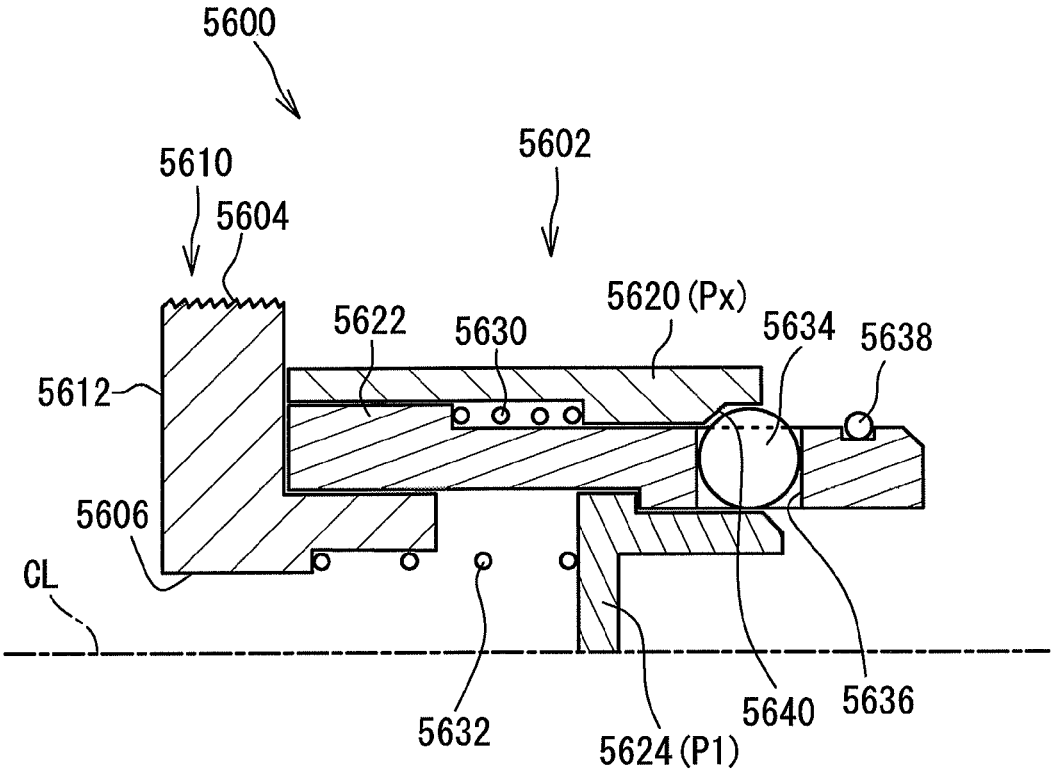
FIG. 49 is a sectional view of an example of the screw member.
Figure 50:
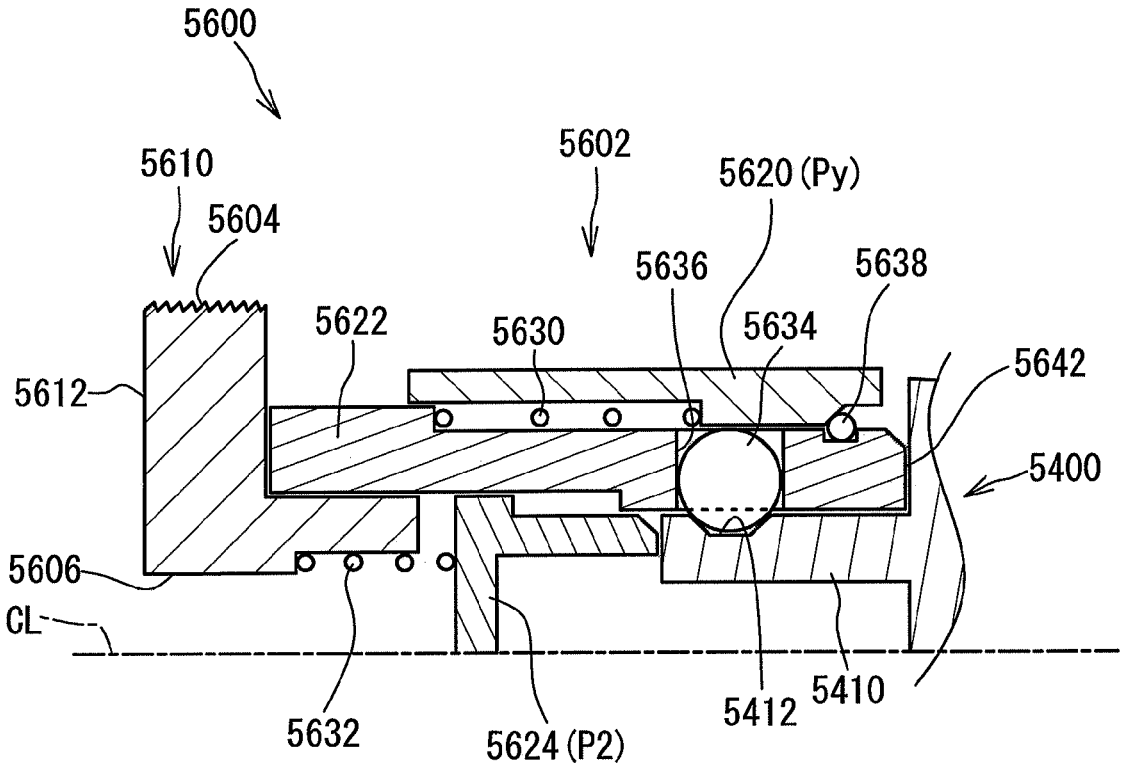
FIG. 50 is a sectional view when the screw member of FIG. 49 and a corresponding sleeve are brought into a connected state.

FIG. 49 is a sectional view of the screw member 5600. FIG. 50 is a sectional view showing a state in which the screw member 5600 is connected to the sleeve 5400. In these sectional views, a center line CL of the screw member 5600 is indicated by a one-dot chain line, and the illustration of portions on the lower side of the center line CL is omitted. The actual sectional views are line-symmetric about the center line CL as an axis of symmetry.

As described above, the screw member 5600 has the screw-side connection part 5602, the male screw part 5604, and the rotating engagement part 5606. A detailed structure of the screw member 5600 will be explained below.

The screw member 5600 includes a screw body 5610. A male screw part 5604 is formed on an outer circumferential surface of the screw body 5610. The rotating engagement part 5606 is provided on a bottom surface 5612 of the screw body 5610. The rotating engagement part 5606 is a recess having a non-circular sectional shape. By inserting a wrench to the rotating engagement part 5606, the screw body 5610 can be rotated about the center line CL. The wrench preferably has a torque limiter. With the torque limiter, the force with which the screw member 5600 presses the tip engagement part RT can be adjusted. From the viewpoint of the Golf Rules, the wrench is preferably used exclusively for the screw member 5600.

The screw-side connection part 5602 includes a first member 5620, a second member 5622, and a third member 5624. The first member 5620, the second member 5622, and the third member 5624 each have a cylindrical shape as a whole. The first member 5620 is exposed to the outside. The second member 5622 is positioned on an inner side of the first member 5620. The second member 5622 is fixed to the screw body 5610. The second member 5622 may be integrally formed with the screw body 5610. The second member 5622 rotates with the rotation of the screw body 5610. The third member 5624 is positioned on an inner side of the second member 5622. The first member 5620 can be slidably moved with respect to the second member 5622. The third member 5624 can be slidably moved with respect to the second member 5622.

The screw-side connection part 5602 includes a first elastic body 5630 and a second elastic body 5632. The first elastic body 5630 is a coil spring. The first elastic body 5630 is a compression spring. The second elastic body 5632 is a coil spring. The second elastic body 5632 is a compression spring.

The screw-side connection part 5602 includes a ball 5634. The ball 5634 is a steel ball. In the present application, the ball 5634 is also referred to as an engagement ball.

The second member 5622 includes a ball housing hole 5636. The ball housing hole 5636 is a through hole. The engagement ball 5634 is disposed in the ball housing hole 5636. The diameter of the ball housing hole 5636 is substantially equal to the diameter of the ball 5634. The engagement ball 5634 can pass through the ball housing hole 5636.

The diameter of the ball 5634 is larger than the depth of the ball housing hole 5636. For this reason, the ball 5634 housed in the ball housing hole 5636 is in a state of being projected to the inner side or the outer side of the second member 5622. In FIG. 49, the ball 5634 is projected to the outer side of the second member 5622.

Although not shown in the drawings, the ball housing holes 5636 are provided at a plurality of positions in the circumferential direction. The ball housing holes 5636 are uniformly spaced in the circumferential direction. Four ball housing holes 5636 are arranged at 90° intervals in the present embodiment. One ball 5634 is disposed in each of the ball housing holes 5636. Here, the circumferential direction means the circumferential direction of the screw member 5600.

The second member 5622 includes a stopper 5638. The stopper 5638 is an annular member disposed in a circumferential groove provided on the outer circumferential surface of the second member 5622. A circlip is used as the annular member.

The first elastic body 5630 is disposed between (a step surface of) the first member 5620 and (a step surface of) the second member 5622. The first elastic body 5630 biases the first member 5620 to a sleeve side (the right side in FIG. 49) with respect to the second member 5622.

The second elastic body 5632 is disposed between (a step surface of) the screw body 5610 and (a bottom surface of) the third member 5624. The second elastic body 5632 biases the third member 5624 to the sleeve side (the right side in FIG. 49) with respect to the screw body 5610.

As described later, at least a part of the screw member 5600 can be formed by a resin. For example, (at least a part of) portions other than the elastic bodies 5630, 5632 and the ball 5634.

In the following, the state of the screw member 5600 shown in FIG. 49 is also referred to as a non-connected state, and the state of the screw member 5600 shown in FIG. 50 is also referred to as a connected state. The sleeve side is also referred to as an upper side, and the sole side is also referred to as a lower side. The right side in FIG. 49 and FIG. 50 is the upper side, and the left side in FIG. 49 and FIG. 50 is the lower side.

In the non-connected state (FIG. 49), the third member 5624 is pressed to the upper side by the second elastic body 5632, and is located at a position P1 on a relatively front side. In the position P1, the third member 5624 abuts on the step surface of the second member 5622.

The third member 5624 located at the position P1 includes a portion positioned on the inner side of the ball housing hole 5636. The third member 5624 located at the position P1 prevents the ball 5634 from being projected to the inner side. Therefore, in the non-connected state, the ball 5634 is projected to the outer side of the second member 5622.

In the non-connected state (FIG. 49), the first member 5620 is pressed to the upper side by the first elastic body 5630, but its movement to the upper side is regulated by the ball 5634 being projected to the outer side. As a result, in the non-connected state, the first member 5620 is located at a position Px on a relatively lower side.

The first member 5620 includes an inclined surface 5640. The inclined surface 5640 is a conically recessed surface. The inclined surface 5640 is inclined so as to extend toward the radially outward direction as going to the upper side. The radial direction means the radial direction of the screw member 5600. In the non-connected state, the inclined surface 5640 abuts on the ball 5634.

When the male screw part 5604 of the screw body 5610 is screwed into the female screw part of the head by rotating the screw member 5600 (screw body 5610) in the first direction, the screw body 5610 is moved to the upper side, and the second member 5622 is also positioned on the upper side by being pressed by the screw body 5610. As a result, the entire screw member 5600 is moved to the upper side.

When the movement of the screw member 5600 to the upper side progresses as the rotation of the screw member 5600 in the first direction is continued, the sleeve-side connection part 5410 of the sleeve 5400 is inserted inside the screw member 5600. More specifically, the sleeve-side connection part 5410 is inserted inside the second member 5622. In the insertion, (a lower end surface of) the sleeve-side connection part 5410 presses the third member 5624 to the lower side against the biasing force of the second elastic body 5632. By the insertion of the sleeve-side connection part 5410, the third member 5624 is moved to a position P2 on a relatively lower side.

By this movement, the abutment between the third member 5624 and the ball 5634 is released. In place of the third member 5624, the engagement recess 5412 of the sleeve-side connection part 5410 reaches the same axial direction position as that of the ball 5634.

As described above, the ball 5634 receives a pressing force from the inclined surface 5640 by the biasing force of the first elastic body 5630, and the pressing force includes a component force acting toward the inner side in the radial direction. Accordingly, the ball 5634 falls in the engagement recess 5412 that has been moved to the inner side in the radial direction of the ball 5634 (FIG. 50). A part of the ball 5634 is located within the engagement recess 5412, and the remaining part of the ball 5634 is located within the ball housing hole 5636. Therefore, the ball 5634 retains the sleeve-side connection part 5410 in the screw-side connection part 5602.

When the ball 5634 falls in the engagement recess 5412, the abutment between the ball 5634 and the first member 5620 is released. As a result, the first member 5620 is moved to a second position Py on a relatively upper side by the biasing force of the first elastic body 5630. At the second position Py, the first member 5620 abuts on the stopper 5638. The connected state is achieved by the movement of the first member 5620.

As shown in FIG. 50, the first member 5620 located at the second position Py prevents the ball 5634 from being projected to the outer side. Therefore, the state in which the ball 5634 falls in the engagement recess 5412 is maintained. That is, the connected state is maintained. As long as the second position Py of the first member 5620 is maintained, it is not possible to pull out the sleeve-side connection part 5410 from the screw member 5600.

Thus, by simply rotating the screw member 5600 in the first direction with respect to the female screw part 5220 (see FIG. 44), the sleeve 5400 and the screw member 5600 are automatically connected to each other, whereby the connected state is achieved (FIG. 50). In the connected state, the third member 5624 is located at the position P2, the first member 5620 is located at the position Py, and the ball 5634 is engaged with the engagement recess 5412.

In the connected state, the screw member 5600 presses the sleeve 5400 to the upper side. Specifically, an upper end surface 5642 of the second member 5622 presses the sleeve 5400. As a result, the screw member 5600 presses the sleeve 5400 in the engaging direction. Therefore, the tip engagement part RT including the sleeve 5400 is reliably fitted to the hosel hole 5204, whereby backlash resulting from a dimensional error can be eliminated.

Elimination of backlash is accompanied by an elastic deformation of the tip engagement part RT or the hosel hole 5204. Once fitting accompanied by the elastic deformation has been achieved, it will be difficult to release the fitting. That is, the tip engagement part RT is fitted into the hosel hole 5204, and thus is difficult to be pulled out from the hosel hole 5204. The connection between the screw member 5600 and the sleeve 5400 can solve this problem. When the screw member 5600 is rotated in the second direction while maintaining the connected state, the screw member 5600 is moved to the lower side, and the sleeve 5400 is pulled in the engagement releasing direction by the screw member 5600. As a result, the tip engagement part RT including the sleeve 5400 is pulled out from the hosel hole 5204.

As described above, the connection is maintained unless the first member 5620 located at the second position Py is moved. Therefore, the connection is maintained when the screw member 5600 is simply rotated in the second direction. The pulling-out of the tip engagement part RT is achieved by simply rotating the screw member 5600 in the second direction.

To release the connection, the first member 5620 should be moved to the lower side. The connected state can be released by moving the first member 5620 to the position Px so as to bring about a state in which the ball 5634 can be projected to the outer side. The movement of the first member 5620 is achieved by an external force. For example, the connected state can be released by simply moving the first member 5620 to the lower side by fingers. The first member 5620 can be moved by applying an external force greater than the biasing force of the first elastic body 5630.

Thus, the connection can be easily released. The connection should be released upon confirmation of pulling out of the tip engagement part RT including the sleeve 5400 from the hosel hole 5204.

As explained above, in the present embodiment, by the rotation in the first direction DR1, the screw member 5600 presses the tip engagement part RT in the engaging direction, and the sleeve-side connection part 5410 is inserted to the screw-side connection part 5602. The connection between the sleeve-side connection part 5410 and the screw-side connection part 5602 is automatically completed by the sleeve-side connection part being inserted to the screw-side connection part. Therefore, by simply screwing the screw member 5600, the backlash between the tip engagement part RT and the head is eliminated, and the above-described connection that is effective for pulling out the tip engagement part RT is completed simultaneously.

In the present embodiment, the screw member 5600 includes the screw body 5610 having the male screw part 5604; the first member 5620 constituting an outer circumferential surface of the screw-side connection part 5602; the second member 5622 positioned on the inner side of the first member 5620; and the third member 5624 positioned on the inner side of the second member 5622. The screw member 5600 further includes the first elastic body 5630 that is disposed between the first member 5620 and the second member 5622, and biases the first member 5620 to the sleeve side (upper side) with respect to the second member 5622; the second elastic body 5632 that biases the third member 5624 to the sleeve side (upper side); and the engagement ball 5634 disposed in the ball housing hole 5636. The sleeve-side connection part 5410 includes the engagement recess 5412. In the non-connected state, the ball 5634 is projected to the outer side of the second member 5622 by the third member 5624 being positioned on the inner side of the ball 5634, and by the projected ball 5634, the first member 5620 is located at the first position Px at which movement thereof to the sleeve side is regulated. In the connected state in which the connection has been achieved, the third member 5624 is shifted to a position at which the third member 5624 is removed from the inner side of the engagement ball 5634 by the sleeve-side connection part 5410, the engagement ball 5634 falls in the engagement recess 5412, and the movement regulation on the first member 5620 by the engagement ball 5634 is released, whereby the first member 5620 is shifted to the second position Py at which the first member 5620 prevents the engagement ball 5634 from projecting to the outer side. Therefore, the above-described automatic connection is reliably achieved, and the connection can be easily released.

A mechanism used for a fluid coupling or an instant coupling may be adopted as the connecting structure of the screw-side connection part and the sleeve-side connection part. This mechanism is disclosed in Japanese Unexamined Utility Model Application Publication No. 60-108888, for example. Such a mechanism achieves connection by simply inserting one member into the other member, and the connection can be easily released, and therefore can be applied to the golf club according to the present disclosure.

Figure 51:
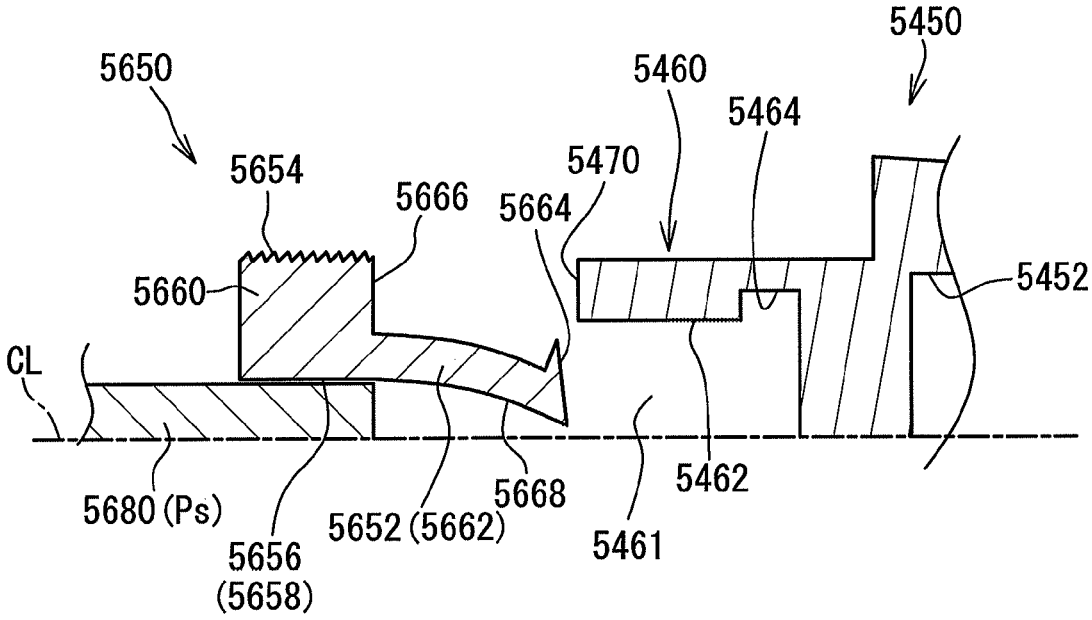
FIG. 51 is a sectional view of another screw member and a corresponding sleeve.
Figure 52:
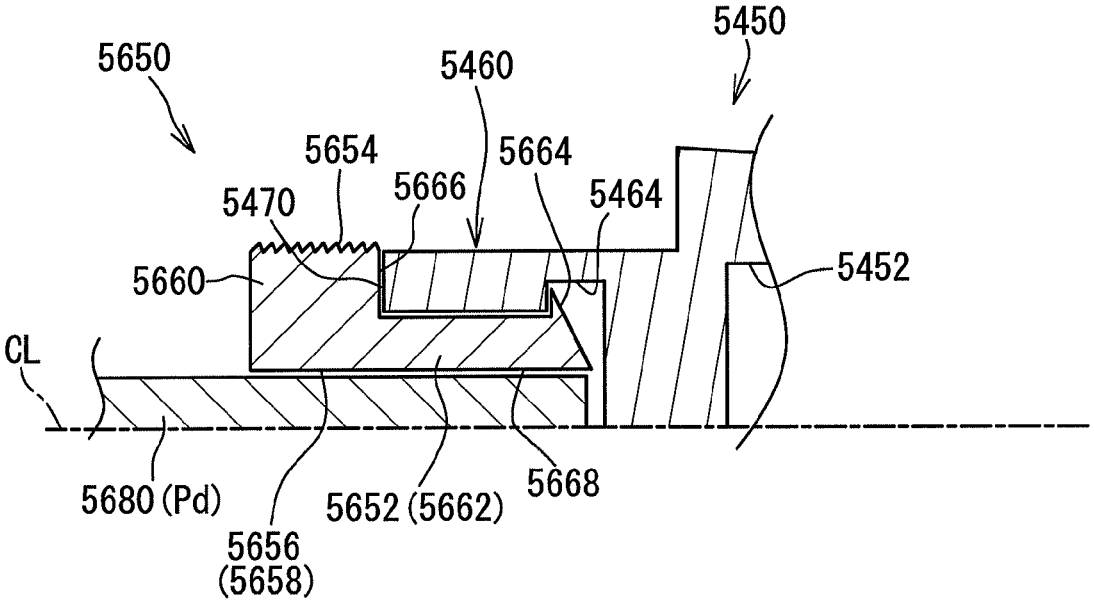
FIG. 52 is a sectional view when the screw member and sleeve in FIG. 51 are brought into a connected state.

FIG. 51 and FIG. 52 are sectional views showing a screw member 5650 according to another embodiment, and a sleeve 5450 corresponding to the screw member 5650. FIG. 51 shows a non-connected state, and FIG. 52 shows a connected state.

In FIG. 51 and FIG. 52, a center line CL of the screw member 5650 is indicated by a one-dot chain line, and the illustration of portions on the lower side of the center line CL is omitted. The actual sectional views are line-symmetric about the center line CL as an axis of symmetry.

The screw member 5650 has a cylindrical shape as a whole. The screw member 5650 includes a screw-side connection part 5652 and a male screw part 5654. The screw member 5650 further includes a rotating engagement part 5656. The rotating engagement part 5656 is a hole coaxial with the center line CL. The sectional shape of the hole is a non-circle. The rotating engagement part 5656 penetrates the screw member 5650.

The screw member 5650 includes a screw body part 5660 and an elastic deformation part 5662. The elastic deformation part 5662 includes an engagement projection 5664. The screw body part 5660 includes a cylindrical shape. The male screw part 5654 is formed on the outer circumferential surface of the screw body part 5660. The elastic deformation part 5662 is positioned on the upper side of the screw body part 5660.

The elastic deformation part 5662 exhibits a shape resembling a bent bar as a whole. The elastic deformation part 5662 extends from an upper end surface 5666 of the screw body part 5660 toward the upper side. The upper end (right end in FIG. 51) of the elastic deformation part 5662 is a free end, and the engagement projection 5664 is formed at the free end.

Although not shown in the drawings, the elastic deformation parts 5662 are provided at a plurality of locations in the circumferential direction of the screw body part 5660. In the present embodiment, the elastic deformation parts 5662 are provided at four locations in the circumferential direction of the screw body part 5660. All the elastic deformation parts 5662 are bent so as to become closer to the center line of the screw member 5650 with decreasing distance to the free end.

As described above, the rotating engagement part 5656 penetrates the screw member 5650. More specifically, the rotating engagement part 5656 penetrates the screw body part 5660. That is, the through hole penetrating the screw body part 5660 constitutes a part of the rotating engagement part 5656. Furthermore, an inner surface 5668 of the elastic deformation part 5662 also constitutes a part of the rotating engagement part 5656. The inner surface 5668 is continuous with the through hole penetrating the screw body part 5660.

The sleeve 5450 includes a shaft hole 5452. A shaft is inserted and adhered to the shaft hole 5452. In FIG. 51 and FIG. 52, the illustration of the shaft is omitted.

The sleeve 5450 includes a sleeve-side connection part 5460. The sleeve-side connection part 5460 has a cylindrical shape. The sleeve-side connection part 5460 includes a hollow portion 5461 and an inner surface 5462. The hollow portion 5461 is opened to the screw member 5650 side. The inner side of the inner surface 5462 constitutes the hollow portion 5461. The inner surface 5462 defines the hollow portion 5461. The inner surface 5462 is a circumferential surface. The inner surface 5462 includes an engagement recess 5464. The engagement recess 5464 is a circumferential groove.

FIG. 51 and FIG. 52 show a wrench 5680 used for rotating the screw member 5650. The sectional shape of the wrench 5680 corresponds to the sectional shape of the rotating engagement part 5656. The sectional shape of the wrench 5680 is a tetragon (square). As shown in FIG. 51 and FIG. 52, the screw-connection between the male screw part 5654 and the female screw part 5220 is enabled by inserting the wrench 5680 into the rotating engagement part 5656 and rotating the wrench 5680.

As shown in FIG. 51, in a state in which an external force is not applied, the elastic deformation part 5662 is bent. The state in which an external force is not applied is also referred to as a natural state. In FIG. 51, the wrench 5680 is shallowly inserted. The wrench 5680 remains at the screw body part 5660, and has not reached the inside of the elastic deformation part 5662. Therefore, the wrench 5680 does not abut on the elastic deformation part 5662, and thus does not elastically deform the elastic deformation part 5662. An insertion position at which the elastic deformation part 5662 is not elastically deformed is also referred to as a first insertion position Ps.

On the other hand, as shown in FIG. 52, the elastic deformation part 5662 abuts on the wrench 5680 when the wrench 5680 is deeply inserted. As a result, the elastic deformation part 5662 is elastically deformed so as to extend along the wrench 5680. The elastic deformation part 5662 is straightened by the elastic deformation. The elastic deformation causes the engagement projection 5664 of the elastic deformation part 5662 to reach a position at which the engagement projection 5664 is engaged with the engagement recess 5464 of the sleeve-side connection part 5460. An insertion position at which the engagement projection 5664 is engaged with the engagement recess 5464 is also referred to as a second insertion position Pd.

Although a gap is present between the elastic deformation part 5662 and the wrench 5680 in FIG. 52, the gap is not actually present. The elastic deformation part 5662 is deformed to the outer side by abutting on the wrench 5680, and is thereby straightened.

Such a screw member 5650 can also fulfill the same function as that of the above-described screw member 5600.

To press the sleeve 5450 in the engaging direction, the screw member 5650 is screwed into the female screw part of the head. At this time, the wrench 5680 is inserted shallowly. That is, the wrench 5680 is positioned at the first insertion position Ps. While maintaining the shallow insertion (first insertion position Ps), the screw member 5650 is rotated in the first direction DR1. Then, the screw-connection of the screw member 5650 progresses while the natural state of the elastic deformation part 5662 is maintained. In the elastic deformation part 5662 in the natural state, the engagement projection 5664 is positioned on the inner side of the inner surface 5462. Therefore, the elastic deformation part 5662 is smoothly inserted inside the sleeve-side connection part 5460. Finally, a lower end surface 5470 of the sleeve-side connection part 5460 abuts on an abutting surface 5666 of the screw member 5650, whereby the sleeve 5450 is pressed in the engaging direction.

To remove the screw member 5650, the wrench 5680 is inserted deeply. That is, the wrench 5680 is positioned at the second insertion position Pd (FIG. 52). This insertion causes the elastic deformation part 5662 to be elastically deformed, whereby the engagement projection 5664 is engaged with (caught by) the engagement recess 5464. That is, the screw member 5650 is connected to the sleeve 5450. While maintaining the deep insertion (second insertion position Pd), the screw member 5650 is rotated in the second direction DR2. Then, the screw member 5650 is moved to the lower side while the connection between the screw member 5650 and the sleeve 5450 is maintained. As a result, the tip engagement part RT including the sleeve 5450 is pulled out from the hosel hole 5204. The connection between the screw member 5650 and the sleeve 5450 can be easily released by making the insertion of the wrench 5680 shallow.

Thus, the connection can be easily released. The connection should be released upon confirmation of pulling out of the tip engagement part RT including the sleeve 5450 from the hosel hole 5204.

As explained above, the screw member 5650 includes: the screw body part 5660 having the male screw part 5654; the elastic deformation part 5662 extending from the screw body part 5660 to the sleeve side (upper side) and constituting the screw-side connection part 5652; and the rotating engagement part 5656 to which the wrench 5680 for rotating the screw member 5650 can be inserted. The rotating engagement part 5656 includes the through hole 5658 penetrating the screw body part 5660, and the inner surface 5668 of the elastic deformation part 5662 that extends continuously with the through hole 5658. The elastic deformation part 5662 includes the engagement projection 5664 at an end portion thereof on the sleeve side, and the end portion on the sleeve side is the free end. The sleeve-side connection part 5460 includes the hollow portion 5461 opened to the screw member 5650 side, the inner surface 5462 defining the hollow portion 5461, and the engagement recess 5464 provided on the inner surface 5462. In a natural state, the elastic deformation part 5662 including the engagement projection 5664 exhibits a shape that can be inserted to the hollow portion 5461 with rotation of the screw member 5650 in the first direction DR1. When the wrench 5680 is inserted to a position at which the wrench 5680 abuts on the inner surface 5668 of the elastic deformation part 5662, the elastic deformation part 5662 is elastically deformed so as to be located at a position at which the engagement projection 5664 of the elastic deformation part 5662 can be engaged with the engagement recess 5464.

With this configuration, the wrench 5680 can be inserted shallowly when rotating the screw member 5650 in the first direction DR1, whereby the pressing of the tip engagement part RT is enabled. The wrench 5680 can be inserted deeply when rotating the screw member 5650 in the second direction DR2, whereby the pulling out of the tip engagement part RT is enabled.

Each of the above-described screw members plays the role (role A) of pressing the tip engagement part RT in the engaging direction, and the role (role B) of pulling the tip engagement part RT in the engagement releasing direction. These screw members can also be used to play only the role B. For example, the role A can be fulfilled by replacing the screw member with another screw member that does not have the connecting function to the sleeve. A screw member having the above-described connecting function may be used only when the tip engagement part RT is removed from the reverse-tapered hole. In this case, the screw member mounted to the golf club being used can be a screw member that does not have the connecting function, so that the weight of the golf club can be reduced.

In the above-described embodiments, the upper end edge E1 and the lower end edge E2 are formed by a resin. Therefore, the damage on the shaft can be prevented. A portion that can be damaged in attaching/detaching operation of the shaft is the tip end portion of the shaft. A great impact force acts on the tip end portion of the shaft in shots. Therefore, the shaft strength can deteriorate because of a small damage at the tip end portion of the shaft. Furthermore, the damage causes peeling off of the coating of the shaft and spoils the appearance. By forming the upper end edge E1 and the lower end edge E2 with a resin, the damage of the shaft is suppressed so that the deterioration of the shaft strength can be prevented. In addition, the peeling off of the coating is suppressed so that the appearance is improved. These advantageous effects are further enhanced by forming the inner surface of the hosel hole (reverse-tapered hole) with the resin.

The resin part can be formed by injection forming, press forming, etc. Therefore, highly accurate forming can be easily performed. Formation of the hosel hole (reverse-tapered hole) by the resin part eliminates the need to highly accurately form the hosel hole in formation of the head, thereby reducing manufacturing costs.

A high dimensional accuracy is needed in order to achieve a reverse-tapered fitting without backlash. When the inner surface of the hosel hole is made of a metal, a NC process, for example, is needed for forming the inner surface with high accuracy. The cost required for this process is high. A high dimensional accuracy can be achieved with low cost by forming the hosel hole with the resin part.

A resin has a small specific gravity as compared with a metal. Weight reduction of the shaft attaching/detaching mechanism is achieved by using a resin for a part of the hosel. The degree of freedom of design of the head is increased by distributing the weight saved by the weight reduction to other portions of the head.

In such a conventional attaching/detaching mechanism as shown in US2013/0017901 and U.S. Pat. No. 7,980,959 described above, a burden (stress) on the screw part and/or the sleeve is great. For this reason, it is difficult to use a resin for components of the mechanism in view of the strength and durability. On the other hand, in the engagement structure of the present disclosure, burdens on the respective components are small since the reverse-tapered fitting is used. Therefore, the resin part can be provided as shown in the above embodiments.

The resin constituting the upper end edge E1 and the lower end edge E2 (above-described resin part) is not limited. In light of damage prevention and dimensional accuracy, a resin having an appropriate hardness and being excellent in formability and durability is preferable. As described above, since the burden on the attaching/detaching mechanism is small in the reverse-tapered engagement, a resin, the rigidity and strength of which are not very high, can also be used. For example, a resin having a tensile strength based on ASTM D-638 of 1100 (kgf/cm$^2$) or less can be used. A resin having a flexural strength based on ASTM D-790 of 1600 (kgf/cm$^2$) or less can also be used. A generally used resin can also be an option. Since there are many options, a resin that has a high forming accuracy and that is low cost can be selected. Specific examples of the resin include nylon 6, nylon 66, polyacetal, polycarbonate, polyethylene terephthalate, modified polyphenylene ether, polybutylene terephthalate, ultrahigh molecular weight polyethylene and polystyrene. Particularly, polyacetal, polycarbonate, modified polyphenylene ether, and polystyrene are preferable.

The material of the sleeve is not limited. Preferable examples of the material include a titanium alloy, stainless steel, an aluminum alloy, a magnesium alloy, and a resin. In light of strength and lightweight properties, for example, the aluminum alloy and the titanium alloy are preferable as the metal.

In light of weight reduction of the shaft attaching/detaching mechanism, the sleeve is preferably made of a resin. The degree of freedom of design of the head is increased by distributing the weight saved by the weight reduction of the sleeve to other portions of the head.

As described above, the burden on the sleeve is small in the structure using the reverse-tapered fitting. Therefore, unlike conventional attaching/detaching mechanisms, the sleeve can be formed by a resin. A resin, the rigidity and strength of which are not very high, can also be used. Examples of the resin include nylon 6, nylon 66, polyacetal, polycarbonate, polyethylene terephthalate, modified polyphenylene ether, polybutylene terephthalate, ultrahigh molecular weight polyethylene and polystyrene. Particularly, polyacetal, polycarbonate, modified polyphenylene ether, and polystyrene are preferable.

The material of the spacer is not limited. Preferable materials for the spacer are the same as those of the sleeve.

In light of weight reduction of the shaft attaching/detaching mechanism, the spacer is preferably made of a resin. The screw member also includes a portion on which burden is small. At least a part of the screw member can be formed by a resin. In this case, the weight of the screw member can be reduced. The degree of freedom of design of the head is increased by distributing the weight saved by the weight reductions to other portions of the head.

As described above, the above-described embodiments can include the adjusting mechanism capable of adjusting the position and/or angle of the center line of the shaft. The embodiments also include the falling-off prevention mechanism. These mechanisms preferably satisfy the Golf Rules defined by the R&A (The Royal andAncient Golf Club of Saint Andrews). That is, the mechanisms preferably satisfy requirements specified in "lb Adjustability" in "1. Clubs" of "Appendix II Design of Clubs" defined by R&A. The requirements specified in the "lb Adjustability" are the following items (i), (ii), and (iii):

(i) the adjustment cannot be readily made;

(ii) all adjustable parts are firmly fixed and there is no reasonable likelihood of them working loose during a round; and (iii) all configurations of adjustment conform to the Rules.

As to the above-described embodiments, the following clauses are disclosed.

[Clause 1]

A golf club comprising:

a head including a hosel part;

a shaft; and a tip engagement part having a reverse-tapered shape and being disposed at a tip end portion of the shaft, wherein the tip engagement part includes a sleeve having a reverse-tapered shape and being fixed to the tip end portion of the shaft, the hosel part includes a hosel hole, the hosel hole includes a reverse-tapered hole having a shape corresponding to at least a part of a shape of an outer surface of the tip engagement part, the tip engagement part is fitted to the reverse-tapered hole, and the hosel hole includes an upper end edge and a lower end edge that are formed by a resin.

[Clause 2]

The golf club according to the clause 1, wherein the reverse-tapered hole has an inner surface that is formed by a resin.

[Clause 3]

The golf club according to the clause 1 or 2, wherein the sleeve is made of a resin.

[Clause 4]

The golf club according to any one of the clauses 1 to 3, wherein the hosel part includes a hosel slit that is provided lateral to the hosel hole and that allows the shaft to pass through the hosel slit.

[Clause 5]

The golf club according to any one of the clauses 1 to 3, wherein the tip engagement part includes a reverse-tapered engagement face, and a non-engagement face provided at a circumferential direction position different from that of the reverse-tapered engagement face, the hosel hole includes a reverse-tapered hole face corresponding to the reverse-tapered engagement face, and an interference-avoiding face provided at a circumferential direction position different from that of the reverse-tapered hole face, in a first phase state in which the reverse-tapered engagement face is opposed to the interference-avoiding face, the hosel hole allows the tip engagement part to pass through the hosel hole, and in a second phase state in which the reverse-tapered engagement face is opposed to the reverse-tapered hole face, the reverse-tapered engagement face is fitted to the reverse-tapered hole face.

[Clause 6]

The golf club according to any one of the clauses 1 to 3, wherein the tip engagement part includes the sleeve and a spacer having a reverse-tapered shape and being externally fitted to the sleeve, the spacer has a divided structure, the hosel hole is configured to pass the sleeve through the hosel hole, the tip engagement part is fitted to the reverse-tapered hole, and the sleeve is fitted inside the spacer.

[Clause 7]

The golf club according to the clause 6, wherein the spacer is made of a resin.

[Clause 8]

The golf club according to any one of the clauses 1 to 7, wherein either one of the outer surface of the tip engagement part and the inner surface of the reverse-tapered hole includes an abutting engagement face;

the other one of the outer surface of the tip engagement part and the inner surface of the reverse-tapered hole includes a first abutting face and a second abutting face;

a first state in which the abutting engagement face abuts on the first abutting face is formed when the tip engagement part is set on a first rotation position, and a second state in which the abutting engagement face abuts on the second abutting face is formed when the tip engagement part is set on a second rotation position; and an axial direction position of the tip engagement part with respect to the hosel hole in the first state is different from that of the second state, and a club length is adjusted by the difference.

[Clause 9]

The golf club according to any one of the clauses 1 to 8, wherein the tip engagement part includes the sleeve and a spacer having a reverse-tapered shape and being externally fitted to the sleeve, and a club length is changed by changing a wall thickness of the spacer.

The above description is merely illustrative example, and various modifications can be made without departing from the principles of the present disclosure.

What is claimed is:

1. A golf club comprising:

a head including a hosel part;

a shaft; and a tip engagement part having a reverse-tapered shape and being disposed at a tip end portion of the shaft, wherein the tip engagement part includes a sleeve having a reverse-tapered shape and being fixed to the tip end portion of the shaft, the hosel part includes a hosel hole, the hosel hole includes an upper end edge, a lower end edge, and a reverse-tapered hole corresponding to at least a part of an outer surface of the tip engagement part, the tip engagement part is fitted to the reverse-tapered hole, in the hosel hole, at least the upper end edge and the lower end edge are formed by a resin, the hosel part includes a hosel body and a resin part disposed on the hosel body, the hosel body is made of a metal, and the upper end edge and the lower end edge are formed by the resin part.

2. The golf club according to claim 1, wherein the reverse-tapered hole has an inner surface that is formed by a resin.

3. The golf club according to claim 1, wherein the sleeve is made of a resin.

4. The golf club according to claim 1, wherein the hosel part includes a hosel slit that is provided lateral to the hosel hole and that allows the shaft to pass through the hosel slit.

5. The golf club according to claim 4, wherein the hosel slit has an outer edge and an inner edge that are formed by a resin.

6. The golf club according to claim 1, wherein the tip engagement part includes a reverse-tapered engagement face, and a non-engagement face provided at a circumferential direction position different from that of the reverse-tapered engagement face, the hosel hole includes a reverse-tapered hole face corresponding to the reverse-tapered engagement face, and an interference-avoiding face provided at a circumferential direction position different from that of the reverse-tapered hole face, in a first phase state in which the reverse-tapered engagement face is opposed to the interference-avoiding face; the hosel hole allows the tip engagement part to pass through the hosel hole, and in a second phase state in which the reverse-tapered engagement face is opposed to the reverse-tapered hole face, the reverse-tapered engagement face is fitted to the reverse-tapered hole face.

7. The golf club according to claim 1, wherein the tip engagement part includes the sleeve, and a spacer having a reverse-tapered shape and being externally fitted to the sleeve, the spacer has a divided structure, the hosel hole is configured to pass the sleeve through the hosel hole, the tip engagement part is fitted to the reverse-tapered hole, and the sleeve is fitted inside the spacer.

8. The golf club according to claim 7, wherein the spacer is made of a resin.

9. The golf club according to claim 1, wherein either one of the outer surface of the tip engagement part and an inner surface of the reverse-tapered hole includes an abutting engagement face;

the other one of the outer surface of the tip engagement part and the inner surface of the reverse-tapered hole includes a first abutting face and a second abutting face;

a first state in which the abutting engagement face abuts on the first abutting face is formed when the tip engagement part is set on a first rotation position, and a second state in which the abutting engagement face abuts on the second abutting face is formed when the tip engagement part is set on a second rotation position; and an axial direction position of the tip engagement part with respect to the hosel hole in the first state is different from that of the second state, and a club length is adjusted by the difference.

10. The golf club according to claim 1, wherein the tip engagement part includes the sleeve, and a spacer having a reverse-tapered shape and being externally fitted to the sleeve, and a club length is changed by changing a wall thickness of the spacer.

11. The golf club according to claim 1, wherein the resin part forms a whole inner surface of the hosel hole.

12. The golf club according to claim 1, wherein the hosel part includes an upper resin part and a lower resin part, the upper resin part forms an upper end portion of the reverse-tapered hole, and the upper end edge, and the lower resin part forms a lower end portion of the reverse-tapered hole and the lower end edge.

13. A golf club kit including the golf club according to claim 1, wherein the tip engagement part includes the sleeve, and a spacer having a reverse-tapered shape and being externally fitted to the sleeve, the golf club kit further includes a replacement spacer having a wall thickness different from that of the spacer, and a club length is changed by replacing the spacer with the replacement spacer.

14. A golf club comprising:

a head including a hosel part;

a shaft; and a tip engagement part having a reverse-tapered shape and being disposed at a tip end portion of the shaft, wherein the tip engagement part includes a sleeve having a reverse-tapered shape and being fixed to the tip end portion of the shaft, the hosel part includes a hosel hole, the hosel hole includes an upper end edge, a lower end edge, and a reverse-tapered hole corresponding to at least a part of an outer surface of the tip engagement part, the tip engagement part is fitted to the reverse-tapered hole, in the hosel hole, at least the upper end edge and the lower end edge are formed by a resin, and the hosel part includes a hosel slit that is provided lateral to the hosel hole and that allows the shaft to pass through the hosel slit.

15. A golf club comprising:

a head including a hosel part;

a shaft; and a tip engagement part having a reverse-tapered shape and being disposed at a tip end portion of the shaft, wherein the tip engagement part includes a sleeve having a reverse-tapered shape and being fixed to the tip end portion of the shaft, the hosel part includes a hosel hole, the hosel hole includes an upper end edge, a lower end edge, and a reverse-tapered hole corresponding to at least a part of an outer surface of the tip engagement part, the tip engagement part is fitted to the reverse-tapered hole, in the hosel hole, at least the upper end edge and the lower end edge are formed by a resin, the tip engagement part includes a reverse-tapered engagement face, and a non-engagement face provided at a circumferential direction position different from that of the reverse-tapered engagement face, the hosel hole includes a reverse-tapered hole face corresponding to the reverse-tapered engagement face, and an interference-avoiding face provided at a circumferential direction position different from that of the reverse-tapered hole face, in a first phase state in which the reverse-tapered engagement face is opposed to the interference-avoiding face, the hosel hole allows the tip engagement part to pass through the hosel hole, and in a second phase state in which the reverse-tapered engagement face is opposed to the reverse-tapered hole face, the reverse-tapered engagement face is fitted to the reverse-tapered hole face.

16. A golf club comprising:

a head including a hosel part;

a shaft; and a tip engagement part having a reverse-tapered shape and being disposed at a tip end portion of the shaft, wherein the tip engagement part includes a sleeve having a reverse-tapered shape and being fixed to the tip end portion of the shaft, the hosel part includes a hosel hole, the hosel hole includes an upper end edge, a lower end edge, and a reverse-tapered hole corresponding to at least a part of an outer surface of the tip engagement part, the tip engagement part is fitted to the reverse-tapered hole, in the hosel hole, at least the upper end edge and the lower end edge are formed by a resin, either one of the outer surface of the tip engagement part and an inner surface of the reverse-tapered hole includes an abutting engagement face;

the other one of the outer surface of the tip engagement part and the inner surface of the reverse-tapered hole includes a first abutting face and a second abutting face;

a first state in which the abutting engagement face abuts on the first abutting face is formed when the tip engagement part is set on a first rotation position, and a second state in which the abutting engagement face abuts on the second abutting face is formed when the tip engagement part is set on a second rotation position; and an axial direction position of the tip engagement part with respect to the hosel hole in the first state is different from that of the second state, and a club length is adjusted by the difference.

* * * * *